US007176875B2

(12) United States Patent
Nagata et al.

(10) Patent No.: US 7,176,875 B2
(45) Date of Patent: Feb. 13, 2007

(54) DATA TRANSFER METHOD, IMAGE DISPLAY DEVICE AND SIGNAL LINE DRIVING CIRCUIT, ACTIVE-MATRIX SUBSTRATE

(75) Inventors: Hisashi Nagata, Nara (JP); Noboru Noguchi, Tenri (JP); Katsuya Mizukata, Shijonawate (JP)

(73) Assignee: Sharp Kabushiki Kaisha, Osaka (JP)

( * ) Notice: Subject to any disclaimer, the term of this patent is extended or adjusted under 35 U.S.C. 154(b) by 854 days.

(21) Appl. No.: 09/803,509

(22) Filed: Mar. 9, 2001

(65) Prior Publication Data

US 2001/0020929 A1 Sep. 13, 2001

(30) Foreign Application Priority Data

Mar. 10, 2000 (JP) ..... 2000-067585
Sep. 28, 2000 (JP) ..... 2000-297524

(51) Int. Cl.
*G09G 3/36* (2006.01)

(52) U.S. Cl. ..... 345/100; 345/103

(58) Field of Classification Search ..... 345/96, 345/99, 100, 103, 209
See application file for complete search history.

(56) References Cited

U.S. PATENT DOCUMENTS 4,870,399 A * 9/1989 Carlson ..... 345/55
5,654,735 A 8/1997 Nakajima
6,262,702 B1 * 7/2001 Murade ..... 345/87
6,377,235 B1 * 4/2002 Murade et al. ..... 345/100
6,462,727 B2 * 10/2002 Shin ..... 345/99
6,563,478 B2 5/2003 Aoki ..... 345/58
6,680,722 B1 * 1/2004 Hiraki et al. ..... 345/96
6,731,266 B1 * 5/2004 Jung ..... 345/103
6,781,605 B2 * 8/2004 Kudo et al. ..... 345/690
6,816,144 B2 * 11/2004 Tsuchi ..... 345/100
2002/0080106 A1 * 6/2002 Miwa et al. ..... 345/87

FOREIGN PATENT DOCUMENTS

| | | |
|---|---|---|
| JP | 61-256390 | 11/1986 |
| JP | 05-313137 | 11/1993 |
| JP | 06-171363 | 7/1996 |
| JP | 08-234237 | 9/1996 |
| JP | 08-248927 | 9/1996 |
| JP | 10-124013 | 5/1998 |
| JP | 2783265 | 5/1998 |
| JP | 10-198321 | 7/1998 |
| JP | 11-065536 | 3/1999 |
| JP | 11-175041 | 7/1999 |
| JP | 11-212519 | 8/1999 |
| JP | 11-352462 | 12/1999 |
| JP | 2000-221476 | 8/2000 |
| JP | 2000-267616 | 9/2000 |
| WO | WO 00/38165 | 6/2000 |

* cited by examiner

*Primary Examiner*—Amare Mengistu
(74) *Attorney, Agent, or Firm*—David G. Conlin; Steven M. Jensen; Edwards Angell Palmer & Dodge LLP

(57) ABSTRACT

Each signal line enters a preliminary polarity inversion period prior to a normal polarity inversion period so as to be inverted to the opposite polarity. By the preliminary polarity inversion a signal line on a border of blocks experiences a potential hike and the potential oscillates, which, however, is restored later by the application of a correct potential in the normal polarity inversion period. When transferring data per block, the problem of different potential states between the border of the blocks and an area surrounding it, which is caused by the potential oscillation of the signal line on the border of the blocks, is relieved.

19 Claims, 29 Drawing Sheets

DATA TRANSFER METHOD, IMAGE DISPLAY DEVICE AND SIGNAL LINE DRIVING CIRCUIT, ACTIVE-MATRIX SUBSTRATE

FIELD OF THE INVENTION

The present invention relates to a data transfer method for carrying out data transfer using a matrix substrate such as an active-matrix substrate used in liquid crystal display devices and the like, and relates also to image display devices, signal line driving circuits, and active-matrix substrates used in liquids crystal display devices and the like.

There have been used a variety of data transfer devices which exchange data between elements, such as a display section or a photo-receiving section where signal lines and scanning lines are provided in a matrix pattern, and other elements.

For example, active-matrix substrates used in display devices such as a liquid crystal display device have signal lines for supplying display signals to pixels, and scanning lines for driving a switching element provided for each pixel. In order to drive these signal and scanning lines, external driving circuits (signal line driving circuit, scanning line driving circuit) are installed.

Conventionally, the external driving circuits were provided with the same number of output terminals as the number of signal lines and scanning lines for driving these lines. However, attempts have been made to reduce the number of components of the external circuit and to reduce the cost of installing it, by a method in which the number of ICs is reduced to half or one-third, and signals are supplied selectively by signal line switching elements by branching the ICs. For example, in a method disclosed in Japanese Unexamined Patent Publication No. 234237/1996 (Tokukaihei 8-234237) (published date: Sep. 13, 1996), scanning lines are divided into blocks, and the blocks to which the scanning signals are destined are switched in time so that the scanning lines are sequentially applied to each block by dividing one vertical period with respect to time.

The foregoing conventional structure, however, had a problem that an error occurred on transfer data by the application of a potential on a signal line at a border line while the potential of the signal line is being oscillated by a parasitic capacitance which exists between the signal line and adjacent signal lines.

For example, in the case of a display device, there is a problem that the signal line and pixels which correspond to the border of the blocks are oscillated at the time of switching the blocks by the parasitic capacitance between the signal line and the pixel electrodes. The following explains this principle with reference to a timing chart of FIG. 32, and FIG. 1 which shows a structure according to the present invention. Note that, in reality, there are many other signal lines and their corresponding elements other than those shown in the drawing, which, however, are omitted here for convenience of explanation. The following explanation is based on the case where signals of maximum amplitude are outputted from output lines $s_1$ to $s_4$, which respectively correspond to output terminals of the signal line driving circuit 1, for effecting black display over the entire screen.

Signal lines f', f, a, and b make up a single block ("first block" hereinafter), and signal lines c, d, e, and e' makes up another block ("second block" hereinafter). While a scanning line g1 is being selected, a signal is first supplied to the signal lines a and b from the signal line driving circuit 1. The signal is applied to pixels $A_1$ and $B_2$ because the scanning line $g_1$ is selected. Here, no signal is supplied to the signal lines c and d. Then, the signal lines a and b, and the pixels $A_1$ and $B_1$ become on hold, and a signal is supplied to the signal lines c and d from the signal line driving circuit 1, which is then applied to pixels $C_1$ and $D_1$ because the scanning line $g_1$ is selected.

While the scanning line $g_1$ is selected, a signal is sent to control wires $SW_1$ and $SW_2$ subsequently, so as to conduct signal line switching elements (SWa, etc.). First, by selecting $SW_1$, the signal line switching elements $SW_1$ and $SW_2$ are conducted. This allows the signal from the signal line driving circuit 1 to be supplied to the pixels a and b. The signal is applied to the pixels $A_1$ and $B_1$ because the scanning line $g_1$ is selected. Here, no signal is supplied to the signal lines c and d since $SW_2$ is not selected here. Then, $SW_1$ becomes non-selected and SWa and SWb become non-conducted, placing the signal lines a and b and the pixels $A_1$ and $B_1$ on hold. Then, when $SW_2$ is selected and the signal line switching elements SWc and SWd are conducted, the signal from the signal line driving circuit 1 is supplied to the signal lines c and d, which is then applied to the pixels $C_1$ and $D_1$ because the scanning line $g_1$ is selected.

Note that, even though the same signal is supplied to the signal lines a through d in this example of black display over the entire screen, the signal from the signal line driving circuit 1 is normally switched while one scanning line ($g_1$) is selected.

Here, there exists parasitic capacitance Csd between pixel electrodes and signal lines. FIG. 1 only shows Csd at the pixels $A_1$, $B_1$, $C_1$, $D_1$ and pixels $A_2$, $B_2$, $C_2$, $D_2$, there are a number of Csds which equal the number of pixels provided in each signal line, and therefore there are actually capacitance which cannot be ignored compared with the electrostatic capacitance of the entire signal lines. Here, when the destination of the signal is switched from the first block to the second block, i.e., when $SW_2$ is selected while $SW_1$ is non-selected, there occurs polarity inversion of the potential of the signal line s, as shown in FIG. 32. The signal line b is capacitively coupled with the signal line c via the pixel electrodes (plurality of pixels, e.g., $B_2$, in the direction of the signal line c), and since $SW_1$ is non-selected, there is a potential hike of some degree on the signal line b by the polarity inversion of the signal line c. Further, since the scanning line $g_1$ is being selected, the potential hike is supplied to the pixel $B_1$, and the scanning line $g_1$ is switched under this condition.

Because the foregoing operation occurs with respect to all scanning lines, only a single line which corresponds to the signal line b in the display of the entire screen is supplied with a voltage which is higher than that for the other pixels, and as a result the line is recognized as a black line.

The same hike also occurs when $SW_1$ is selected while $SW_2$ is non-selected; however, since the potential is replaced with a correct potential by the selection of $SW_2$ at the next timing, no display problem will be caused with respect to pixel $C_1$. Further, the oscillation due to Csd during non-conduction of the scanning line $g_1$ does not have any difference as an effective value with respect to a display period as a whole, and does not cause any problem.

Even though the foregoing explained the driving over two blocks, for example, in the case of driving over four blocks on the entire screen, there is a problem that a total of three black lines are recognized at the respective borders of the blocks.

This problem is also present in devices other than the display device, for example, such as an X-ray sensor. That is, signal lines and scanning lines are provided in a matrix pattern on a substrate, and a photo-detecting section having a photo-detecting elements is provided thereon. X-rays are detected by the photo-detecting section and converted to an electrical signal, which is then transferred to an external display device, etc., via the signal lines. Even in this case, when signals are transferred by dividing the signal lines into blocks as in the foregoing case, there will be an error on transfer data by the application of a potential on a signal line at the border while the potential of the signal line is being oscillated by a parasitic capacitance which exists between the signal line and adjacent signal lines.

SUMMARY OF THE INVENTION

It is an object of the present invention to provide a data transfer method, an image display device, and a signal line driving circuit which are capable of relieving the drawback of different potential states between a border of blocks and an area surrounding it, which is caused by a potential oscillation of a signal line on the border of the blocks when transferring data per block.

Another object of the present invention is to provide an active-matrix substrate which can relieve the drawback of different display states between the border of the blocks and the area surrounding it, which is caused even when the potential supplied to the border and the surrounding area is the same, when displaying an image on the active-matrix substrate which carries out block-driving.

In order to achieve the foregoing object, in a data transfer method of the present invention, scanning lines in a row direction and signal lines in a column direction are formed in a matrix pattern, and a data signal which corresponds to a position on the matrix is applied within one horizontal period to a signal line which corresponds to this position, the signal lines being divided into a plurality of blocks and being sequentially conducted for each line per block so as to transfer the data signal between a matrix section and a data transfer section with respect to each block, wherein, with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, the SL2 is conducted as preliminary conduction within one horizontal period prior to the time the application of the data signal to the BL1 is finished as normal conduction for applying the data signal.

With this arrangement, within one horizontal period, at least SL2 among the signal lines of the BL2 is preliminarily conducted prior to the time the application of the data signal to the BL1 as normal conduction is finished. For example, all the signal lines which belong to the BL2, including the SL2, are conducted. In the case of AC driving where the polarity of the potential of the signal lines is inverted with respect to a reference voltage, the polarity of the potential of at least the SL2 is inverted as the preliminary conduction with respect to the reference voltage, prior to the time the application of the data signal to the BL1 as the normal conduction is finished. That is, within one horizontal period, before conduction of at least one block is finished, a signal line of a block to be conducted next is conducted once. In the case of AC driving, the polarity of the signal line of the BL2 is inverted in advance as preliminary polarity inversion before the normal polarity inversion of the BL1.

This causes a potential hike on the block BL1 by the preliminary conduction and the potential oscillates, which, however, is restored by the subsequent normal conduction by which a correct potential is applied to the BL1. Thereafter, the application of the data signal to the BL1 is finished and the BL1 maintains and transfers the data signal based on the correct potential. Therefore, it is possible to effectively prevent an error on transfer data, which is caused by the application of a potential to the signal line on the border of the blocks while the signal line is experiencing potential oscillation by the parasitic capacitance between the signal line and the adjacent signal line. In the case of a display device, it is possible to prevent the phenomenon in which a potential is applied to the pixels on the border while they are oscillated, which state is then maintained over the display period, thus relieving the drawback of different display states between the border and an area surrounding it, which is caused even when the potentials applied to the border and the surrounding area are the same.

For example, during the preliminary conduction of the BL2, to the signal line of the BL2 undergoing the preliminary conduction is applied a signal, which is applied during its normal conduction period while the line is being selected. In this way, the signal line undergoing the preliminary conduction in the BL2 receives the same signal which should be applied in the preliminary conduction period and in the normal conduction period. As a result, there will be no potential difference between the two signals. Accordingly, no potential drop will be caused by the potential difference on the signal line in the BL1. Thus, in addition to the effect by the foregoing arrangement, it is possible to further relieve the drawback of different potentials between the border and an area surrounding it, even though the same potential is applied to the block and the surrounding area.

Further, the data transfer method of the present invention is for an image display device having scanning lines in a row direction and signal lines in a column direction which are formed in a matrix pattern and displaying an image according to a data signal by a pixel on the matrix, the method applying a data signal which corresponds to a position on the matrix to a signal line which corresponds to this position within one horizontal period, the signal lines being divided into a plurality of blocks, and the data signal being transferred per block from a data transfer section to the pixel by sequentially inverting a polarity of a potential of the signal line for each line per block with respect to a reference voltage, wherein, with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, a polarity of a potential of the SL2 is inverted as preliminary conduction with respect to the reference voltage within one horizontal period, prior to the time the application of the data signal to the BL1 is finished as normal conduction for applying the data signal.

With this arrangement, within one horizontal period, the polarity of the potential of the SL2 is inverted within one horizontal period as the preliminary conduction with respect to the reference voltage, prior to the time the application of the data signal to the BL1 is finished as the normal conduction for applying the data signal. For example, the polarity of all the signal lines of the BL2, including the SL2, are inverted with respect to the reference voltage. That is, in AC driving where the polarity of the signal lines is inverted with respect to the reference voltage, the polarity of the potential of at least the SL2 is inverted as the preliminary conduction with respect to the reference voltage, prior to the time the application of the data signal to the BL1 as the normal conduction is finished. That is, within one horizontal period, before the conduction of at least one block is finished, the polarity of the potential of the signal lines of a block which is to be conducted next is inverted with respect to the reference voltage. That is, in AC driving, the polarity of the signal line of the BL2 is inverted in advance as the preliminary polarity inversion before the normal polarity inversion of the BL1.

This causes a potential hike on the block BL1 by the preliminary conduction and the potential oscillates, which, however, is restored by the subsequent normal conduction by which a correct potential is applied to the BL1. Thereafter, the application of the data signal to the BL1 is finished and the BL1 maintains and transfers the data signal based on the correct potential. Therefore, it is possible to effectively prevent an error on transfer data, which is caused by the application of a potential to the signal line on the border of the blocks while the signal line is experiencing potential oscillation by the parasitic capacitance between the signal line and the adjacent signal line. In the case of a display device, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

Further, in the data transfer method of the present invention, scanning lines in a row direction and signal lines in a column direction are formed in a matrix pattern, and a data signal which corresponds to a position on the matrix is applied within one horizontal period to a signal line which corresponds to this position, the signal lines being divided into a plurality of blocks and being sequentially conducted for each line per block so as to transfer the data signal between a matrix section and a data transfer section, wherein, when input data of one block, equivalent of n signal lines, which are continuously inputted in a time sequential manner are sampled in n sampling sections and respectively stored as n sampling data, and are outputted to their corresponding signal lines, and when the n sampling sections are divided into groups, and when one of the blocks in which order of sampling the input data with respect to a single scanning line is second or after is BL2, and when a group having a sampling section to which first sampling data Db1 of the block BL2 is inputted is GRa, a blank sampling section for storing the sampling data Db1 is created in the group GRa, after the group GRa stores sampling data of a block in which a sampling time is earlier than the block BL2 with respect to the single scanning line, and before, at the latest, the sampling data Db1 is inputted.

For example, the n sampling sections can be grouped based on those having the same switching time therein. Further, the n sampling sections can be grouped based on those having the same output time with respect to the data signal which is outputted to one of the blocks of the signal lines.

When not grouping, the first to nth data signals are sampled first with respect to the data signal which is outputted to one of the blocks of the signal lines, and thereafter the first to nth signal lines thus sampled are transferred to the signal lines or latched, before sampling the first data signal again. This requires time for the transfer or latching. Thus, when transferring data signals which are in chronological sequence, i.e., data signals which are successively inputted one after another with certain time intervals, and when the transfer time or latch time cannot be ignored compared with the supply intervals of the data signals, sampling cannot catch up with the data transfer and the data signals are missed out. In other words, it is required to modify the data signals in some way or another, for example, by incorporating an index signal in data signals to be transferred, taking into consideration the transfer time.

In contrast, according to the arrangement of the present invention, input data of one block, equivalent of n signal lines, which are continuously inputted in a time sequential manner are sampled in n sampling sections and respectively stored as n sampling data, and are outputted to their corresponding signal lines, and n sampling sections are divided into groups, and when one of the blocks in which order of sampling the input data with respect to a single scanning line is second or after is BL2, and when a group having a sampling section to which first sampling data Db1 of the block BL2 is inputted is GRa, a blank sampling section for storing the sampling data Db1 in the group GRa is created after the group GRa stores sampling data of a block in which a sampling time is earlier than the block BL2 with respect to the single scanning line, and before, at the latest, the sampling data Db1 is inputted.

Therefore, when there are n input lines for the signal lines (accordingly, the number of signal lines is integer multiples of n), it is not required to provide, neither after the nth data signal is sampled nor before the first data signal is sampled again, time for transferring the sampled data signals to the signal lines or latching the same. Accordingly, it is not required to specially modify the data signals according to the transfer time or latch time. As a result, data can be transferred rapidly and processed fast with a simpler structure.

The blank sampling section can be created by using and suitably outputting a group control signal which indicates the timing of this operation. Such a group control signal, for example, is the group control signal (system switching timing signal) which, by the provision of a plurality of systems (system A, system B, etc.) for storing data signals in each sampling section, indicates the timing of switching the systems for storing the data signal to a blank system. Also, for example, such a group control signal is the group control signal (output timing signal) which indicates the timing of outputting the stored sampling data by transferring or latching it while another group is undergoing input and storage operation of other sampling data.

Further, in the data transfer method of the present invention, scanning lines in a row direction and signal lines in a column direction are formed in a matrix pattern, and a data signal which corresponds to a position on the matrix is applied within one horizontal period to a signal line which corresponds to this position, the signal lines being divided into a plurality of blocks and being sequentially conducted for each line per block so as to transfer the data signal between a matrix section and a data transfer section, wherein, with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, the application of the data signal to the SL2 is started within one horizontal period, prior to the time the application of the data signal to the BL1 is finished as normal conduction for applying the data signal.

For example, in the case of AC driving, it is possible to have an arrangement wherein the normal polarity inversion for applying the data signal to the SL2 is started within one horizontal period, prior to the time the normal polarity inversion as the normal conduction for applying the data signal to the BL1 is finished.

According to this arrangement, within one horizontal period, the application of the data signal to the SL1 is started prior to the time the application of the data signal to the BL1 is finished as the normal conduction for applying the data signal. That is, the respective signal lines of the BL2 are conducted by starting the normal conduction before the application of the data signal to the BL1 is finished.

By this conduction, the block BL1 experiences the potential hike and the potential oscillates, which, however, is restored as and while the data signal is continuously applied to the BL1 for a brief moment after the conduction period. Thereafter, the application of the data signal to the BL1 is finished, and the BL1 can maintain and transfer the correct potential. Therefore, it is possible to effectively prevent an error on transfer data, which is caused by the application of a potential to the signal line on the border while the signal line is experiencing potential oscillation by the parasitic capacitance between the signal line and the adjacent signal line.

In the case of a display device, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

The conduction is started in advance at an earlier timing than usual to avoid error. This can be realized only be slightly changing the timing of the signal for specifying the start time and the end time of the normal conduction period, and it is not required to newly create a signal for specifying the start time and the end time for the early conduction, thereby simplifying a device structure for the driving.

Further, the data transfer method of the present invention is for an image display device having scanning lines in a row direction and signal lines in a column direction which are formed in a matrix pattern and displaying an image according to a data signal by a pixel on the matrix, the method applying a data signal which corresponds to a position on the matrix to a signal line which corresponds to this position within one horizontal period, the signal lines being divided into a plurality of blocks, and the data signal being transferred per block from a data transfer section to the pixel by sequentially inverting a polarity of a potential of the signal line for each line per block with respect to a reference voltage, wherein, with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, the application of the data signal to the SL2 is started within one horizontal period, prior to the time the application of the data signal to the BL1 is finished as normal conduction for applying the data signal.

That is, it is possible to have an arrangement in AC driving wherein, within one horizontal period, the normal polarity inversion for applying the data signal to the SL2 is started prior to the time the normal polarity inversion of the BL1 is finished as the normal conduction for applying the data signal.

With this arrangement, the application of the data signal to the SL2 is started within one horizontal period prior to the time the application of the data signal to the BL1 is finished as the normal conduction for applying the data signal. That is, the respective signal lines of the BL2 are conducted in advance by starting the normal conduction before the application of the data signal to the BL1 is finished.

By this conduction, the block BL1 experiences the potential hike and the potential oscillates, which, however, is restored as and while the data signal is continuously applied to the BL1 for a brief moment after the conduction period. Thereafter, the application of the data signal to the BL1 is finished, and the BL1 can maintain and transfer the correct potential. Therefore, it is possible to effectively prevent an error on transfer data, which is caused by the application of a potential to the signal line on the border while the signal line is experiencing potential oscillation by the parasitic capacitance between the signal line and the adjacent signal line.

As a result, in a display device, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

The conduction is started in advance at an earlier timing than usual to avoid error. This can be realized only be slightly changing the timing of the signal for specifying the start time and the end time of the normal conduction period, and it is not required to newly create a signal for specifying the start time and the end time for the early conduction, thereby simplifying a device structure for the driving.

An image display device of the present invention includes scanning lines in a row direction and signal lines in a column direction which are formed in a matrix pattern and applies a data signal which corresponds to a position on the matrix to a signal line which corresponds to this position within one horizontal period, the signal lines being divided into a plurality of blocks, the image display device displaying an image according to the data signal by a pixel on the matrix by transferring the data signal per block from a data transfer section to the pixel on the matrix by sequentially inverting a polarity of a potential of the signal line for each line per block with respect to a reference voltage, wherein the data signal is transferred from the data transfer section to the pixels on the matrix using any of the foregoing data transfer methods.

According to this arrangement, the data signal is transferred from the data transfer section to the pixels on the matrix using any of the foregoing data transfer methods. Thus, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

Further, in a signal line driving circuit of the present invention which functions as the data transfer section to transfer the data signal to the image display device, when input data of one block, equivalent of n signal lines, which are continuously inputted in a time sequential manner are sampled in n sampling sections and respectively stored as n sampling data, and outputted to their corresponding signal lines, and when the n sampling sections are divided into groups, and when one of the blocks in which order of sampling the input data with respect to a single scanning line is second or after is BL2, and when a group having a sampling section to which first sampling data Db1 of the block BL2 is inputted is GRa, the signal line driving circuit generates a group control signal for specifying a timing of creating a blank sampling section for storing the sampling data Db1 in the group GRa, after the group GRa stores sampling data of a block in which a sampling time is earlier than the block BL2 with respect to a single scanning line, and before, at the latest, the sampling data Db1 is inputted.

According to this arrangement, the signal line driving circuit generates a group control signal for specifying a timing of creating a blank sampling section for storing the sampling data Db1 in the group GRa, after the group GRa stores sampling data of a block in which sampling time is earlier than the block BL2 with respect to a single scanning line, and before, at the latest, the sampling data Db1 is inputted.

Therefore, when there are n input lines for the signal lines (accordingly, the number of signal lines is integer multiples of n), it is not required to provide, neither after the nth data signal is sampled nor before the first data signal is sampled again, time for transferring the sampled data signals to the signal lines or latching the same. Accordingly, it is not required to specially modify the data signals according to the transfer time or latch time. As a result, data can be transferred rapidly and processed fast with a simpler structure.

Further, the data transfer device of the present invention may be used for an image display device which includes scanning lines in a row direction and signal lines in a column direction which are formed in a matrix pattern and applies a data signal which corresponds to a position on the matrix to a signal line which corresponds to this position within one horizontal period, and which displays an image by transferring the data signal to the pixels on the matrix, the signal lines being divided into a plurality of blocks, and the data signal being transferred per block between the matrix section and the data transfer section by sequentially conducting the signal lines for each line per block, wherein, with respect to at least one pair of the blocks respectively having signal lines which are adjacent to each other, among which a block for which the application of the data signal is finished earlier is BL1, and a block for which the application of the data signal is finished later is BL2, and the blocks BL1 and BL2 having adjacent signal lines SL1 and SL2, respectively, the data transfer device includes a conduction control section for conducting the SL2 as the preliminary conduction so as to transfer the data signal from the data transfer section to the pixel on the matrix within one horizontal period, prior to the time the application of the data signal to the BL1 is finished as normal conduction for applying the data signal.

According to this arrangement, among the signal lines which belong to the BL2, at least the SL2 is conducted as the preliminary conduction within one horizontal period, prior to the time the application of the data signal to the BL1 is finished as the normal conduction. For example, all the signal lines, including the SL2, which belong to the BL2 are conducted. In the case of AC driving where the polarity of the potential of the signal lines is inverted with respect to the reference voltage, the polarity of the potential of at least the SL2 is inverted as the preliminary conduction with respect to the reference voltage, prior to the application of the data signal as the normal conduction to the BL1 is finished. Thus, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

In order to achieve the foregoing object, an active-matrix substrate which includes a pixel switching element connected to each of a plurality of pixel electrodes, a plurality of scanning lines for driving the pixel switching element, a plurality of signal lines for applying a data signal to the pixel electrodes via the pixel switching element, and a signal input section for supplying the data signal to the signal lines so as to invert a polarity of a voltage of the signal lines, the signal lines being divided into blocks depending on a time the data signal is supplied in one horizontal period, includes: a signal branching section for branching the data signal from the signal input section into respective blocks; a signal line switching element for switching on or switching off supply of the data signal to respective signal lines from the signal branching section by being conducted or not conducted; and a control wire, provided per block, for supplying a conduction signal to the signal line switching element, so as to switch conduction/non-conduction of the signal line switching element per block according to a supply time of the data signal, wherein, with respect to at least one target block of at least two adjacent blocks, the data signal is applied to a control wire of an adjacent block earlier than a control wire of the target block within one horizontal period, and a signal line of the target block on a border between the adjacent blocks is preliminarily supplied with a preliminary polarity inverse signal for inverting a polarity of a voltage of the signal line of the target block, by an auxiliary signal line switching element which is controlled by being supplied with an auxiliary control signal from another auxiliary control wire which is different from the control wire of the target block, and which is different from the signal line switching element which is controlled by the control wire of the target block, prior to the time the supply of the data signal to the adjacent block is finished within one horizontal period.

According to this arrangement, the signal line of the target block on the border between the target block and the adjacent block preliminarily inverts the voltage of its signal line by the auxiliary signal line switching element.

Thus, because the signal line can be inverted to the opposite polarity in advance, it is possible to prevent the phenomenon in which a potential is applied to the pixels on the border while they are oscillated, which state is then maintained over the display period. As a result, it is possible to relieve the drawback of different display states between the border and an area surrounding it, which is caused even when the potentials applied to the border and the surrounding area are the same.

Further, the conduction signal is supplied to each block by a predetermined order of selection, and the additional signal line switching element is provided only on the signal line which would cause the display deficiency. Therefore, the area of the signal line switching element can be increased for the area of the unnecessary signal line switching element. Further, only one control wire of the other signal line switching element needs to be provided, thus preventing additional control wires and making the layout of wiring easier.

For a fuller understanding of the nature and advantages of the invention, reference should be made to the ensuing detailed description taken in conjunction with the accompanying drawings.

DESCRIPTION OF THE EMBODIMENTS

[First Embodiment]

Figure 1:
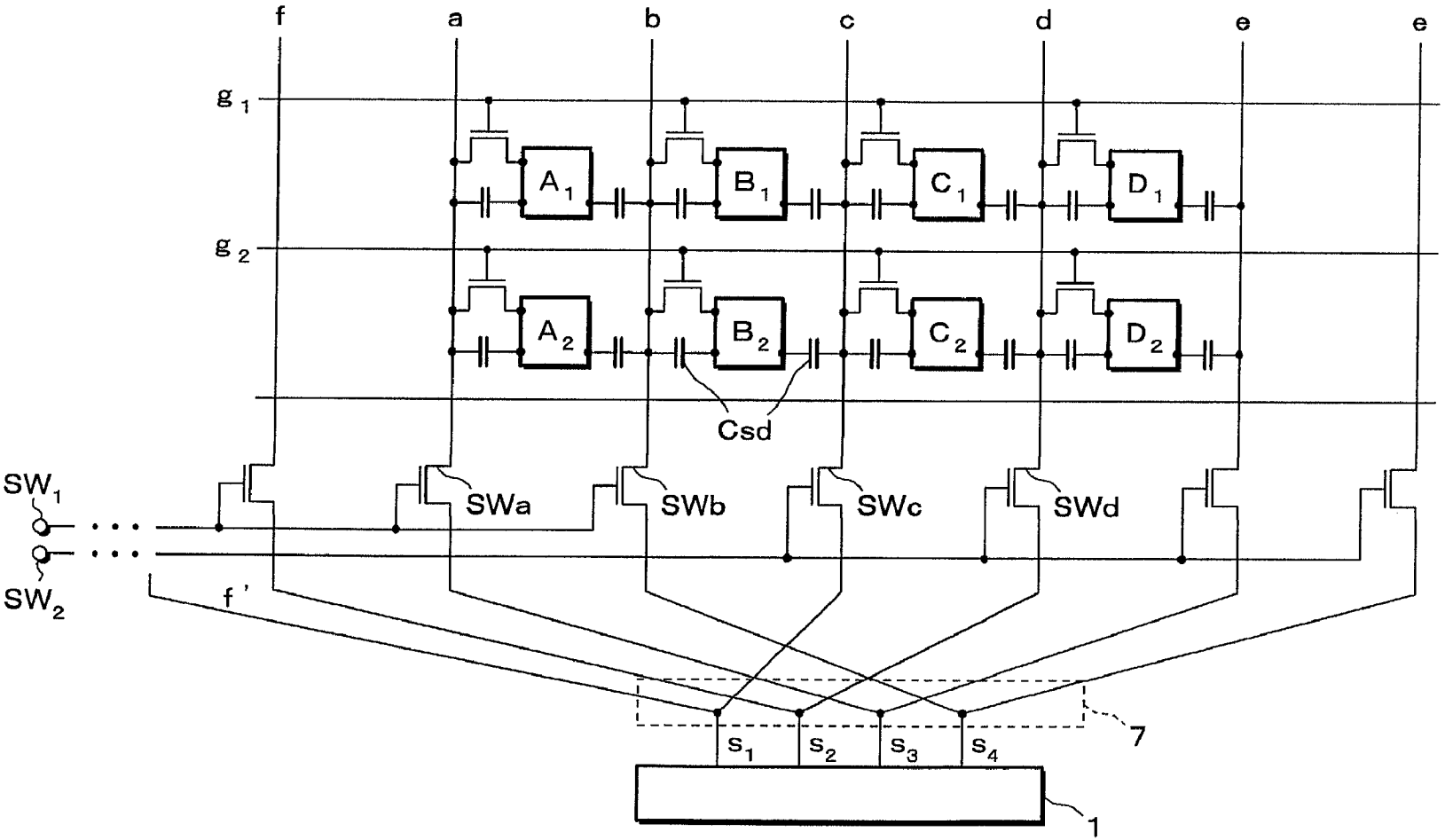
FIG. 1 is an explanatory drawing showing an equivalent circuit of an active-matrix substrate.

The following will describe one embodiment of the present invention referring to FIG. 1 through FIG. 20. In the present embodiment, a data transfer device is an active-matrix substrate (matrix section), and includes scanning lines, signal lines, and pixel electrodes, which make up a liquid crystal display device as a display device which is driven by the active-matrix mode for display.

The pixel electrodes have their respective pixels $A_1$, $B_1$, . . . , as a data processing section, and are connected to pixel switching elements such as TFTs (Thin Film Transistor) (not shown). The pixels are made up of liquid crystal, which makes up a liquid crystal panel, which, in turn, makes up the liquid crystal display device for displaying an image on the liquid crystal panel. Note that, in reality, there are many other signal lines and other elements corresponding thereto, other than those shown in the drawing, which, however, are omitted here for convenience of explanation, and only eight signal lines f', f, a, b, c, d, e, e', and two scanning lines $g_1$ and $g_2$ are shown.

The signal lines f', f, a, b make up a single block ("first block" hereinafter), and the signal lines c, d, e, e' make up another block ("second block" hereinafter). The following explanation of the present embodiment will be based on a structure of these two blocks, which, however, is not limiting.

As shown in FIG. 1, to respective ends of the signal lines f', f, a, b, c, d, e, e' are provided signal line switching elements (SWa, SWb, SWc, SWd, etc.), and the other ends of these switching elements are electrically connected to a signal line driving circuit (data transfer section) 1 as a signal input section for installing an external circuit, and between the signal line driving circuit 1 and the switching elements is provided a signal line branching section 7. The signal line switching elements may be realized by CMOS transistors, or, alternatively, NMOS transistors in some cases. The signal line branching section 7 can be structured by branching wires.

The signal line switching elements are electrically and respectively connected to output lines $s_1$, $s_2$, $s_3$, $s_4$ which extend from output terminals of the signal line driving circuit 1. To control ends of the switching element SWa and other switching elements are connected, commonly to each of the plurality of blocks, control wires $SW_1$ and $SW_2$ for switching conduction/non-conduction of the signal line switching elements, and by this switching, an image signal (data signal) from the signal line driving circuit 1 is supplied in time division as a display signal to each signal line.

That is, the signal lines or scanning lines are divided into blocks, and by dividing a period during which a scanning line is selected (one select period of a scanning line, one horizontal period) in the case of the signal line, or by dividing one vertical period in the case of the scanning line, the blocks to which the signal is destined are switched in time so that the data signal or scanning signal is sequentially applied to each block. In the present embodiment, the signal lines are divided into blocks, and the blocks to which the signal is destined are switched in time by dividing one select period of the scanning line so that the data signal is sequentially applied to each block. In the case of dividing the scanning lines into blocks, the blocks to which the signal is destined are switched in time by dividing one vertical period so that the scanning signal is sequentially applied to each block.

Figure 11:
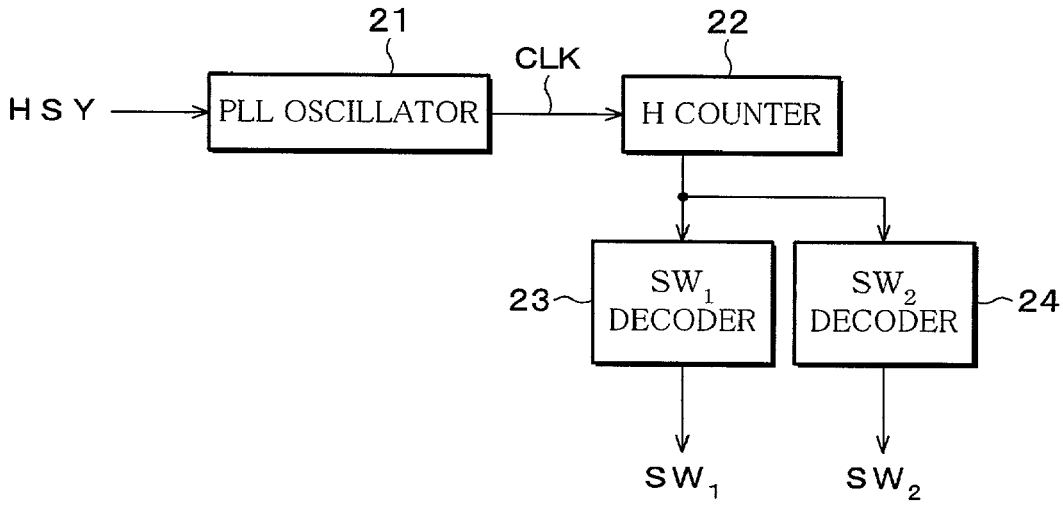
FIG. 11 is a block diagram showing a schematic exemplary structure of a conduction controlling section.

The outputs of the control wires $SW_1$ and $SW_2$ are controlled by a conduction control section. FIG. 11 shows an exemplary structure of the conduction control section. Indicated by "HSY" is a horizontal synchronize signal which is synchronized with an image. A PLL (phase-locked loop) oscillator 21 generates a clock CLK. The HSY and clock CLK are counted by an H counter (here, "H" indicates "Horizontal") 22, and a pulse is generated in decoders ($SW_1$ decoder 23, $SW_2$ decoder 24) based on the value of the counter. Each decoder is set to have a predetermined value in advance, and outputs a pulse based on this value. The predetermined value is decided and optimized beforehand with respect to individual parameters of the pixels or SWa, such as $s_1$ and $g_1$.

Figure 12:
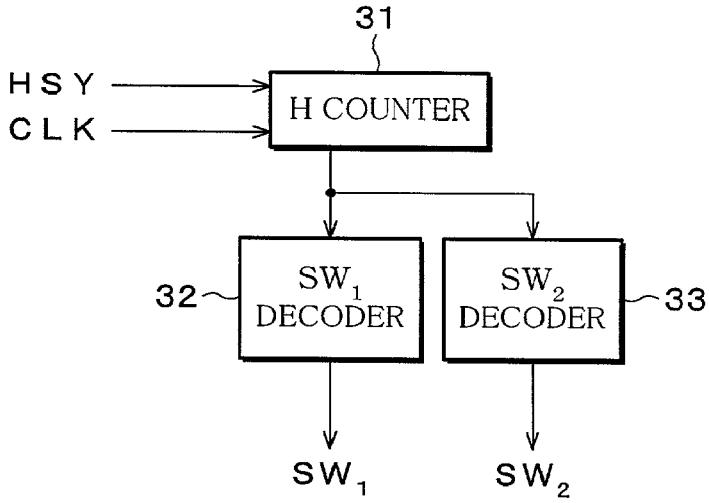
FIG. 12 is a block diagram showing a schematic exemplary structure of a conduction controlling section.

FIG. 12 shows another structure example of the conduction control section. Here, instead of generating the clock CLK by the PLL oscillator 21 of FIG. 11, HSY and CLK are inputted to an H counter 31. The CLK is in synchronization with dot data of an image. The other structure is the same as that of FIG. 11.

Figure 18:
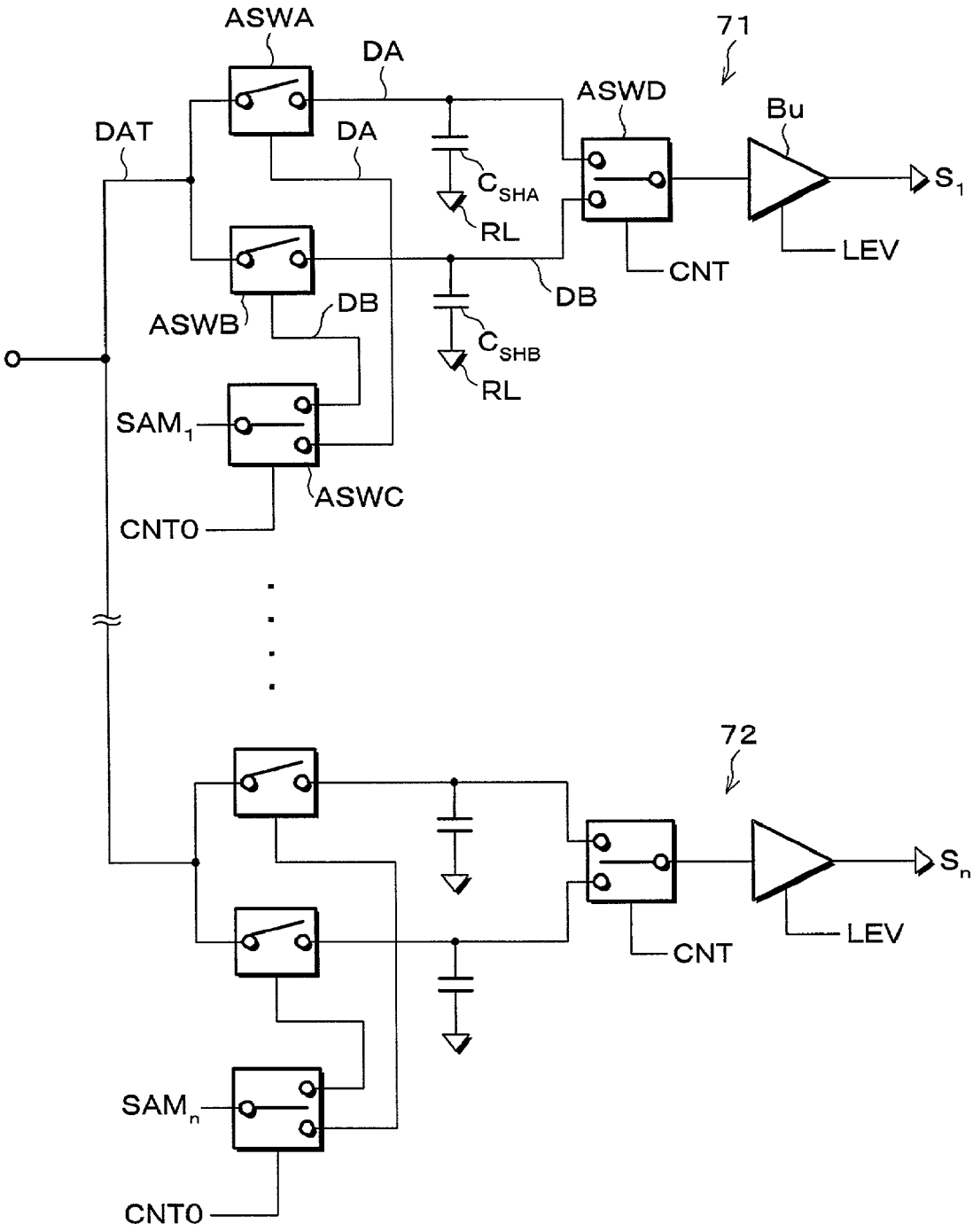
FIG. 18 is a block diagram showing an exemplary structure of a signal line driving circuit.
Figure 19:
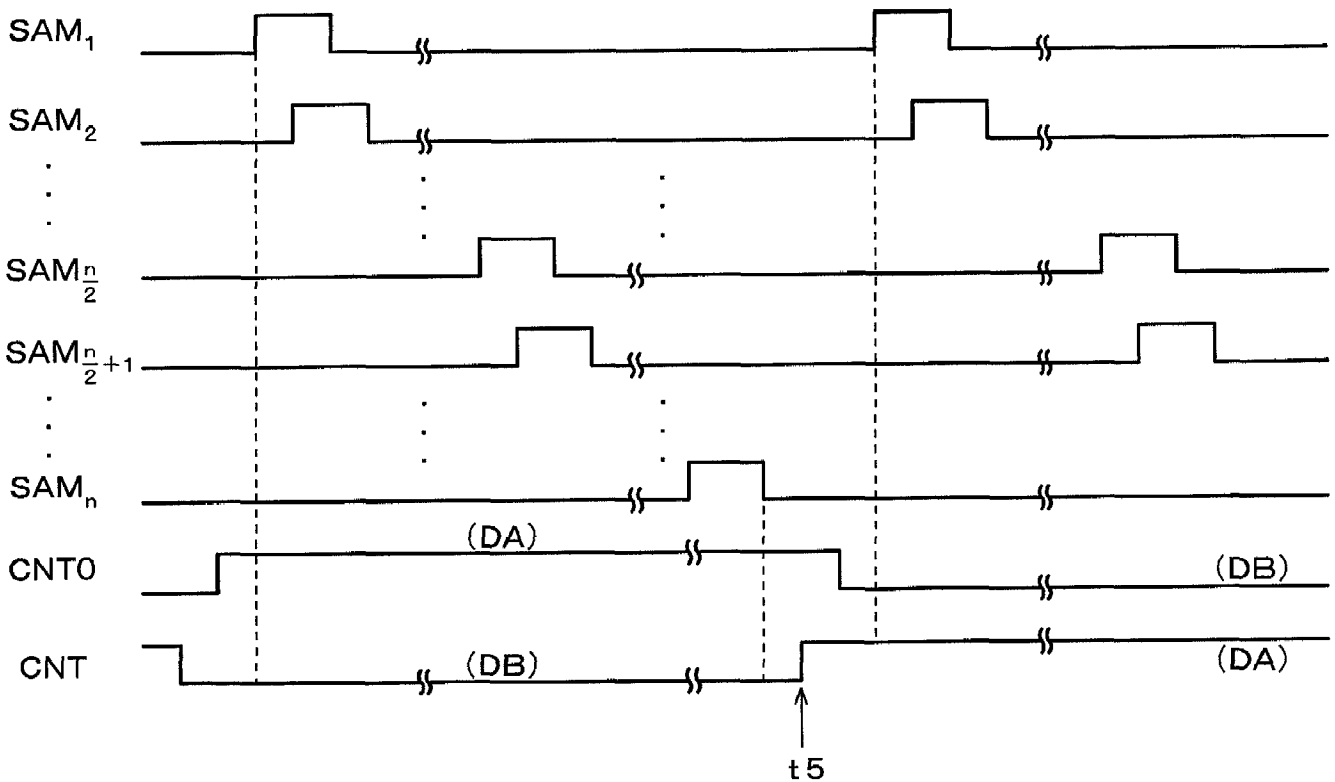
FIG. 19 is an explanatory drawing showing a timing chart of the signal line driving circuit of FIG. 18.

The following describes a structure of the signal line driving circuit 1. FIG. 18 shows one exemplary structure. FIG. 19 shows its timing chart. As shown in FIG. 18, from an input of a data line DAT to the output $S_1$ makes up a single sampling circuit (sampling section), and a total of n sampling circuits are provided. Note that, for convenience of explanation, FIG. 18 only shows a first sampling circuit 71 and an nth sampling circuit 72, as representatives.

The data line DAT is branched for input into n sampling circuits (sampling sections), and an image signal is outputted from each sampling circuit, via the output terminal (e.g., $S_1$), to a signal line. The data line DAT is for supplying the image signal, which is a data signal to be displayed on a pixel, to the signal line driving circuit 1. When the number of outputs of the data line DAT is n (n line outputs), and when the number of blocks is two as in the present example, the number of signal lines is given by their product, 2n. The image signal supplied from the data line DAT is sampled from the first (output terminal $S_1$) to the nth (output terminal $S_n$) signals at the timings of their respective sampling signals (sampling pulses) $SAM_1$ to $SAM_n$, which is then branched in the signal line branching section 7, so as to send the image signal to the 2n signal lines. The sampling signals $SAM_1$ to $SAM_n$ may be created by shift resistors in the signal line driving circuit 1.

To the data line DAT are connected analog switches ASWA and ASWB as the first output. The data line DAT has a role of transferring an analog signal therein. The analog switches ASWA and ASWB are connected so as to transfer the image signal, which was inputted to the data line DAT, to an analog switch ASWD. Further, by the control of the analog switch ASWC, the input of the data line DAT is sent to the analog switch ASWD via either one of the analog switches ASWA and ASWB.

Among two systems of inputs of the image signal as the data signal, the input which is transferred through the analog switches ASWC, ASWA, and ASWD will be referred to as a system A (indicated by "DA" in FIG. 18), and the input which is transferred through the analog switches ASWC, ASWB, and ASWD will be referred to as a system B (indicated by "DB" in FIG. 18). That is, the data line DAT has two parallel signal paths of system A and system B.

Between the analog switch ASWA and the analog switch ASWD is disposed a sampling hold capacitor $C_{SHA}$. Similarly, between the analog switch ASWB and the analog switch ASWD is disposed a sampling hold capacitor $C_{SHB}$. Indicated by "RL" is a base potential.

The analog switch ASWC receives the sampling signal $SAM_1$, and is switched under the control of a control signal CNT0.

The analog switch ASWD outputs the image signal to an output buffer Bu, and is switched under the control of a control signal CNT. The output of the output buffer Bu makes up a first output terminal $S_1$.

Figure 4:
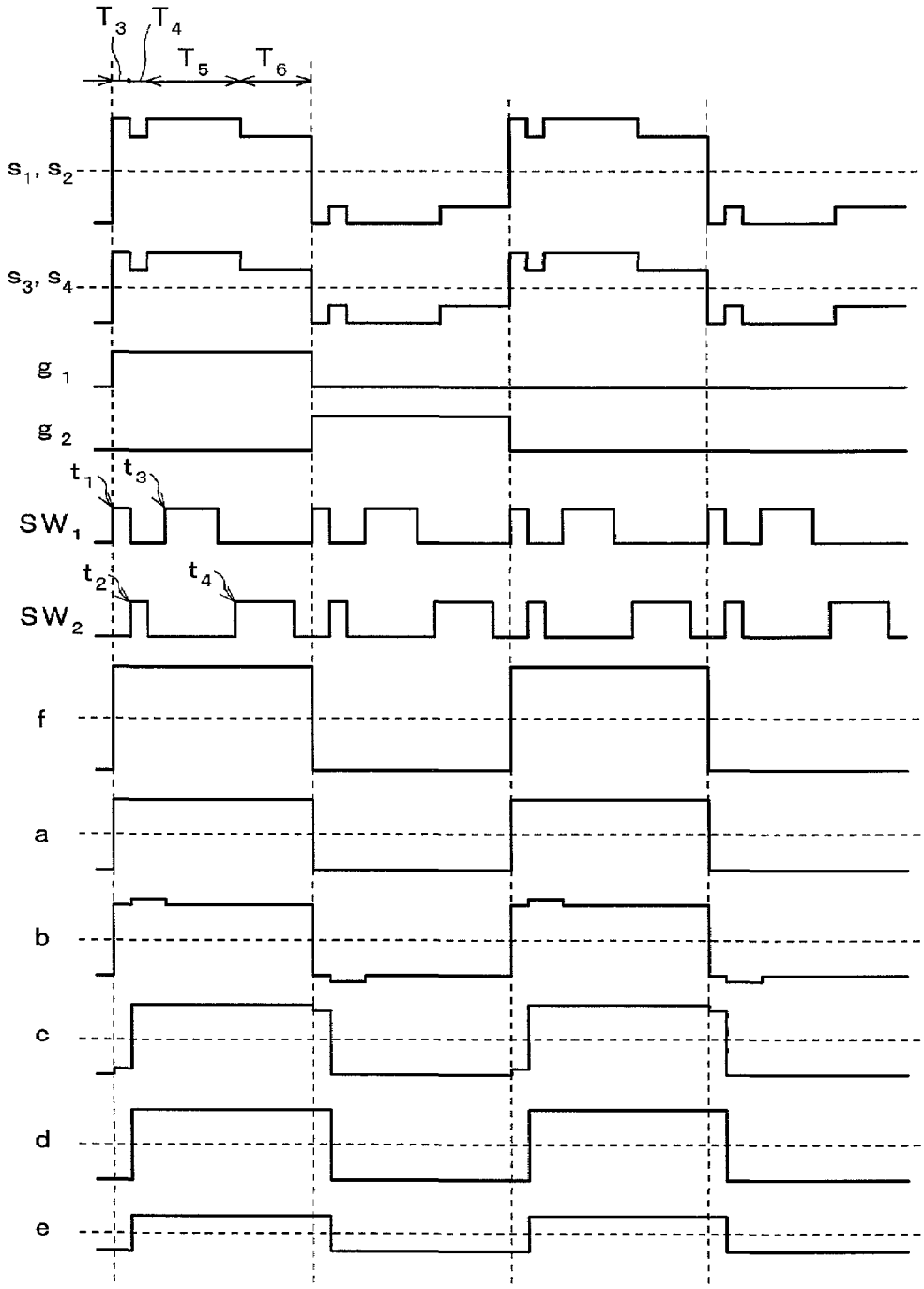
FIG. 4 is an explanatory drawing showing a timing chart by the driving method employing the active-matrix substrate.

LEV is used to bring a charge level to a desired charge voltage in advance, as in the case of FIG. 4 (and FIG. 22 to be described later). That is, either a desired charge voltage is applied to the signal LEV, or the signal LEV is used as a switching timing signal so as to bring a voltage to a desired voltage, for example, by switching. This will be described later.

The second and subsequent outputs are processed in the same manner as the foregoing first output.

Figure 3:
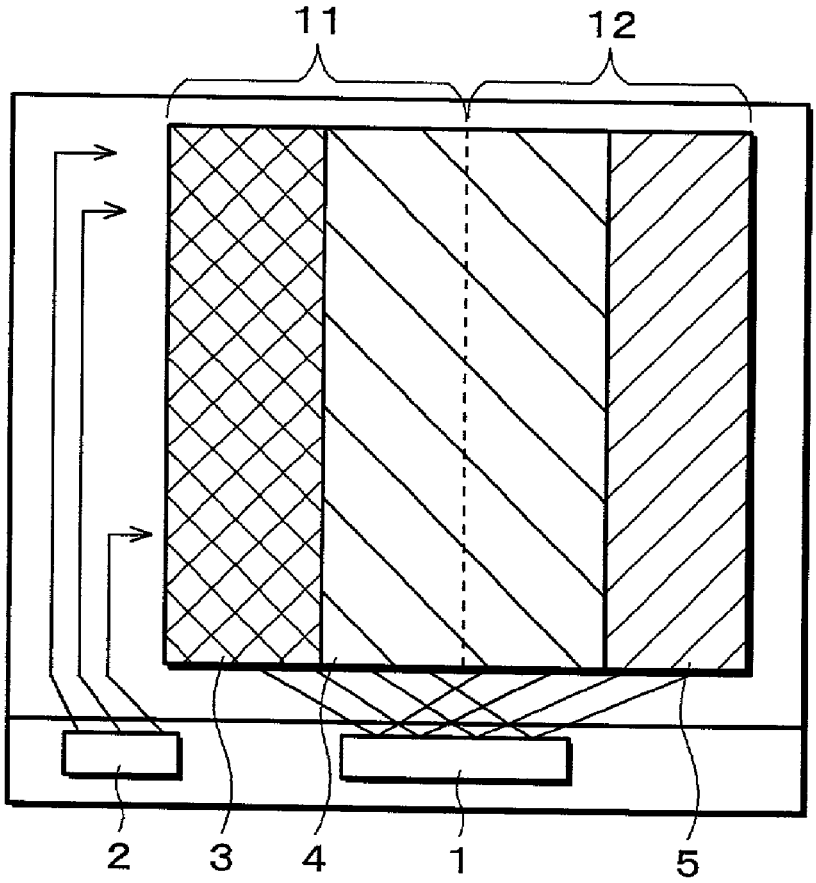
FIG. 3 is an explanatory drawing showing a display state of a liquid crystal display device using the active-matrix substrate of FIG. 1.

In order to drive the active-matrix substrate having the 2n signal lines, the following operations are carried out. That is, the sampling signals ($SAM_1$ to $SAM_n$) from the shift resistors are sequentially supplied while a display signal which corresponds to a first block (data displayed on the left half of the screen) 11 of FIG. 3 is being supplied. Here, the control signal CNT0 selects the system A ("DA" in FIG. 18). Thus, the analog switch A (ASWA) is conducted, and the data signal of the first block is stored in the sampling hold capacitor ($C_{SHA}$).

When the selection is finished up to $SAM_n$, the control signal CNT0 is switched to the system B ("DB" in FIG. 18), and the sampling signals ($SAM_1$ to $SAM_n$) are sequentially supplied again, and the image signals are supplied. Then, while the signal is being stored in the system B, the control signal CNT selects the system A so as to output the data signal which was stored previously.

In the structure of FIG. 18, no data signal can be stored in the sampling hold capacitor of the system A or system B during a certain time period (in the vicinity of time $t_5$ in FIG. 19) in which the control signal CNT is switched from the system A to the system B. The image signal is generally supplied externally and continuously per one horizontal line in a time sequential manner. Thus, in the structure of FIG. 18, when the time required for the sampling system to switch between the system A and the system B cannot be ignored with respect to a supply interval of the image signal, the data signal at the border of the first block and the second block is missed out in the display. To avoid this, a blanking period which corresponds to the time required for the switching is provided by making some modification to the image signal itself.

Figure 5:
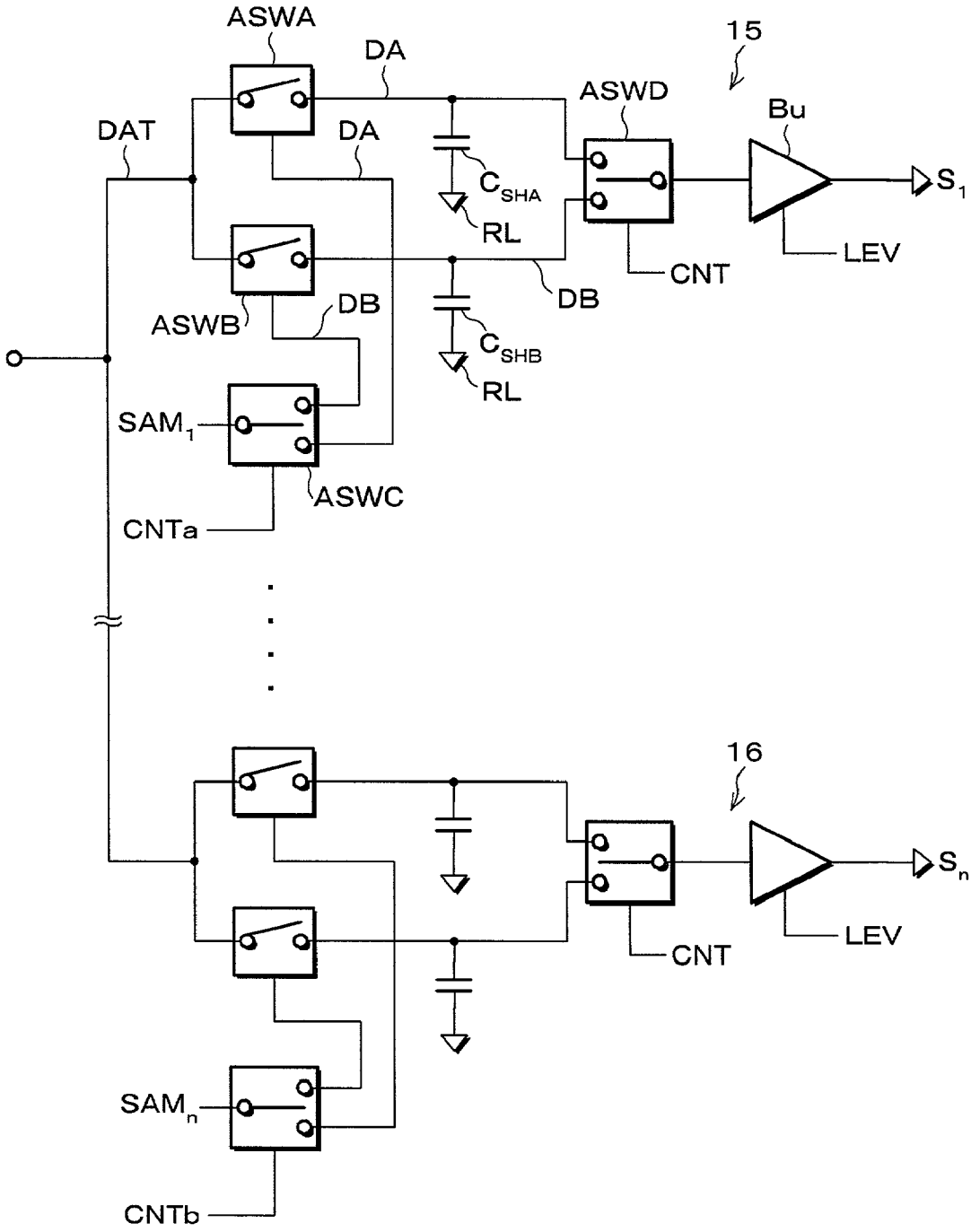
FIG. 5 is a block diagram showing an exemplary structure of a signal line driving circuit.
Figure 7:
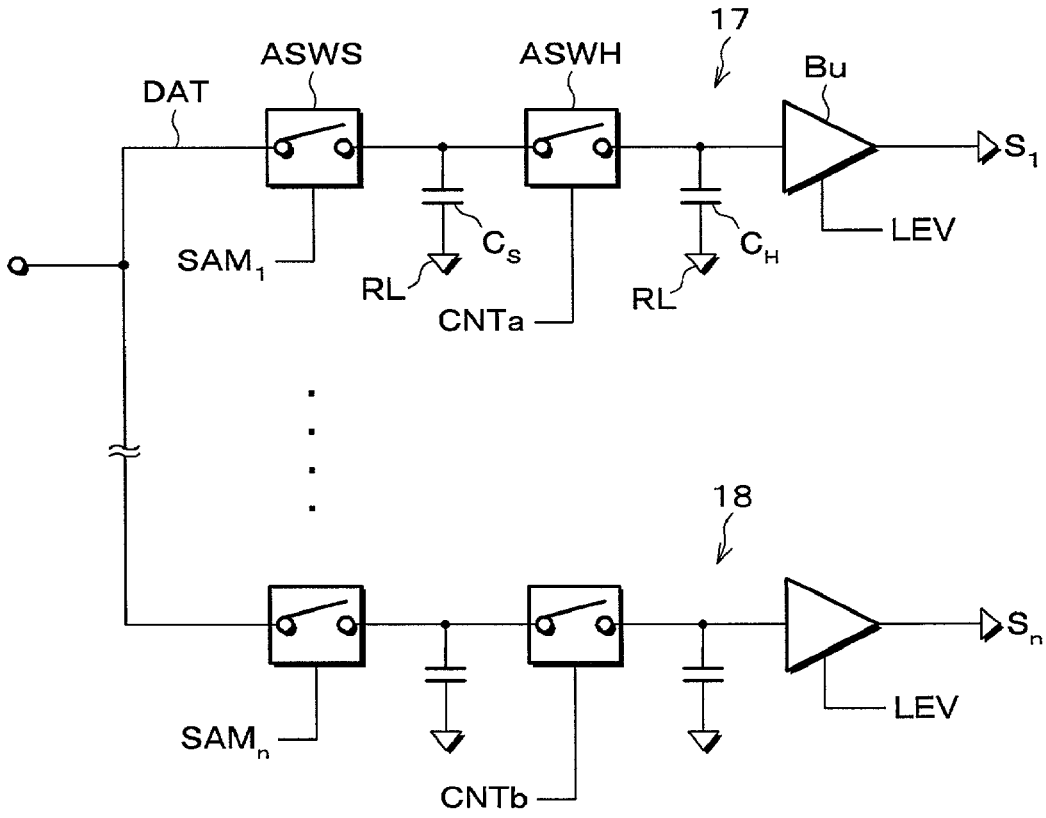
FIG. 7 is a block diagram showing an exemplary structure of a signal line driving circuit.
Figure 9:
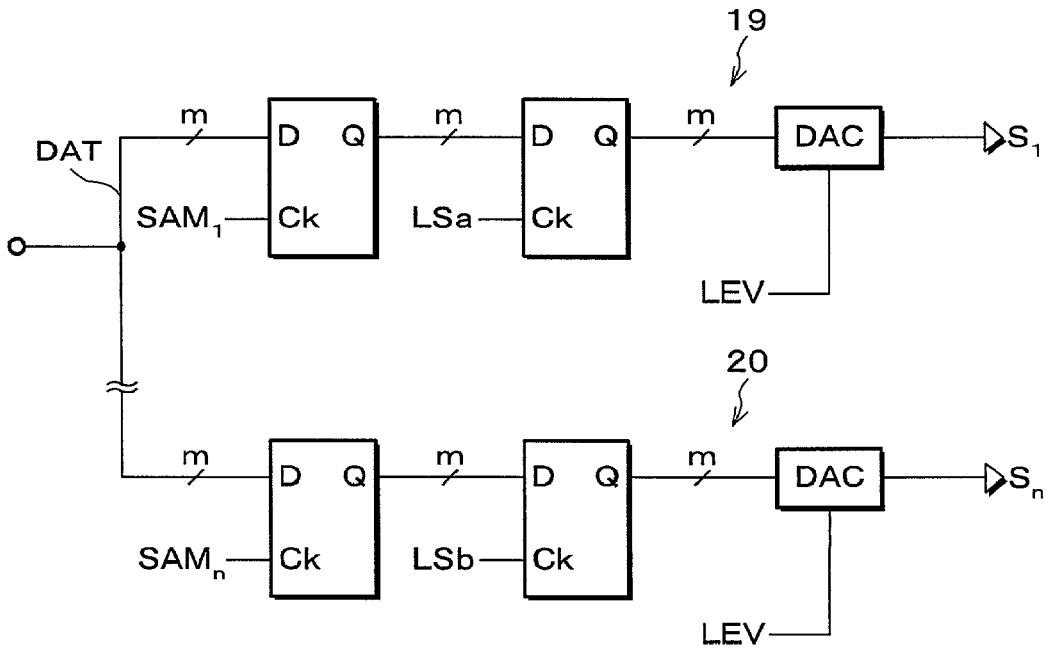
FIG. 9 is a block diagram showing an exemplary structure of a signal line driving circuit.

Meanwhile, in the structures as shown in FIG. 5, FIG. 7, and FIG. 9, while sampling is made with the sampling signal $SAM_1$ continuously after the sampling signal $SAM_1$, unlike the structure of FIG. 18, they do not require a blanking period for latching or transfer. That is, because a single signal line driving circuit needs to be used twice or more in order to sample pixels of a single horizontal line (pixels of one horizontal line in the image display device), sampling is made with the sampling signal $SAM_1$ continuously and immediately after the sampling signal $SAM_n$. The structure of FIG. 18, to this end, requires a time interval between $SAM_n$ and $SAM_1$ since it requires time for the transfer, etc. of the data signal. In contrast, in the structures of FIG. 5, FIG. 7, and FIG. 9, the continuous sampling is made possible by having different group control signals for the front half and the rear half of the number of outputs, without taking a special measure, such as modification to the image signal itself, to provide a blanking period.

The following explains an exemplary structure as shown in FIG. 5. The structure of FIG. 5 differs from that of FIG. 18 by the arrangement of signals for controlling sampling. Note that, for convenience of explanation, FIG. 5 only shows a first sampling circuit 15 and an nth sampling circuit 16 as representative sampling circuits.

When the number of outputs is n (n line outputs) as in the foregoing case, in the structure of FIG. 5, unlike that of FIG. 18, the outputs are grouped into a first group which includes the first output ($S_1$) to the (n/2)th output ($S_{n/2}$), and a second group which includes the (n/2+1)th output ($S_{n/2+1}$) to the nth output ($S_n$) Here, n is an even number. From the first output ($S_1$) to the (n/2)th output ($S_{n/2}$), the analog switch ASWC is controlled by a group control signal CNTa for the lines of the front half, and from the (n/2+1)th output ($S_{n/2+1}$) to the nth output ($S_n$), the analog switch ASWC is controlled by a group control signal CNTb for the lines of the rear half. That is, there are two kinds of group control signals, CNTa and CNTb, for switching the sampling signals $SAM_1$ to $SAM_n$ between the system A and the system B. The switching by the group control signals CNTa and CNTb is made in the vicinity of $SAM_{n/2}$. This is because $SAM_1$ is sampled continuously and immediately after the sampling of $SAM_1$ to $SAM_n$ is finished, and to eliminate the need for specially modifying the data signal supplied to the data line. Note that, the other structure is the same as that of FIG. 18.

Figure 6:
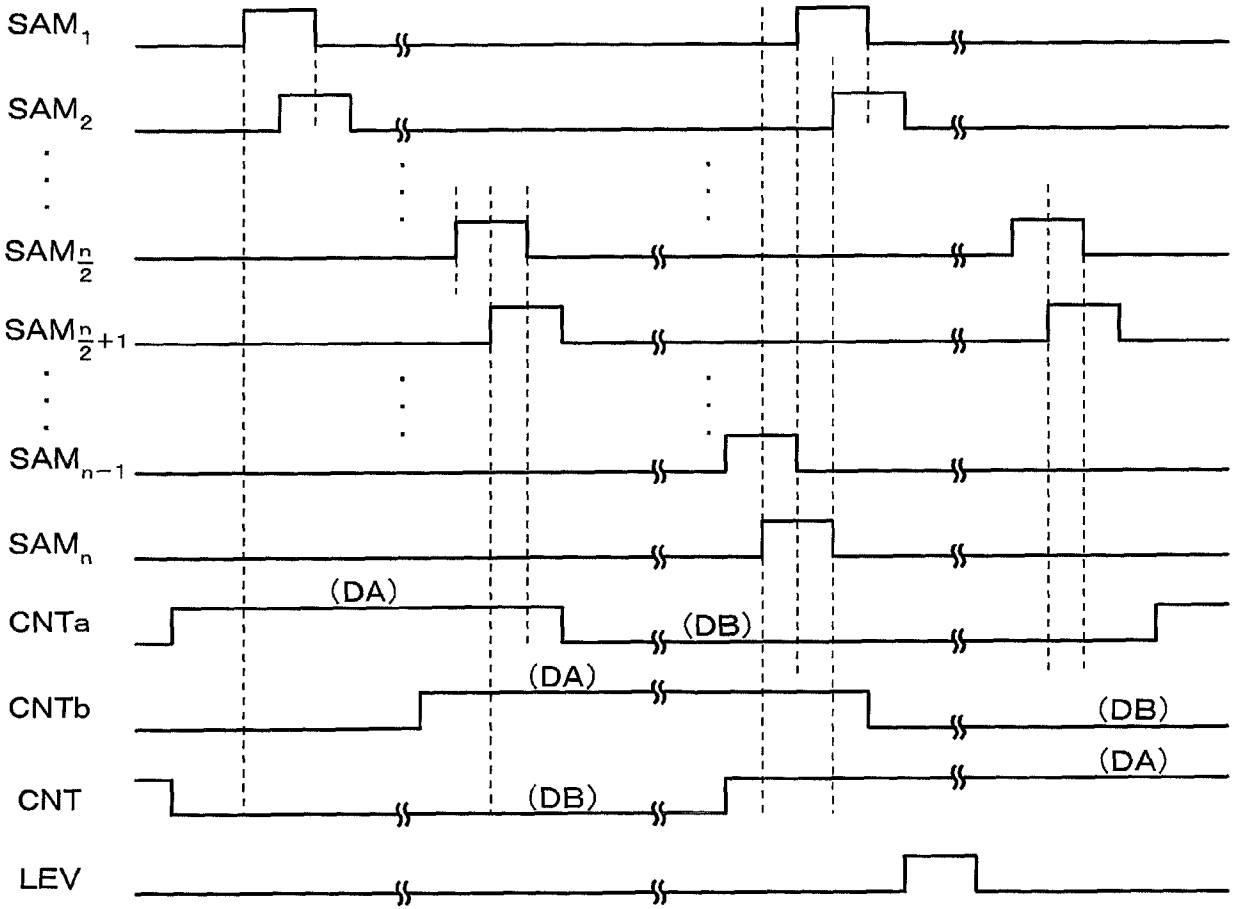
FIG. 6 is an explanatory drawing showing a timing chart of the signal line driving circuit of FIG. 5.

FIG. 6 shows a timing chart. In FIG. 6, the systems which are selected by the group control signals CNTa and CNTb and the control signal CNT are indicated in brackets. That is, the period in which the system A is selected is indicated by (DA) and the period in which the system B is selected is indicated by (DB) Also, as to LEV, its output level is fixed during a high period in FIG. 6, and its effect is the same as the case of FIG. 18.

In this manner, in this structure, unlike that of FIG. 18, the sampling signals are divided into two groups. That is, n sampling circuits (sampling sections) are connected by dividing them in half, corresponding to the group control signals CNTa and CNTb, respectively. The data signals of a half (n/2) of the first block 11 (see FIG. 3) are stored in the $C_{SHA}$ at the timings of $SAM_1$ to $SAM_{n/2}$ by the selection of the system A by the group control signal CNTa, which is the control signal for controlling these data signals. The remaining n/2 data signals are stored in the $C_{SHA}$ of their corresponding sampling circuits at the timings of $SAM_{n/2+1}$ to $SAM_n$, wherein the system A has been selected in advance by the group control signal CNTb, which is the control signal for selecting these data signals, at the timing of $SAM_{n/2+1}$. Even when the selection is made in advance in this manner, no adverse effect is caused during a non-select period of $SAM_{n/2+1}$ to $SAM_n$.

When the selection of $SAM_{n/2+1}$ to $SAM_n$ is started, the group control signal CNTa selects the system B, thus getting ready to hold the in-coming image signals of the second block (data which correspond to the right half of the screen) 12. Evidently, during a selection period of $SAM_{n/2+1}$ to $SAM_n$, the first to (n/2)th sampling circuits are in a stand-by state, and no sampling is actually carried out therein. After the selection is finished up to $SAM_n$, the sampling signals ($SAM_1$ to $SAM_n$) are sequentially supplied again, and the image signals are supplied. Then, the control signal CNT selects the system A while signals are being stored in the system B, so as to output the data signal which was stored previously. This structure allows sampling of the next block $SAM_1$ immediately after the sampling up to $SAM_n$ is finished. As a result, the image signals of the first block and the image signals of the second block are continuously transmitted, allowing the data signals (image signals) to be admitted without causing any problem, even when the data signals of the second block are continuously sent immediately after the sampling of the first block up to $SAM_n$ is finished.

The following describes an exemplary structure as shown in FIG. 7. The structure of FIG. 7 differs from those shown in FIG. 5 and FIG. 18 by the structure of the sampling circuit. For convenience of explanation, FIG. 7 only shows a first sampling circuit 17 and an nth sampling circuit 18 as representative sampling circuits. Indicated by "ASWS" is an analog switch for sampling. "ASWH" is an analog switch for holding. "$C_S$" is a sampling capacitor and "$C_H$" is a holding capacitor.

Grouping is as shown in FIG. 5. That is, when the number of outputs is n (n line outputs) as in the foregoing case, unlike FIG. 18, the outputs are grouped into the first group which includes the first output ($S_1$) to the (n/2)th output ($S_{n/2}$), and the second group which includes the (n/2+1)th output ($S_{n/2+1}$) to the nth output ($S_n$). Here, n is an even number. From the first output ($S_1$) to the (n/2)th output ($S_{n/2}$), the analog switch ASWH is controlled by the group control signal CNTa which is used for the lines of the front half, and from the (n/2+1)th output ($S_{n/2+1}$) to the nth output ($S_n$), the analog switch ASWH is controlled by the group control signal CNTb which is used for the lines of the rear half. That is, there are two kinds of group control signals, CNTa and CNTb, for controlling sampling of the sampling signals $SAM_1$ to $SAM_n$. The transfer in the first group is made in the vicinity of $SAM_{n/2}$. This is because $SAM_1$ is sampled continuously and immediately after the sampling of $SAM_1$ to $SAM_n$ is finished, and to eliminate the need for specially modifying the data signals supplied to the data lines. The other operations are the same as those described in FIG. 18.

Figure 8:
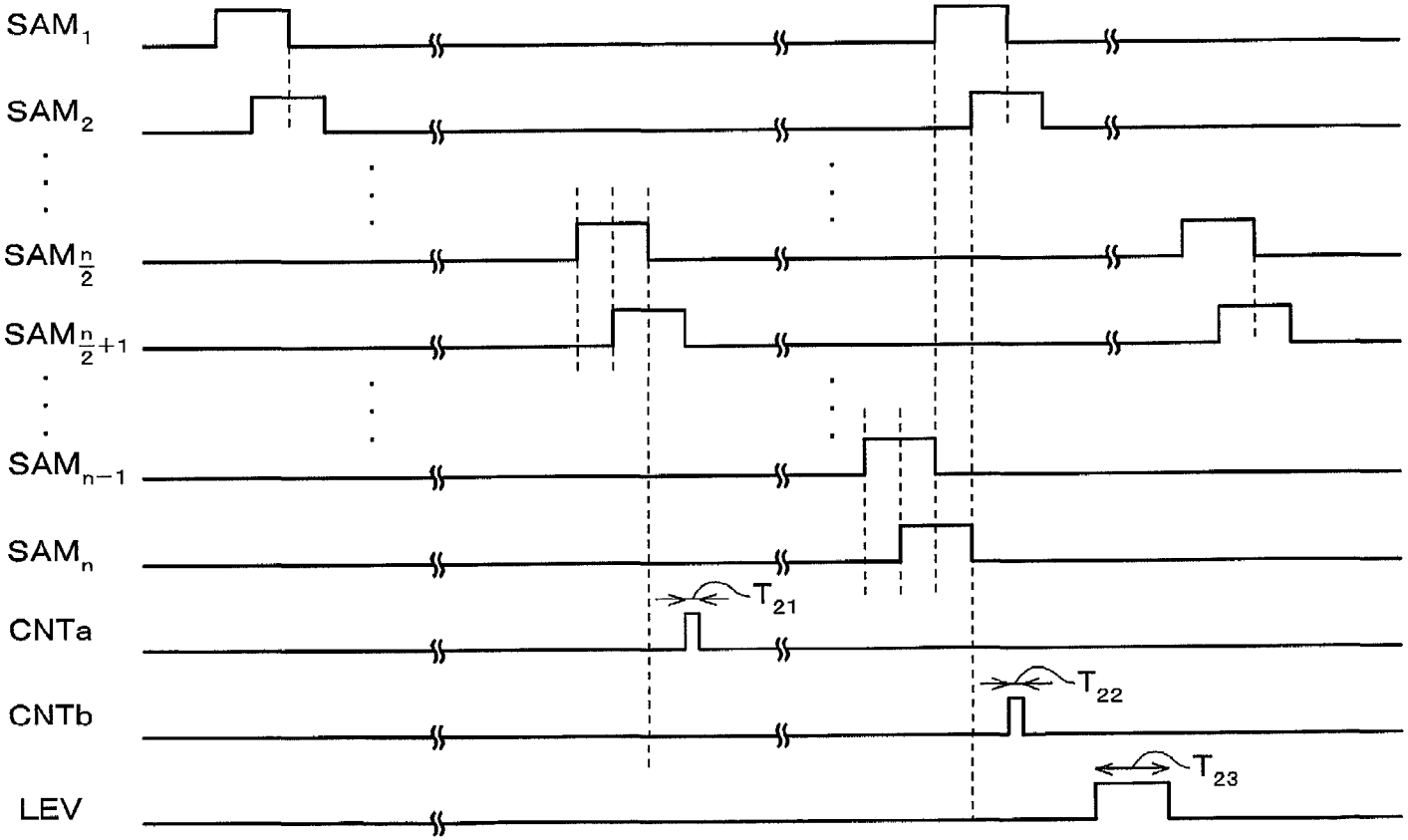
FIG. 8 is an explanatory drawing showing a timing chart of the signal line driving circuit of FIG. 7.

FIG. 8 shows a timing chart. In FIG. 8, the transfer periods of image signals by the group control signals CNTa and CNTb are indicated by $T_{21}$ and $T_{22}$, respectively. The output level of LEV is fixed during a period $T_{23}$, and its effect is as described in FIG. 18.

In this manner, in this structure, unlike that of FIG. 18, the sampling signals are divided into two groups. That is, n sampling circuits (sampling section) are connected by dividing them in half, corresponding to the group control signals CNTa and CNTb, respectively. The data signals of a half (n/2) of the first block 11 (see FIG. 3) are stored in the $C_H$ of their respective sampling circuits at the timings of $SAM_1$ to $SAM_{n/2}$. The remaining n/2 data signals are stored in the $C_H$ of their corresponding sampling circuits at the timings of $SAM_{n/2+1}$ to $SAM_n$.

When $SAM_{n/2+1}$ to $SAM_n$ are selected and storing of their data signals is started, the data signals of $SAM_1$ to $SAM_{n/2}$, which are stored in $C_H$, are transferred (period $T_{21}$) by the group control signal CNTa, which is the control signal, thus getting ready to hold the in-coming image signals of the second block (data which correspond to the right half of the screen). Evidently, during a selection period of $SAM_{n/2+1}$ to $SAM_n$, the first to (n/2)th sampling circuits are in a stand-by state, and no sampling is actually carried out therein. After the selection is finished up to $SAM_n$, the sampling signals ($SAM_1$ to $SAM_n$) are sequentially supplied again, and the image signals are supplied. When $SAM_1$ to $SAM_{n/2}$ is selected and storing of their data signals is started, the data signals of $SAM_{n/2+1}$ to $SAM_n$, which are stored in $C_H$, are transferred (period $T_{22}$) by the group control signal CNTb, which is the control signal. This structure allows sampling of the next block from $SAM_1$ immediately after the sampling up to $SAM_n$ is finished.

As described, the structure of FIG. 7 includes, instead of the two sampling systems of FIG. 5 and FIG. 18 which are provided in parallel for each output, two serial capacitors, which allows output and admission of the signals at the same time by transferring the signals for each admission. In the structure of FIG. 18, there is only one control signal for holding and transfer (control signal CNT0). In contrast, in the example of FIG. 7, as in FIG. 5, the control signal is divided into two (group control signals CNTa and CNTb). In the admission of signals in the first block, while the sampling signal $SAM_{n/2+1}$ to $SAM_n$ are being selected, the data signals of $SAM_1$ to $SAM_{n/2}$ are transferred to be ready for holding the in-coming image signals of the second block. As a result, the image signals of the first block and the image signals of the second block are continuously transmitted, thus admitting data signals (image signals) without causing any problem, even when the data signals of the second block are sent continuously and immediately after the sampling of the signals of the first block up to $SAM_n$ is finished.

The following describes an exemplary structure as shown in FIG. 9. FIG. 9 shows the case of digital data of m bits. For convenience of explanation, FIG. 9 only shows a first sampling circuit 19 and an nth sampling circuit 20 as representative sampling circuits. The data line DAT has the function of transferring a digital signal. The number of tones is m bits. In FIG. 9, an image signal inputted from the terminal on the left end is branched and sequentially inputted to m data lines DAT, i.e., data lines of m bits, and, respectively, to two D-type flip-flops and an D/A convertor DAC, to be outputted as image signals ($S_1$, $S_2$, . . . $S_n$)

Grouping is as shown in FIG. 5 and FIG. 7. That is, when the number of outputs is n (n line outputs) as in the foregoing case, unlike FIG. 18, the outputs are grouped into the first group which includes the first output ($S_1$) to the (n/2)th output ($S_{n/2}$), and the second group which includes the (n/2+1)th output ($S_{n/2+1}$) to the nth output ($S_n$). Here, n is an even number. From the first output ($S_1$) to the (n/2)th output ($S_{n/2}$) are controlled by a group controlling signal LSa for controlling a latch for the lines of the front half, and, from the (n/2+1)th output ($S_{n/2+1}$) to the nth output ($S_n$) are controlled by a group controlling signal LSb for controlling a latch for the lines of the front half. That is, there are two kinds of group control signals, LSa and LSb, for controlling sampling of the sampling signals $SAM_1$ to $SAM_n$. The transfer of the first group is carried out in the vicinity of the $SAM_{n/2}$. This is because $SAM_1$ is sampled continuously and immediately after the sampling of $SAM_1$ to $SAM_n$ is finished, and to eliminate the need for specially modifying the data signals supplied to the data lines. The other operations are the same as those described in FIG. 18.

Figure 10:
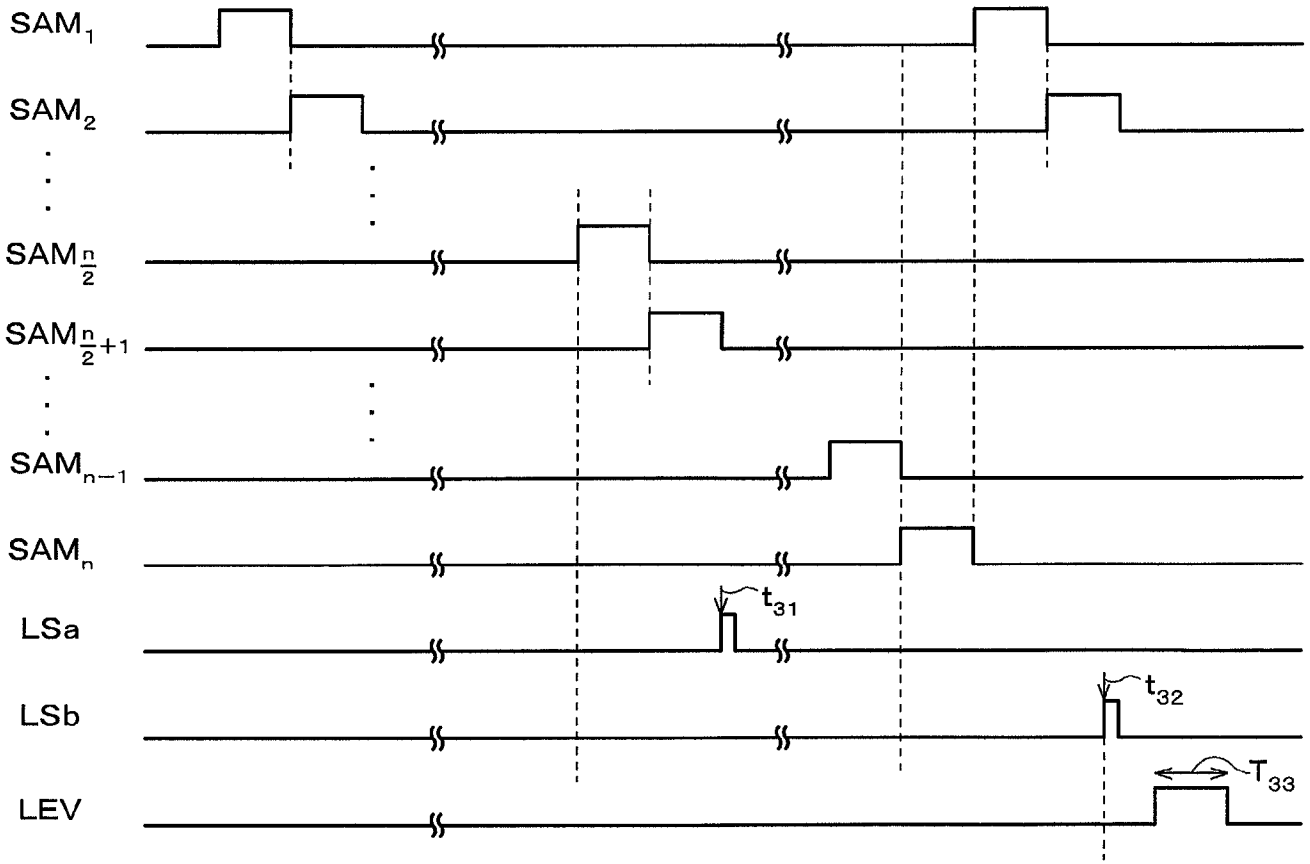
FIG. 10 is an explanatory drawing showing a timing chart of the signal line driving circuit of FIG. 9.

FIG. 10 shows a timing chart. In FIG. 10, the transfer periods of image signals by the group control signals LSa and LSb are indicated by $t_{31}$ and $t_{32}$, respectively. The output level of LEV is fixed during a period $t_{33}$, and its effect is as described in FIG. 18.

In this manner, in this structure, unlike that of FIG. 18, the sampling signals are divided into two groups. That is, n sampling circuits (sampling section) are connected by dividing them in half, corresponding to the group control signals LSa and LSb, respectively. The data signals of a half (n/2) of the first block 11 (see FIG. 3) are stored in the two D-type flip-flops of their corresponding sampling circuits at the timings of $SAM_1$ to $SAM_{n/2}$. The remaining n/2 data signals are stored in the two D-type flip-flops of their corresponding sampling circuits at the timings of $SAM_{n/2+1}$ to $SAM_n$.

When $SAM_{n/2+1}$ to $SAM_n$ is selected and storing of their data signals is started, the data signals $SAM_1$ to $SAM_{n/2}$, which are stored in the two D-type flip-flops, are transferred (time $t_{31}$) by the group control signal LSa, which is the control signal, thus getting ready to hold the in-coming image signals of the second block (data which correspond to the right half of the screen) 12. Evidently, during a selection period of $SAM_{n/2+1}$ to $SAM_n$, the first to (n/2)th sampling circuits are in a stand-by state, and no sampling is actually carried out therein. After the selection is finished up to $SAM_n$, the sampling signals ($SAM_1$ to $SAM_n$) are successively supplied again, and the image signals are supplied. When $SAM_1$ to $SAM_{n/2}$ are selected and storing of their data signals is started, the data signals $SAM_{n/2+1}$ to $SAM_n$, which are stored in the two D-type flip-flops, are transferred (time $t_{32}$) by the group control signal LSb, which is the control signal. This structure allows sampling of the next block from $SAM_1$ immediately after the sampling up to $SAM_n$ is finished.

As described, the structure of FIG. 9 includes, instead of the two sampling systems of FIG. 5 and FIG. 18 which are provided in parallel for each output, two serial D-type flip-flops, which allows output and admission of the signals at the same time by transferring the signals for each admission. In the structure of FIG. 18, there is only one control signal for holding and transfer (control signal CNT0). In contrast, in the example of FIG. 9, as in FIG. 5 and FIG. 7, the control signal is divided into two (group control signals LSa and LSb). In the admission of signals in the first block, while the sampling signal $SAM_{n/2+1}$ to $SAM_n$ are being selected, the data signals of $SAM_1$ to $SAM_{n/2}$ are transferred to be ready for holding the in-coming image signals of the second block. As a result, the image signals of the first block 11 and the image signals of the second block 12 are continuously transmitted, thus admitting data signals (image signals) without causing any problem, even when the data signals of the second block are sent continuously and immediately after the sampling of the signals of the first block up to $SAM_n$ is finished.

Figure 13:
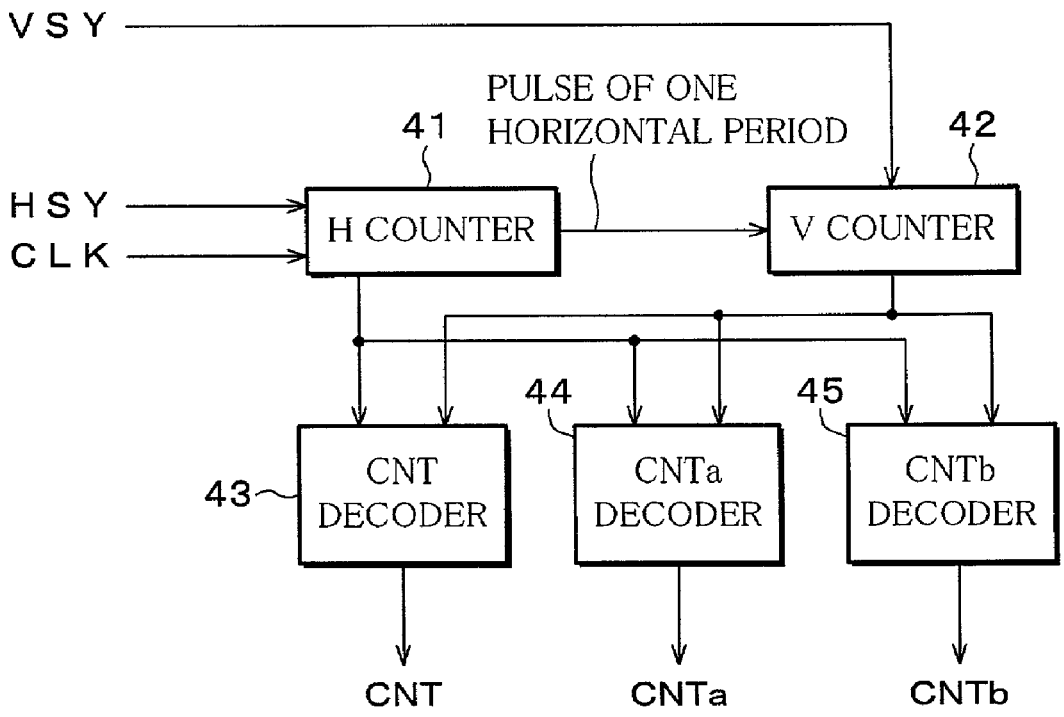
FIG. 13 is a block diagram showing a schematic exemplary structure of a circuit for generating a group control signal and a control signal.

FIG. 13 shows an exemplary structure of a generating section of the control signal CNT and the group control signals CNTa and CNTb. Indicated by "VSY" is a vertical synchronize signal which is synchronized with an image. The input signals to an H counter 41 are the same as those in the examples of FIG. 11 and FIG. 12. A pulse of one horizontal period is inputted from the H counter 41 to a V counter 42 (here, "V" indicates "vertical"). The HSY (and clock CLK) is counted in the H counter 41 and the V counter 42, and decoders (CNT decoder 43, CNTa decoder 44, and CNTb decoder 45) respectively generate pulses based on the values of the counters. Note that, the control signal CNT0 can also be generated in the same manner as the group control signals CNTa and CNTb, by designating one of the CNTa decoder 44 and the CNTb decoder 45 as a CNT0 generating decoder and by omitting the other in the arrangement of FIG. 13. Each decoder outputs, as in the examples of FIG. 11 and FIG. 12, a pulse according to a predetermined value which has been set beforehand. The predetermined value varies depending on the number of outputs of drivers, etc., and is decided and optimized beforehand based on these factors. Note that, an arrangement wherein a PLL oscillator is provided may also be adopted as in FIG. 11.

In FIG. 13, each decoder comes into operation, taking into consideration an output of the V counter 42. This is because, while a pulse which periodically changes at the same timing in one horizontal period can be created by the use of the H counter alone as in the case of FIG. 11 and FIG. 12, the control signal CNT, etc., does not show the periodic change at the same timing in one horizontal period, which necessitates using the V counter (by which counting is made per one horizontal period).

Figure 14:
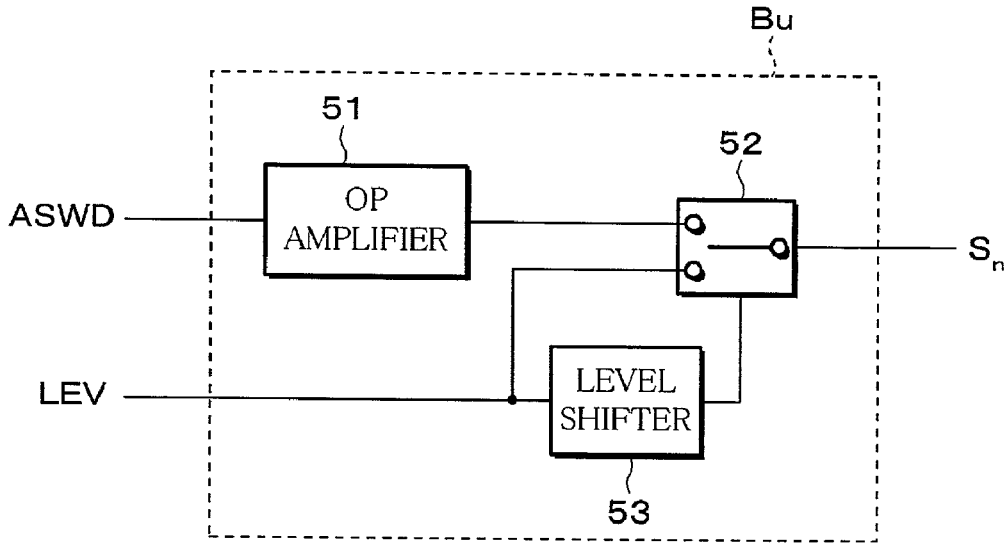
FIG. 14 is a block diagram showing a schematic exemplary structure of an output buffer.
Figure 15:
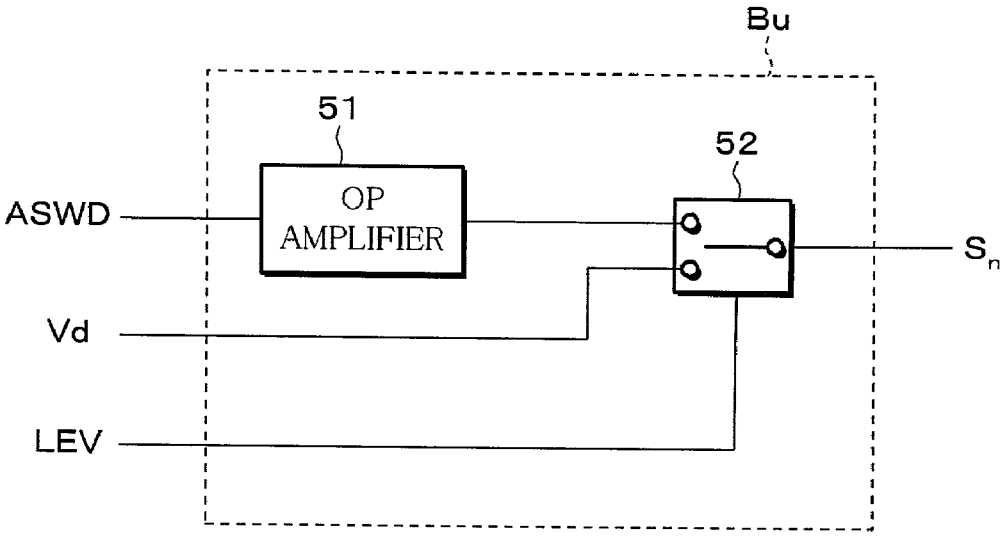
FIG. 15 is a block diagram showing a schematic exemplary structure of an output buffer.

FIG. 14 through FIG. 17 show exemplary structures of an output buffer Bu. FIG. 14 shows the case where a desired charge voltage is added to a signal LEV in the structure of FIG. 18. FIG. 15 shows the case where switching is made to a desired charge voltage Vd using the signal LEV as a timing signal in the structure of FIG. 18. Note that, in FIG. 14 and FIG. 15, "ASWD" applies to the case of FIG. 5 and FIG. 18, and "ASWD" becomes "ASWH" in the case of FIG. 7. A signal from the ASWD is inputted to an OP amplifier (operational amplifier) 51. In FIG. 14, the LEV is inputted directly as a charge voltage to a switch 52, and also as a signal which indicates a switching timing via a level shifter 53 to the switch 52. In FIG. 15, the LEV is inputted as a signal which indicates a switching timing directly to the switch 52, and a desired charge voltage Vd is inputted to the switch 52.

Figure 16:
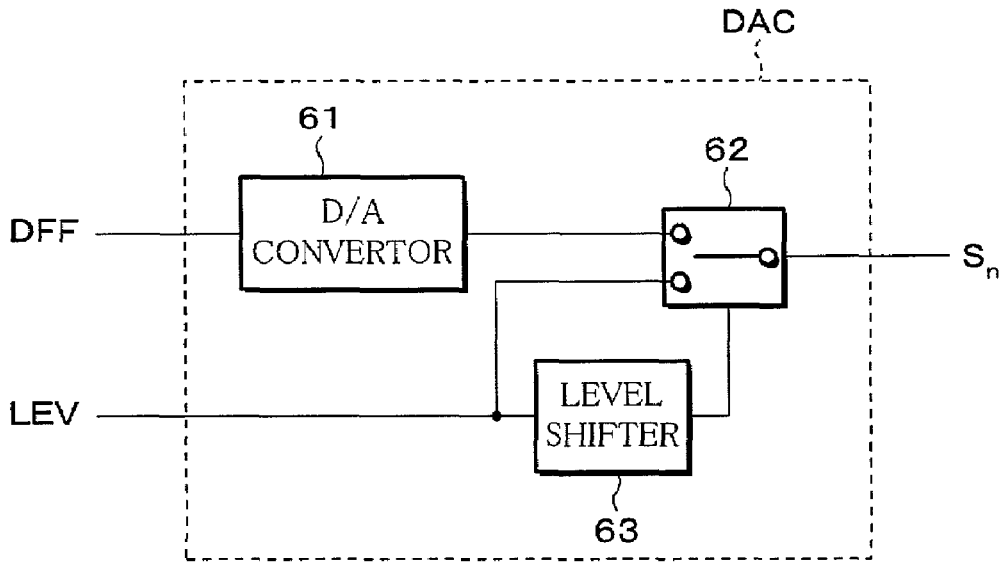
FIG. 16 is a block diagram showing a schematic exemplary structure of a D/A convertor.
Figure 17:
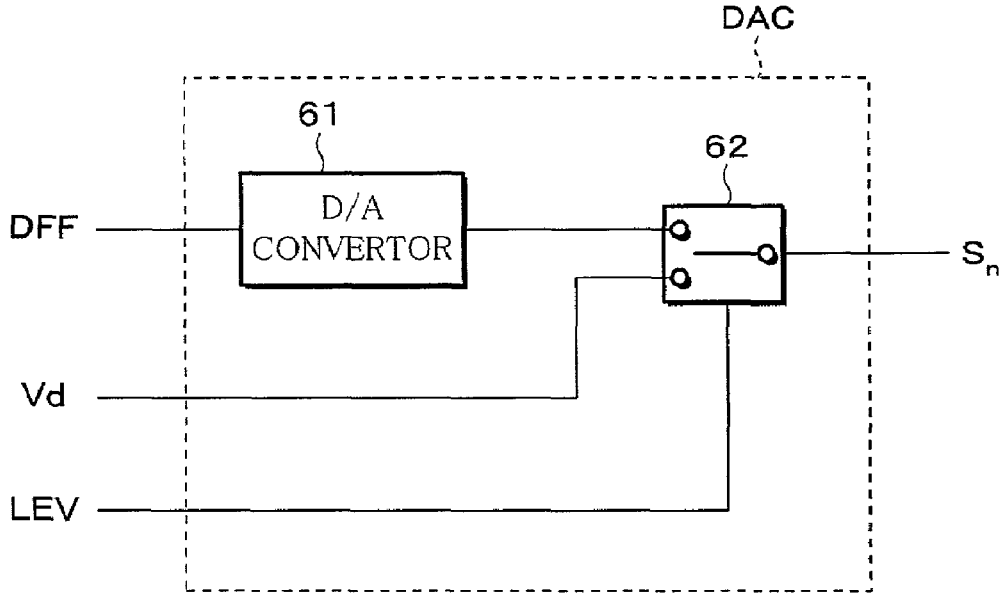
FIG. 17 is a block diagram showing a schematic exemplary structure of a D/A convertor.

FIG. 16 and FIG. 17 show exemplary structures of the D/A (digital/analog) convertor DAC. FIG. 16 shows the case where a predetermined charge voltage is added to the signal LEV in the structure of FIG. 9. FIG. 17 shows the case where switching is made to a predetermined charge voltage Vd with the use of the signal LEV as a timing signal in the structure of FIG. 9. In each of n sampling circuits of FIG. 9, a signal DFF immediately before the DAC, i.e., a signal from the output Q of the D-type flip-flop of the second stage, is inputted to the D/A convertor 61. In FIG. 16, the LEV is inputted directly as a charge voltage to the switch 62, and as a signal which indicates a switching timing via the level shifter 63 into the switch 62. In FIG. 17, the LEV is directly inputted as a signal which indicates a switching timing into the switch 62, and a predetermined charge voltage Vd is inputted to the switch 62.

The foregoing operation can be realized relatively easily by making up the structure using the switch. Even though the predetermined charge voltage Vd can alternatively be inputted externally from the source driver (signal line driving circuit 1), the inconvenience of supplying power externally from the driver can be eliminated by directly providing operation power for the source driver, or by using a voltage which is resistively divided from the operation power.

Note that, in any of the foregoing structures of FIG. 5, FIG. 7, and FIG. 9, it is not necessarily required for the sampling circuits to be grouped exactly in half, as long as they are grouped into a plurality of groups. Further, the number of groups is not just limited to two. More specifically, the sampling circuits are grouped into a predetermined number of groups based on a switching time which is decided by a clock frequency and a switching rate of each analog switch (ASWA, etc.). The border of grouping in this example is at n/2 since this provides.

The following will describe a data transfer operation and a state of image signals by the foregoing structures. Note that, the explanation will be given through the case of a display screen with vertical stripes of three tones as shown in FIG. 3, instead of a display screen of entire black.

To explain its basic operation, while a certain scanning line $g_1$ is being selected (see FIG. 1), i.e., while a certain line is selected, a pulse (signal line switching element control signal) is sent from each decoder as shown in FIG. 11 and FIG. 12 subsequently to the control wires $SW_1$ and $SW_2$, so as to conduct the signal line switching elements (e.g., SWa). Then, by the selection of $SW_1$, the signal line switching elements SWa and SWb are conducted. As a result, image signals from the signal line driving circuit 1 are supplied to the signal lines a and b. Because the scanning line $g_1$ is selected, the image signals of the signal lines a and b are applied to pixels $A_1$ and $B_2$, respectively. Here, since $SW_2$ is non-selected, no image signals are supplied to signal lines c and d. Thereafter, $SW_1$ become non-selected, and SWa and SWb become non-conducted, thus holding the signal lines a and b and the pixels $A_1$ and $B_1$. Then, when $SW_2$ is selected and the signal line switching elements SWc and SWd are conducted, image signals from the signal line driving circuit 1 are supplied to the signal lines c and d, and since the scanning line $g_1$ is selected, the image signals of the signal lines c and d are applied to the pixels $C_1$ and $D_1$, respectively.

Figure 2:
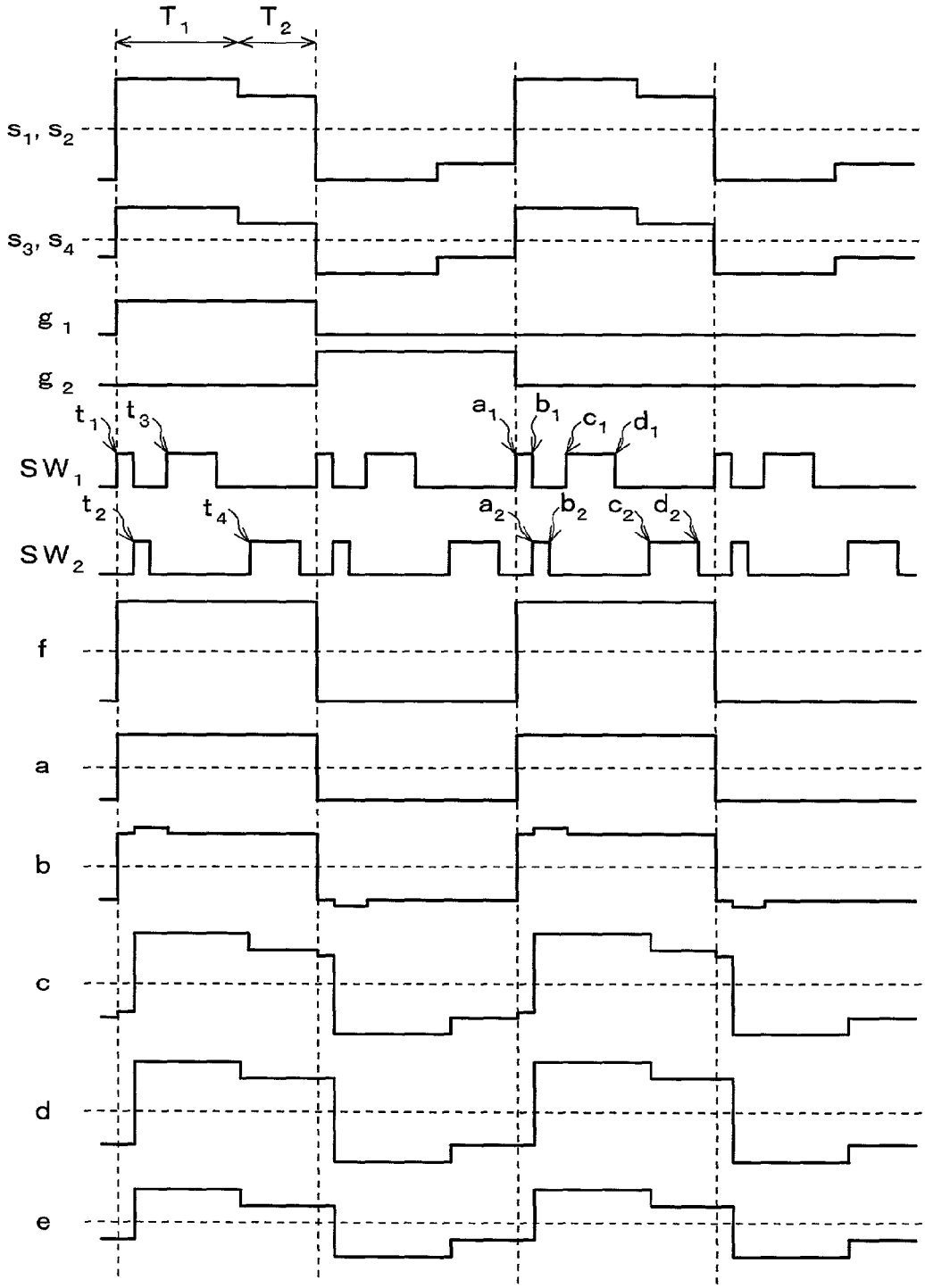
FIG. 2 is an explanatory drawing showing a timing chart by a driving method employing the active-matrix substrate.
Figure 32:
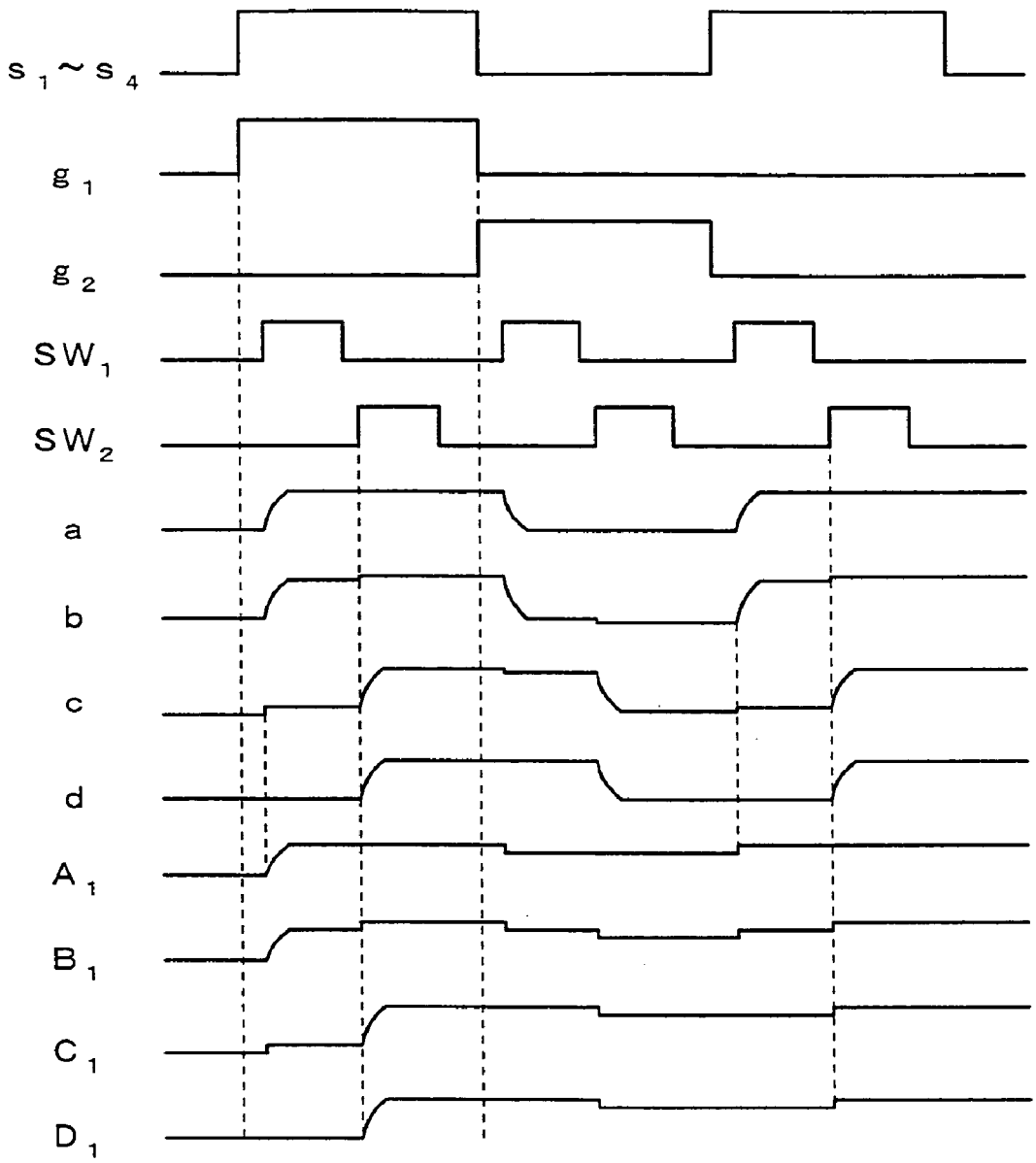
FIG. 32 PRIOR ART
FIG. 32 is an explanatory drawing showing a timing chart by the driving method employing a conventional active-matrix substrate.

The scanning lines $g_1$ and $g_2$ are supplied by the scanning line driving circuit 2, as shown in FIG. 3, and image signals are supplied from the signal line driving circuit 1 so that the vertical stripes becomes thinner in the display areas 3, 4, and 5 in this order. FIG. 2 shows a state of image signals under this condition. In the present embodiment, prior to the timings ($t_3$ and $t_4$ in FIG. 2) of supplying normal image signals (data signals) to the signal lines by the normal selection of the control wires, selection is made at $t_1$ and $t_2$ as shown in FIG. 2 to invert the polarity of the signal lines in advance. The selection of the control wires $SW_1$ and $SW_2$ is distinguished between normal selection and preliminary selection, where the former refers to selection which is normally carried out, and the latter refers to selection which is carried out prior to the normal selection. In the present embodiment, while a single line is being selected by switching on the scanning line (select period, one horizontal period), the signal lines c, d, e, e' which belong to the second block 12 are preliminarily conducted prior to the end of a period in which the image signal is normally applied to each line (each lines of scanning signals $g_1$ and $g_2$, etc.) as normal conduction of the first block 11 (signal lines f', f, a, b), so as to invert the polarity. At the timing $t_2$ at which $SW_2$ is selected, the signal line b has a hike as in the conventional structure shown in FIG. 32. However, the normal timing of the image signal is $t_3$, and a correct potential is given by the application to the signal line via the signal line switching element, and this state is maintained until the scanning line $g_1$ becomes non-selected. As a result, the foregoing problem of visible border can be solved.

In the driving method of FIG. 2, as shown therein, the image signal is divided according to intervals $T_1$ and $T_2$ in a chronological order within one select period of the scanning line, and image signals which are supplied in a time sequential manner are sent sequentially to the signal lines from the signal line driving circuit 1 in such a manner that the image signals of the first block are first admitted by the multiplexer of the signal line driving circuit 1 in interval $T_1$, and then the image signals of the second block are admitted in interval $T_2$.

Incidentally, as the timing $t_4$, the potential given to the signal line c is different from that given at $t_2$, and there are cases where the signal line b is hiked according to the potential difference. However, the potential difference is sufficiently small compared with the polarity inversion of the image signal, and, in many cases, it does not become visible. However, in case where oscillation of the signal line b due to the potential difference becomes visible by the magnitude of the parasitic capacitance Csd, it is effective to apply the image signal as shown in FIG. 4. The following explains how this is done.

A desired voltage is applied at the time of preliminary polarity inversion, separately from the output signal (image signal) from the signal line driving circuit 1. In the signal driving system according to FIG. 4, the signal line driving circuit 1 has incorporated a memory function for storing such a desired voltage. Specifically, the signal LEV as shown in FIG. 5, FIG. 7, and FIG. 9 is used. That is, as noted above, a desired charge voltage is added to the signal LEV. In this case, the desired charge voltage added to the signal LEV has signal intensity which has been increased or decreased from the value of signal intensity at the time of the normal polarity inversion of the first block 11, so as to have a value close to the signal intensity at the time of the normal polarity inversion of the second block 12. Further, here, the signal supplied as the desired charge voltage to the signal LEV has the same potential as that applied at the time of the normal potential inversion of the second block 12 in which the preliminary polarity inversion is carried out.

Alternatively, as noted above, the voltage may be, for example, switched to the desired voltage (Vd) in accordance with the input timing of the signal LEV.

In this manner, the image signals which correspond to the first block 11 and the second black 12, respectively, are also supplied in the described manner to the output lines $s_1$ through $s_4$ at the timings of $t_1$ and $t_2$, and the signals are accurately applied to the signal lines and the pixels at the timings $t_3$ and $t_4$ after raising the signal lines roughly to a predetermined voltage. Here, the term "roughly" indicates a degree which does not cause oscillation on the signal line at the border at the time of $t_3$ and $t_4$, and it is not necessarily required to have a potential exactly the same as that of the output lines $s_1$ through $s_4$. That is, the select period (data signal is applied) of the signal lines selected at the timings $t_1$ and $t_2$ can be made short to some extent.

Further, depending on restrictions of time for the admission of the signals in the signal line driving circuit 1, the image signals of a previous line or previous frame may be supplied at the timings $t_1$ and $t_2$ by suitably setting their polarity. In this way, substantially the same effect can be obtained.

In the structure as shown in FIG. 18, the CNT selects the system B and a display signal of interval $T_2$ is outputted while the system A is selected by the CNT0 and the display signal is being admitted in the sampling hold capacitors $C_{SHA}$ and $C_{SHB}$. This structure is limited to the case where the data signals which are supplied in a time sequential manner are outputted without resulting in change in order, and in order to carry out the driving as shown in FIG. 4, since the data signals cannot be inputted and outputted simultaneously, it is required to quickly receive the two systems of data signals and output them at their respective timings, or to increase the capacity of the sampling hold capacitors ($C_{SHA}$ and $C_{SHB}$) in parallel, or to have a memory function on the supply side of the data signals.

Incidentally, in the structure of FIG. 18, the CNT0 selects the system B at the timing $t_5$ (see FIG. 19), and starts to admit a new data signal. By inverting the polarity in advance, the signals of the system B of the previous line are supplied with the same polarity prior to the selection at $t_3$ and $t_4$. Evidently, it is required here that the signals of the scanning lines of the previous stage have been switched off beforehand. Further, in the case of driving with a plurality of blocks, it is required to increase the number of sampling hold capacitors in parallel, or to add a memory function on the side of supplying the data signals.

There is high probability that the display signal of the previous line has the same display state as the display signal of the current line, and even at the border where the display in the vertical direction changes, the voltage oscillation is significantly smaller compared with the conventional example where signals are applied with the opposite polarity, and therefore the foregoing display deficiency is limited to one pixel, and the possibility of this deficiency becoming visible is very small.

When the signal line driving circuit 1 has a line memory with the memory function, the display signals of the previous frame can be supplied only by setting their polarity. In this case, the foregoing display deficiency appears only at the moment when the display state changes from the previous frame, and the border of the blocks does not become visible.

Note that, the same hike also occurs at the moment when the destination of the image signals is changed from the second block to the first block, when $SW_1$ is selected while $SW_2$ is non-selected; however, no display problem is caused on pixel $C_1$ because the potential is replaced with a correct potential by the selection of $SW_2$ at the next timing while the scanning line $g_1$ is being selected. Further, the oscillation of the scanning line $g_1$ due to $C_{sd}$ during non-conduction thereof varies depending on the signal line which is capacitively coupled with the pixels, but the difference is insignificant as the effective value of the entire display period and no problem is caused.

The present embodiment thus prevents degradation of display quality due to potential oscillation of the signal lines. Note that, the present embodiment explained the case where two blocks are provided, but it is also applicable to driving employing a larger number of blocks.

In the present embodiment, in the case of two blocks, as shown in FIG. 2, among the two ON (High) periods of the control wire $SW_1$ in one select period of the scanning line, the one which starts with time $t_1$, which is the preliminary polarity inversion period, has ON time $a_1$ and OFF time $b_1$, and the one which starts with time $t_3$, which is the normal polarity inverse period, has ON time $c_1$ and OFF time $d_1$. Similarly, among the two ON (High) periods of the control wire $SW_2$ in the select period of the scanning line, the one which starts with time $t_2$ has ON time $a_2$ and OFF time $b_2$, and the one which starts with time $t_4$ has ON time $c_2$ and OFF time $d_2$. Here, $b_2 \leqq d_1$. Also, $b_1 \leqq a_2$, and $d_1 \leqq c_2$. Further, $b_2 \leqq c_1$.

Figure 20:
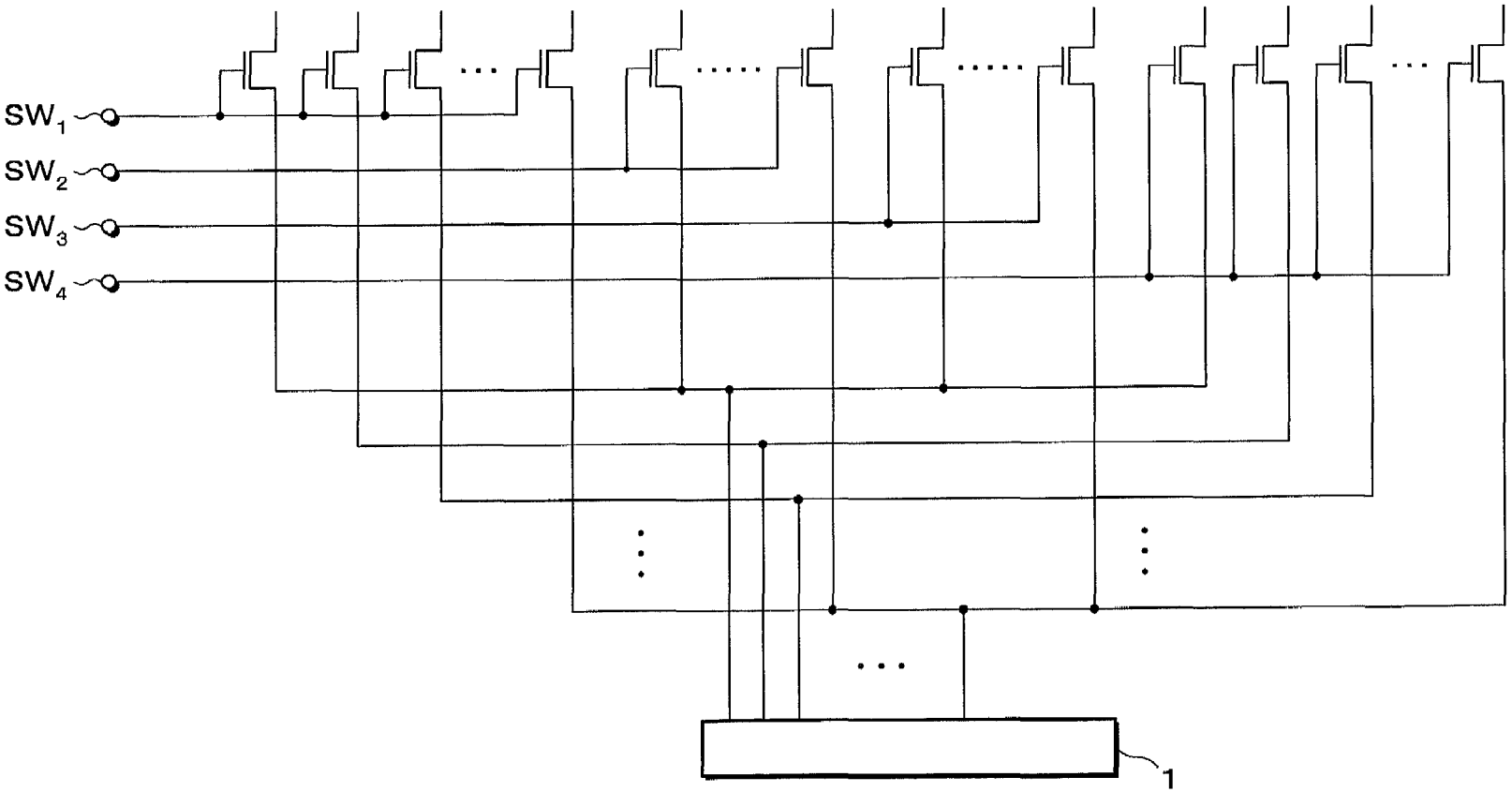
FIG. 20 is an explanatory drawing showing an exemplary structure for applying an image signal to signal lines by dividing the signal lines into two or more blocks.

In the same manner, it is assumed here that there are N blocks (where N is an integer of not less than 2), where the blocks are adjacent to each other in order from the first to the Nth blocks. FIG. 20 shows an example where the number of blocks N is 4. That is, four control wires $SW_1$, $SW_2$, $SW_3$, $SW_4$ are used. Here, with respect to a kth block where k is an integer of not less than 2 and not more than N, among the two ON (High) periods of the control wire $SW_k$ in one select period of the scanning line, the one which is the preliminary polarity inversion period has ON time $a_k$ and OFF time $b_k$, and the one which is the normal polarity inverse period has ON time $c_k$ and OFF time $d_k$. Here, when $d_{k-1} \leqq c_k$, i.e., when the normal polarity inverse time (time at which a normal data signal is applied) is delayed as the number increases, the relation $b_k \leqq d_{k-1}$ is set. Also, $b_{k-1} \leqq a_k$ is set. That is, the start time of the preliminary polarity inversion is delayed as the number increases so that it is after the end time of the preliminary inversion of the previous block. Note that, alternatively, $b_k \leqq a_{k-1}$ may be set. That is, the end time of the polarity inversion may be advanced as the number increases so that it is before the start time of the polarity inversion of the previous block. Further, in either case, the preliminary polarity inverse periods of arbitrary adjacent blocks may have an overlap time.

Figure 24:
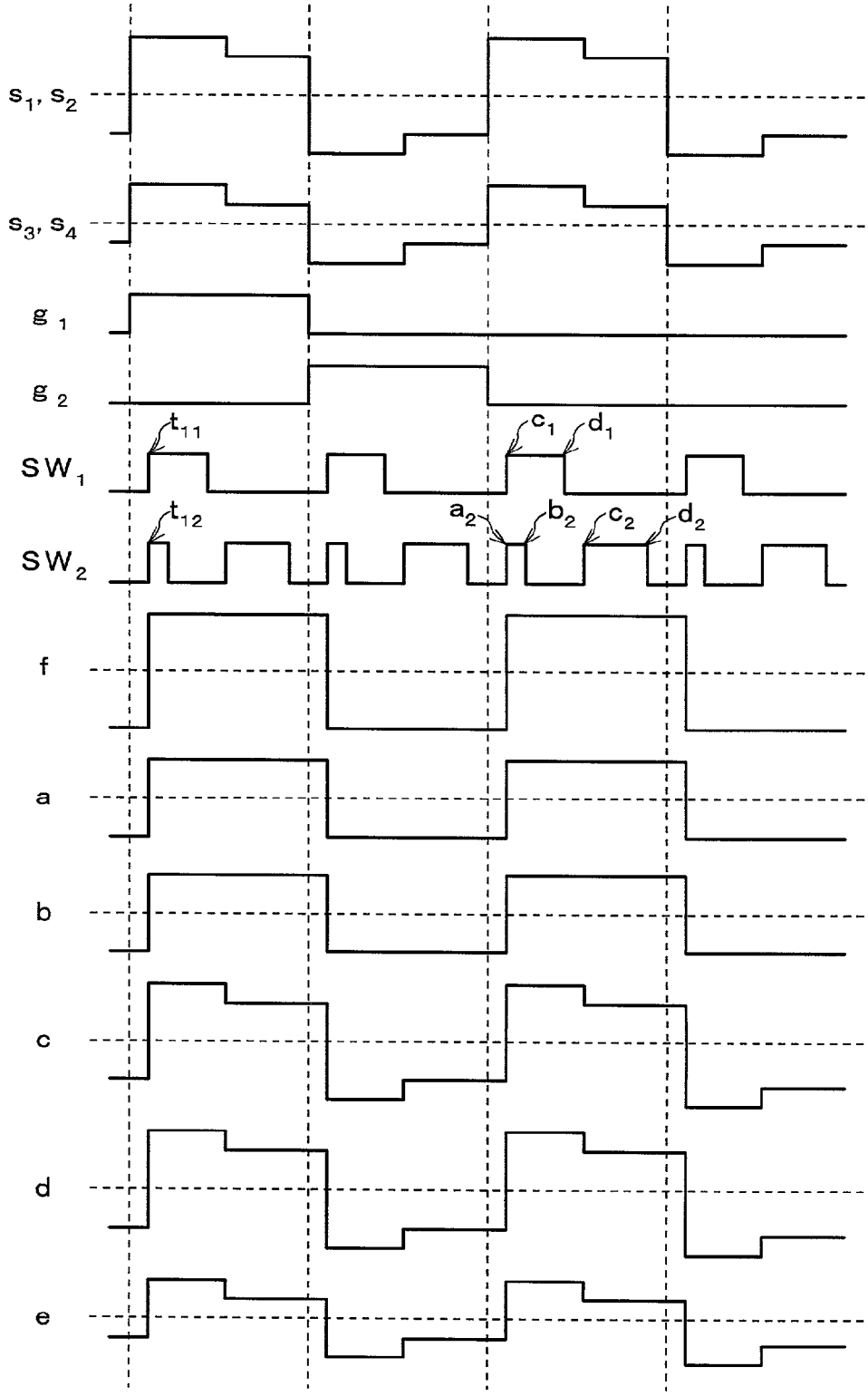
FIG. 24 is an explanatory drawing showing a timing chart by the driving method employing the active-matrix substrate.

Further, it is also possible to have a relation $b_N \leqq c_1$. That is, the end time of the preliminary inverse period of an Nth block may be on or before the start time of the normal inverse period of the first block, which, however, is not limiting. However, the end time of the preliminary polarity inversion of the last block N is preferably before the start time of the normal polarity inversion (data signal is applied) of the first block for the following reasons. When the signal line switching elements (e.g., SWa) of a certain block is ON while another block is supplying a normal data signal, there will be an increase in load on various places of the signal line driving circuit 1 and panel (liquid crystal panel), e.g., auxiliary capacitor wiring (not shown), and due to the influence of signal delay, etc., the charge characteristics of the block to which the normal data signal is supplied may become different from that of other blocks. This may not cause any problem depending on driving capacity of the signal line driving circuit 1, a load or size of the panel, a pre-set charging rate, i.e., a resistance value of the pixel transistor or signal line switching element. Note that, such a structure is shown in FIG. 24 to be described later.

Further, as shown in FIG. 3, when the block to which the data signal is applied by the conduction of the control wire $SW_1$ is on the left end of the screen (first block 11), i.e., when it is the first block to which the normal data signal is applied, the preliminary polarity inversion (polarity inversion at $t_1$) is not required. However, since it is preferable in actual practice to exactly match the charging rate, etc., among blocks, it is preferable to have the same release time or waveform (conduction timing, etc.) for the control wires $SW_1$, $SW_2$, . . . This also applies to the following embodiments.

[Second Embodiment]

Figure 21:
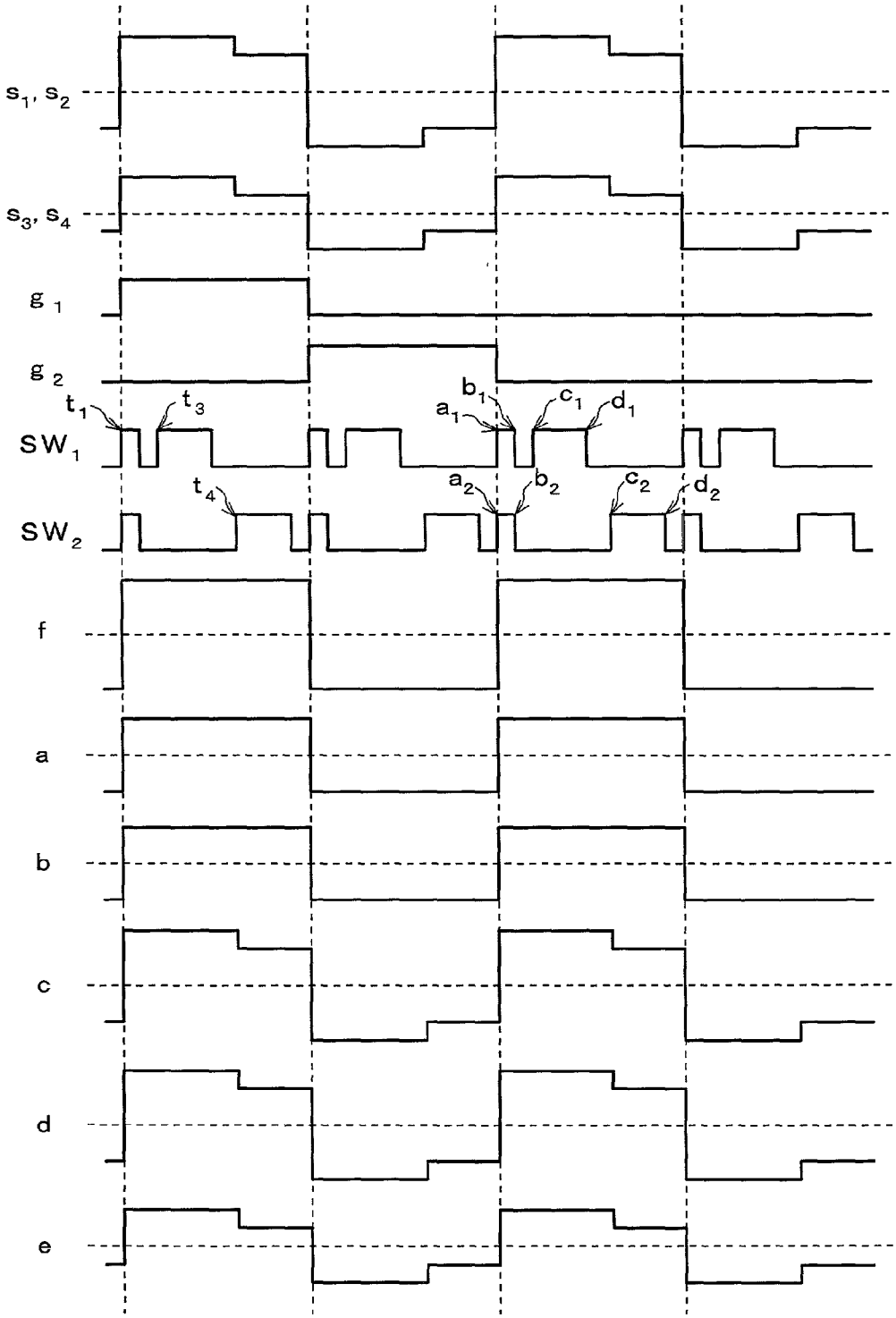
FIG. 21 is an explanatory drawing showing a timing chart by the driving method employing the active-matrix substrate.
Figure 22:
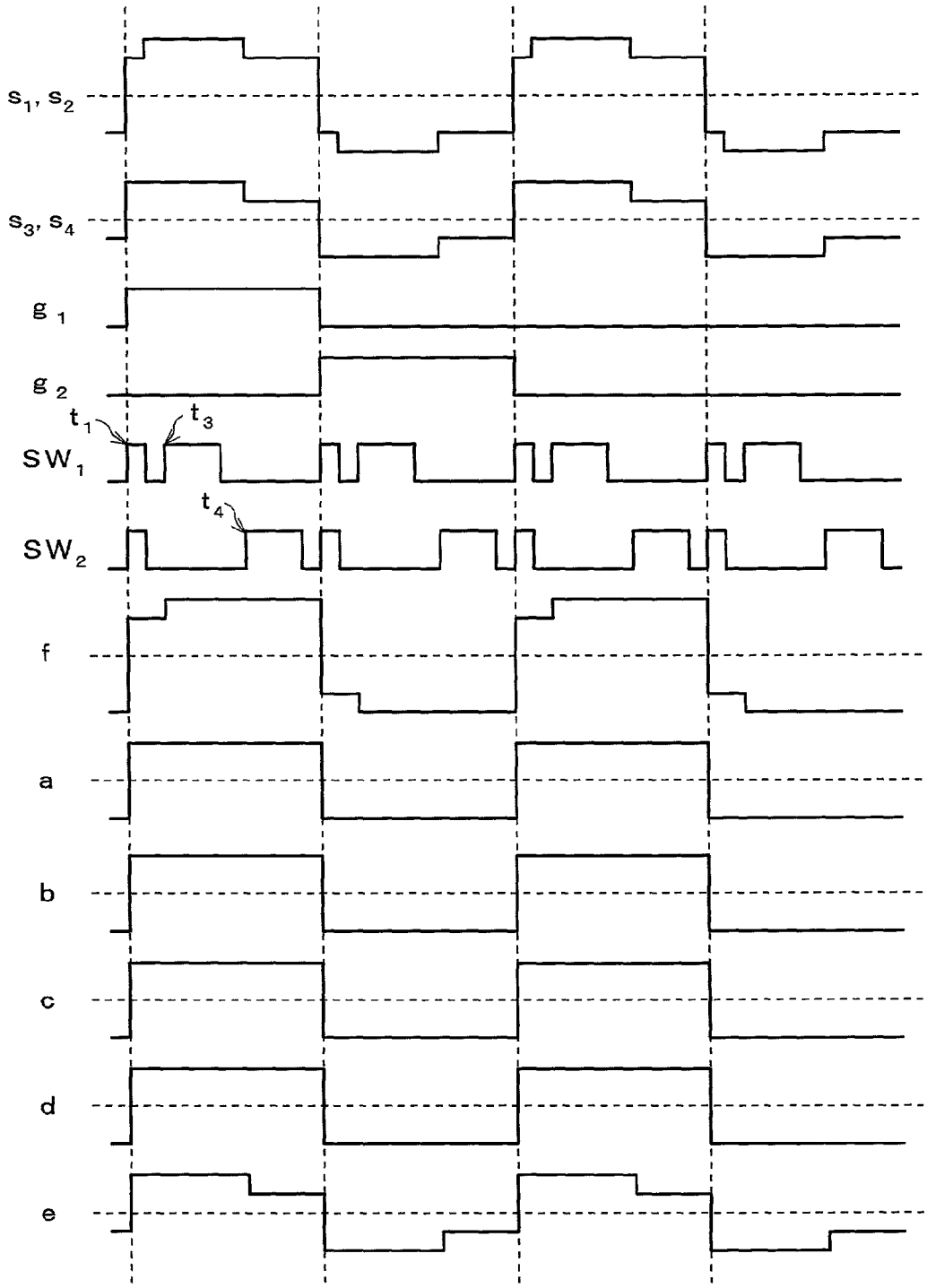
FIG. 22 is an explanatory drawing showing a timing chart by the driving method employing the active-matrix substrate.

The following will describe another embodiment of the present invention referring to FIG. 21 and FIG. 22. Note that, for convenience of explanation, elements having the same functions as those explained in the drawings of the foregoing embodiment are given the same reference numerals and explanations thereof are omitted here.

In the present embodiment, as shown in FIG. 21, a plurality of blocks are selected once at the same time prior to the selection of each block, so as to invert the polarity of signal lines. FIG. 21 only show two blocks and their effect appears nominal. In reality, however, in the case of driving using many blocks, for example, four blocks, it becomes important to select the blocks simultaneously and to end the polarity inversion of the signal lines in a short period of time, in order to secure enough time for supplying an accurate potential to each block in the subsequent operation. The duration of the periods which are selected simultaneously is set such that the signal line at the border is not affected by oscillation, and, specifically, it is sufficient to have a value twice the time constant which is given by the signal line switching element and the signal line capacitance.

In this manner, in the present embodiment, under the restriction where the driving is made per block, the signals are supplied simultaneously prior to sequentially supplying image signals to the respective signal lines, so as to apply inverse signals in advance to prevent the border of the blocks from becoming visible. This reduces display deficiency due to potential fluctuation by $C_{sd}$.

Incidentally, it was mentioned that the signal line b experiences a slight hike by the change in potential of the signal line c at the timing $t_4$. This slight potential fluctuation becomes most visible when displaying half-tones. To say it backwards, no deficiencies due to $t_4$ will be caused by the setting which eliminates the deficiencies in half-tones. Even though the image signal applied to the first block is given at $t_1$ in FIG. 21, as shown in FIG. 22, by supplying a half-tone image signal at $t_1$, there will be no fluctuation at the timing $t_4$ when a half-tone is displayed on the lines which correspond to the signal lines b and c. The half-tone image signal used here is prepared as the signal LEV as discussed above. That is, the LEV is used to bring a charge level to a desired charge voltage in advance, as explained in the First Embodiment with reference to FIG. 4. Namely, either a desired charge voltage is applied to the signal LEV, or the signal LEV is used to bring a voltage to a desired voltage, for example, by switching.

The largest potential fluctuation occurs when a half-tone voltage is applied to the signal lines b and c at $t_1$ and when a black or white voltage is supplied to the signal line c at $t_4$. Even in this case, while the signal line b is at the black or white potential at $t_3$, no abnormality on pixel $B_1$ is recognized because a change in transmittance of the liquid crystal with respect to the potential fluctuation is small, and since the pixel $B_1$ is on the border at which the tone of adjacent pixels changes, the potential fluctuation does not become visible even when the signal b remains at the half-tone at $t_3$.

The definition as discussed in the First Embodiment can be applied as follows in the present embodiment. When the number of blocks is two, the relation of $b_2 \leqq d_1$ is set. Also, $a_1=a_2$, $b_1=b_2$, and $d_1 \leqq c_2$. Further, $b_2 \leqq c_1$.

Similarly, in the case of N blocks, $b_k \leqq d_{k-1}$, and $a_1=a_2=\ldots=a_N$, $b_1=b_2=\ldots=b_N$, and $d_{k-1} \leqq c_k$. Further, as in the First Embodiment, $b_N \leqq c_1$.

[Third Embodiment]

Figure 23:
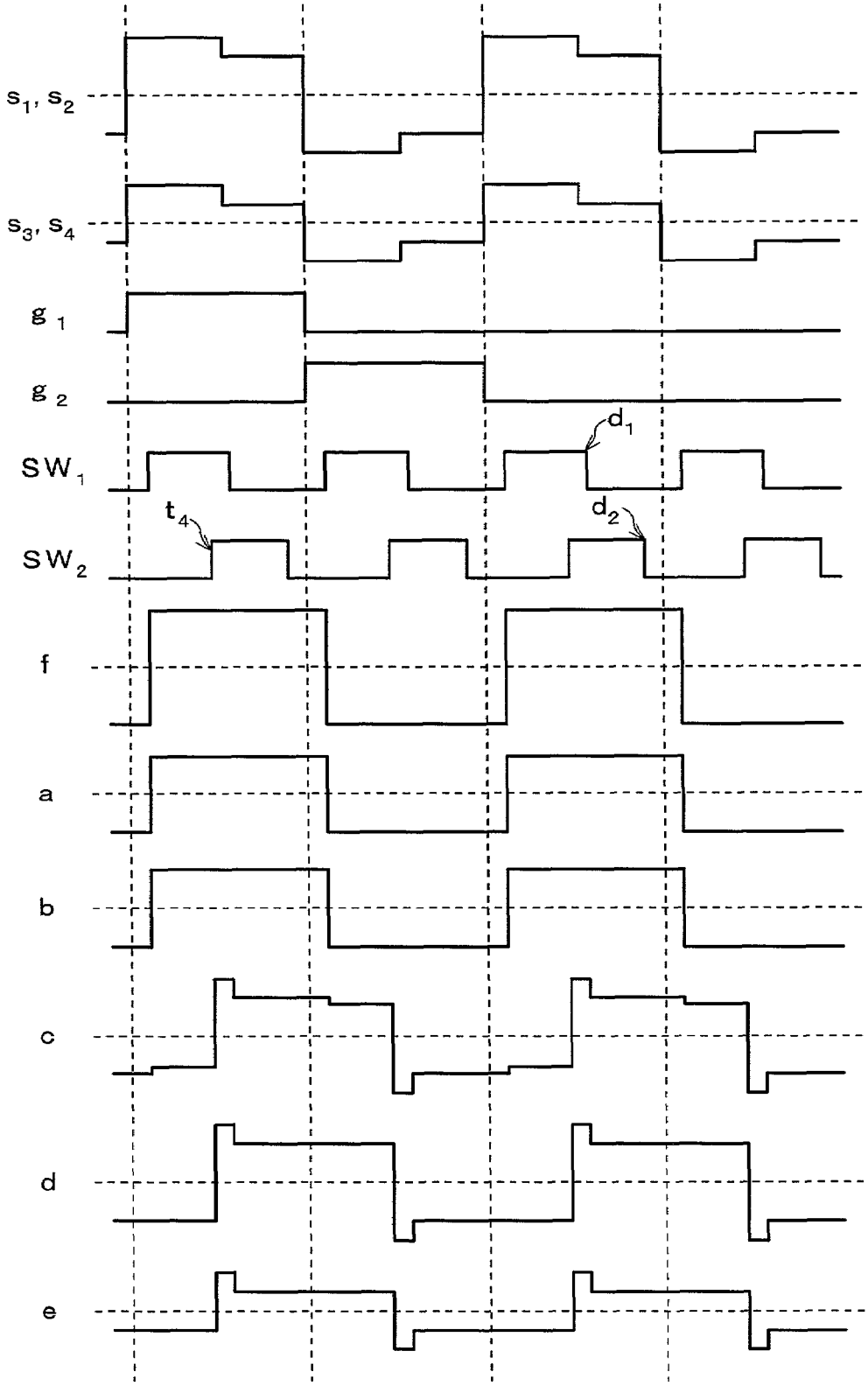
FIG. 23 is an explanatory drawing showing a timing chart by the driving method employing the active-matrix substrate.

The following will describe yet another embodiment of the present invention referring to FIG. 23 and FIG. 24. Note that, elements having the same functions as those described in the drawings of the foregoing embodiments are given the same reference numerals and explanations thereof are omitted here.

In the present embodiment, unlike the First and Second Embodiments, $SW_2$ is selected purposefully before $SW_1$ is switched to non-select. FIG. 23 shows how this is done. At the time when the polarity of the signal line c is inverted at $t_4$, the signal line switching element $SW_1$ of the signal line b is still being conducted, and therefore $s_4$ is in accordance with the supplied voltage, and, unlike the conventional case, $s_4$ is not fixed by the application of the signal to the pixel while there is a hike. Because it is not required to provide a period for conducting $SW_2$ as in the First and Second Embodiments, it is possible to increase the time for applying a normal voltage via the signal line switching element (voltage applied at the time of normal polarity inversion).

The electrostatic capacitance of the signal lines is generally large, and thus it is difficult to lower the resistance value of the switching elements to the extent which allows a signal with a sufficiently small time constant. The driving method of the present embodiment is very useful in such a case.

Further, since it is not required to generate a pulse, etc., which is discrete to the preliminary polarity inversion, the signal waveform of the control wire can be made simpler. As a result, a circuit for generating signals for the control of the signal line driving can be made simpler.

Here, depending on the performance of the signal line driving circuit or impedance of wiring on the active-matrix substrate, there are cases where the potential of the image signals of the output lines $s_1$ through $s_4$ falls at $t_4$ in FIG. 23. This is caused by an abrupt increase in voltage, and the potential returns to a desired potential after a certain elapsed time. However, since $t_4$ is immediately before the time when $SW_1$ becomes non-selected, there are cases where the instantaneous voltage drop affects the last stage of signal application to the pixels, and as a result the voltage is fixed at the dropped level. The following describes this.

In order to prevent this, in FIG. 24, the polarity of the signal line c is inverted by selecting $SW_2$ at the early stage of the $SW_1$ selection. Then, $SW_2$ is non-conducted to accurately supply image signals to the signal lines f, a, and b, and $SW_2$ is conducted again after $SW_1$ becomes non-conducted, so as to accurately supply image signals to the signal lines c, d, and e. Here, particularly, the preliminary conduction start time of $SW_2$ is set to coincide with the normal conduction start time of $SW_1$.

The time for applying a signal to the normal voltage via the signal line switching element can also be increased by this method, and the same effects as that described in FIG. 1 and FIG. 21 can be obtained as to the problem of visible border. Further, unlike the method of FIG. 23, the foregoing method provides enough time from the end of preliminary conduction of $SW_2$ to the end of normal conduction of $SW_1$, thus effectively preventing the voltage drop and obtaining desirable charge characteristics.

In the case of multiple-block driving, instead of two-block driving, a period of selecting a previous block (polarity inverse period), by design, partially overlaps a period of selecting the subsequent block in the driving method of FIG. 23, and the period of selecting a previous block is preferably set to overlap the period of selecting the subsequent block also in FIG. 24, as in the foregoing case. For example, in FIG. 24, a pulse (high period) of $SW_1$ starting with $time_{t11}$ overlaps a pulse (high period) of $SW_2$ starting with $t_{12}$. This is due to the fact that the display state tends to be relatively similar between adjacent blocks and thus, in many cases, the voltage which has been subjected to polarity inversion is the same as the normally applied voltage, and therefore the influence of oscillation due to signal application to the subsequent block after the previous block became non-conducted tends to become less.

As described, the example as shown in FIG. 23 has a structure wherein the normal polarity inverse periods have an overlap time with respect to two blocks in which the times of applying the data signals are in succession. Another way of saying this, by defining the polarity inversion in terms of the normal polarity inversion and the preliminary polarity inversion as explained in the First Embodiment (see FIG. 2, FIG. 21, FIG. 24), is that the preliminary polarity inversion of a subsequent block (second block) is finished at the time when the normal polarity inversion of a certain block (first block) is finished, and continuously thereafter the normal polarity inversion of the second block is started.

Further, in the example of FIG. 24, the preliminary polarity inversion of the subsequent block (second block) is carried out in the vicinity of the time the normal polarity inversion of a certain block (first block) is started. Alternatively, the structure of FIG. 24 may be modified to have a structure wherein the start time of the preliminary polarity inversion of the second block is before the start time of the normal polarity inversion of the first block, or the end time of the preliminary polarity inversion of the second block is also before the start time of the normal polarity inversion of the first block. It is also possible to have an intermediate structure wherein, in FIG. 24, the start time of the preliminary polarity inversion of the second block is before the start time of the normal polarity inversion of the first block, and the end time of the preliminary polarity inversion of the second block is before the end time of the normal polarity inversion of the first block.

In each of the foregoing embodiments, in the case where the active-matrix substrate is used for a color display device, it is preferable that the correspondence of pixels with respect to the output terminals of the signal line driving circuit does not differ in color among blocks. This means that, for example, when pixel $A_1$ receives an image signal from the output line $s_3$ in the first block and pixel $E_1$ (not shown) receives the image signal from the output line $s_3$ in the second block in the two-block driving, both pixel $A_1$ and pixel $E_1$ display red (R). This is to increase, in the polarity inversion prior to the application of the normal image signal, the probability of having the same voltage as the normal apply voltage of the subsequent block when supplying a voltage of the line to the signal line. For example, in the case of displaying a monochromatic half-tone on the entire screen, since the border becomes highly visible in the conventional driving, there is strong need for effectively utilizing the structures of the present invention, and it is important not to have different colors among blocks.

The foregoing embodiments described the display device incorporating pixels, which uses the active-matrix substrate employing the data transfer method of the present invention, and, in particular, the liquid crystal display device which uses liquid crystal for the pixels. However, not limiting to this, the present invention is also applicable, for example, to detectors, for example, such as an X-ray sensor, which use the photoelectric effect.

[Fourth Embodiment]

Figure 25:
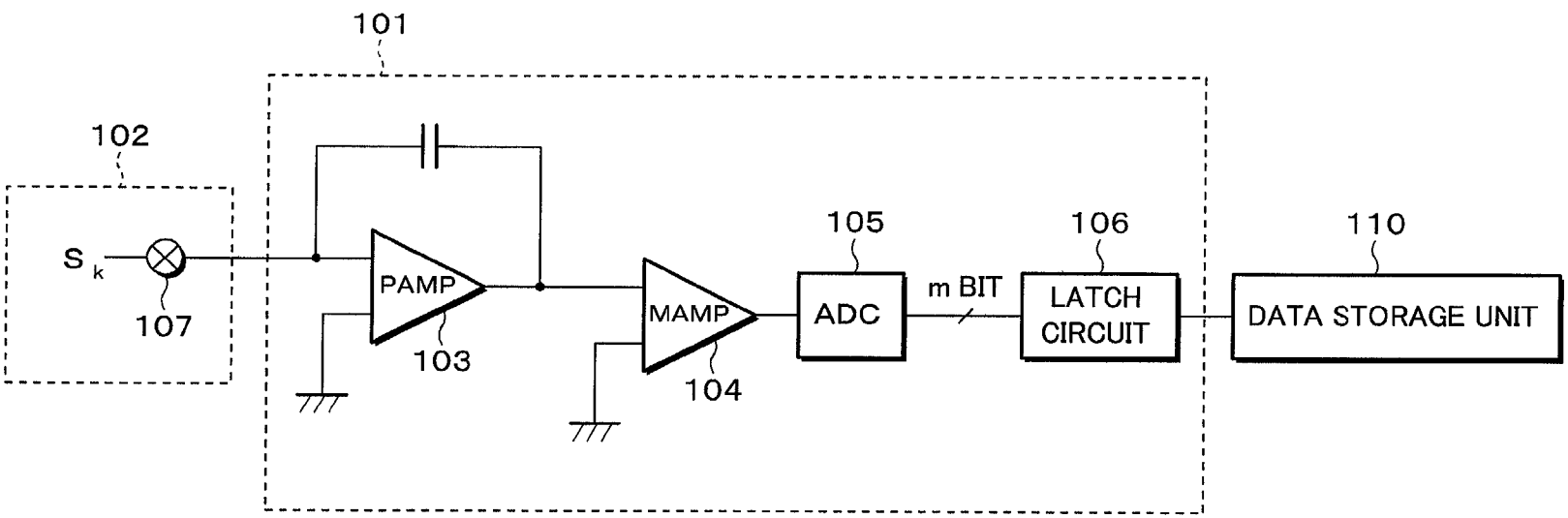
FIG. 25 is a block diagram showing a schematic exemplary structure of a photodetector.

The following will describe still another embodiment of the present invention referring to FIG. 25. Note that, elements having the same functions as those described in the drawings of the previous embodiments are given the same reference numerals and explanations thereof are omitted here.

The preset embodiment is a photodetector, such as an X-ray sensor, which employs the photoelectric effect. As shown in FIG. 25, a photodetector panel 102, a signal processing section (data transfer section) 101, and a data storage unit 110 are connected in this order.

Inside the photodetector panel 102 are provided signal lines $S_k$ (k=1, 2, . . . N) and scanning lines (not shown) which are formed in a matrix pattern as in the First Embodiment, and the signal lines are branched into a plurality of blocks (not shown) as in the First Embodiment. Where the pixels were provided in the First Embodiment are provided, instead of the pixels, photodetecting elements (not shown) which detect light such as X-rays and convert it to an electrical signal. The scanning lines are driven in the same manner as in the First Embodiment.

Inside the photodetector panel 102 where the signal line and the signal processing section 101 are connected is provided a panel switch 107 similar to the signal line switching element SWa of the First Embodiment. The panel switch 107 is controlled so as to sequentially select the blocks, as in the First Embodiment, by the control wire $SW_1$, etc. (not shown), of the First Embodiment. Note that, here, for convenience of explanation, only a single line and a single panel switch 107 are provided; however, in reality, a plurality of signal lines ($s_1$, $s_2$, . . . $s_N$) are connected to a single signal processing section 101 via their respective panel switches. Further, in reality, as with the sampling circuits of FIG. 5, FIG. 7, and FIG. 9, the signal processing section 101 is provided for the number of signal lines provided in a single block, and each signal processing section is connected to a signal line via the panel switch.

The signal processing section 101 therein includes a pre-amplifier (PAMP) 103 which carries out voltage conversion of electrical signals, a main amplifier (MAMP) 104 for amplifying the voltage, and an A/D convertor (ADC) 105 of m bits, and a latch circuit 106 for latching a digital signal of m bits, which are connected in this order.

In each line, when the scanning line is switched on and while the line is being selected (one horizontal period), the photodetecting element generates an electrical signal in accordance with the intensity of the received light. The electrical signal is then inputted to the signal processing section 101 through the signal line. The signal processing section 101 carries out voltage conversion of the electrical signal by the pre-amplifier 103, amplifies it in the main amplifier 104, and converts it to a digital signal by the D/A convertor 105, and after latching it by the latch circuit 106, outputs it to the data storage unit 110. The data storage unit 110 stores the input data.

In the foregoing structure, as described in the foregoing embodiments, each panel switch 107 is controlled, for example, in the manner as described in FIG. 2, FIG. 4, and FIG. 21 through FIG. 24, so as to switch the block. Conventionally, in an arbitrary single line, considering a block ("BL1" hereinafter) in which selection has been made and the electrical signal has been generated, and a block ("BL2" hereinafter) which generates and transfers the electrical signal on the signal line after BL1, there are cases where the voltage fluctuates between adjacent signal lines of the respective blocks BL1 and BL2. In contrast, with the structure of the present embodiment, such a fluctuation is prevented by the control as described in the foregoing embodiments, thereby preventing an error on the data which is outputted to the data storage unit 110.

Note that, the present invention may have the following arrangement. Namely, the present invention is a driving method of an active-matrix substrate which includes: a plurality of pixel electrodes which are formed on a substrate; pixel switching elements which are individually connected to the pixel electrodes; a plurality of scanning lines for driving the pixel switching elements; a plurality of signal lines which are connected to the pixel electrodes via the pixel switching elements; a plurality of signal line switching elements which are individually connected at one ends to the plurality of signal lines; a signal input section which is electrically connected to the other ends of the signal line switching elements; a signal line branching section provided between the signal input section and the switching elements; and control wires which are commonly connected per block to the plurality of signal line switching elements and for switching conduction/non-conduction of the signal line switching elements, wherein the potential supplied to the signal lines is inverted to the opposite polarity with respect to a reference potential per predetermined period, and the signal line switching elements of a certain block are conducted with respect to each predetermined period, prior to selecting the signal line switching elements of each block for supplying a desired display signal to the signal lines and the pixels, and the polarity of the voltage applied to the signal lines here is the same as that of the voltage which is supplied during the select period of the block in the predetermined period with respect to the reference voltage.

With this arrangement, since the signal lines are inverted in advance to the opposite polarity, it is possible to prevent the phenomenon in which a potential is applied to the pixels on the border while they are oscillated, which state is then maintained over the display period, thus relieving the drawback of different display states between the border and an area surrounding it, which is caused even when the potentials applied to the border and the surrounding area are the same.

Further, the foregoing arrangement may have an arrangement wherein, with respect to each predetermined period, the signal line switching elements of a plurality of blocks are conducted at the same time, prior to selecting the signal line switching elements of each block for supplying the desired display signal to the signal lines and the pixels.

With this arrangement, by the provision of a common potential inversion period, it is possible to save time which is required for the polarity inversion, even when driving multiple blocks.

Further, the foregoing arrangement may have an arrangement wherein, with respect to each predetermined period, the signal line switching elements of a certain block are conducted prior to selecting the signal line switching elements of each block for supplying the desired display signal to the signal lines and the pixels, and the display signal supplied here in advance to the signal lines corresponds to a half-tone.

With this arrangement, the foregoing effect can also be obtained when displaying white, half-tone, or monochromatic color, even though the effect is slightly reduced when displaying black. The foregoing structure and driving method are superior in preventing the border of the blocks from being recognized in a wide range of screens since the visibility on the display with respect to a small change in potential becomes most notable in half-tone.

Further, the present invention is a driving method of an active-matrix substrate which includes: a plurality of pixel electrodes which are formed on a substrate; pixel switching elements which are individually connected to the pixel electrodes; a plurality of scanning lines for driving the pixel switching elements; a plurality of signal lines which are connected to the pixel electrodes via the pixel switching elements; a plurality of signal line switching elements which are individually connected at one ends to the plurality of signal lines; a signal input section which is electrically connected to the other ends of the signal line switching elements; a signal line branching section provided between the signal input section and the switching elements; and control wires which are commonly connected per block to the plurality of signal line switching elements and for switching conduction/non-conduction of the signal line switching elements, wherein the potential supplied to the signal lines is inverted to the opposite polarity with respect to the reference potential per predetermined period, and the signal line switching elements of a certain block are conducted before the switching elements of an adjacent block which is selected prior to a horizontal period are switched at least to non-conduction.

With this arrangement, since the signal lines are inverted to the opposite polarity before the adjacent block becomes non-conducted, it is possible to prevent the phenomenon in which a potential is applied to the pixels on the border while they are oscillated, which state is then maintained over the display period, thus relieving the drawback of different display states between the border and an area surrounding it, which is caused even when the potentials applied to the border and the surrounding area are the same.

Further, the present invention is a driving method of an active-matrix substrate which includes: a plurality of pixel electrodes which are formed on a substrate; pixel switching elements which are individually connected to the pixel electrodes; a plurality of scanning lines for driving the pixel switching elements; a plurality of signal lines which are connected to the pixel electrodes via the pixel switching elements; a plurality of signal line switching elements which are individually connected at one ends to the plurality of signal lines; a signal input section which is electrically connected to the other ends of the signal line switching elements; a signal line branching section provided between the signal input section and the switching elements; and control wires which are commonly connected per block to the plurality of signal line switching elements and for switching conduction/non-conduction of the signal line switching elements, wherein the potential supplied to the signal lines is inverted to the opposite polarity with respect to the reference potential per predetermined period, and the signal line switching elements of a certain block are conducted at least once during a conduction state of the switching elements of the adjacent block which is selected in advance in the predetermined period.

With this arrangement, since the polarity inversion is carried out during the selection of the adjacent block, it is possible to prevent the phenomenon in which a potential is applied to the pixels on the border while they are oscillated, which state is then maintained over the display period, thus solving the problem of different display states at the border of the blocks. Also, the time required for the polarity inversion can be saved.

The image display device in accordance with the present invention may be arranged to have the active-matrix substrate which is driven by the foregoing methods. Also, the signal line driving circuit in accordance with the present invention is used for the signal line driving of the image display device having the active-matrix substrate which is driven by the foregoing methods, and may be arranged so that the lines of at least two groups are controlled by different control signals. Further, the signal line driving circuit in accordance with the present invention may have an arrangement wherein the control signal (group control signal) switches the sampling signal. That is, the sampling signal may be switched at the timing of the control signal. Further, the signal line driving circuit in accordance with the present invention may have an arrangement wherein the control signal (group control signal) is equivalent of a transfer signal or a latch signal. That is, data may be transferred or latched at the timing of the control signal.

Further, the data transfer method of the present invention, in addition to the foregoing arrangement, may have an arrangement wherein the signal lines of the plurality of blocks are simultaneously conducted within one horizontal period prior to the time the application of the data signal to the BL1 is finished.

According to this arrangement, the signal lines of the plurality of blocks are conducted prior to the time the application of the data signal to the BL1 is finished. In the case of AC driving, the potential of the signal lines of the plurality of blocks are inverted, prior to the application of the data signal to the BL1 is finished, to the opposite polarity with respect to the reference voltage.

Thus, even when driving multiple blocks, since the preliminary conduction period such as the preliminary polarity inversion is common to all blocks, the time required for the preliminary inversion does not become overly long as a whole, thus saving time for the normal conduction such as the normal polarity inversion. This allows the signal to be applied without congestion, thus improving the quality of data transfer process, in addition to the effect by the foregoing arrangement.

Further, the data transfer method of the present invention, in addition to the foregoing arrangement, may have an arrangement wherein, during the preliminary conduction of the BL2, a data signal having intermediate intensity between a maximum value and a minimum value of data signals which are applied to the signal lines is applied to the signal line BL2 which is being preliminarily conducted.

According to this arrangement, during the preliminary conduction of the BL2, a data signal having intermediate intensity between a maximum value and a minimum value of data signals which are applied to the signal lines is applied to the signal line BL2 which is being preliminarily conducted. For example, in the case of a display device, to the pixels as the data processing section are applied a halt-tone data signal which is an intermediate of the black display and the white display. As a result, the signal lines in the BL1 will not experience an abrupt potential drop by a small potential difference when the data signal is a half-tone. In general, for example, in the case of a display device, the visibility on a display with respect to a small potential difference becomes most notable when the data signal has an intermediate signal intensity (half-tone) between the maximum value and the minimum value. The foregoing arrangement can effectively prevent a difference in display state even when the difference becomes most notable as in this case. Thus, in addition to the effect by the foregoing arrangement, it is possible to relieve the drawback of different display states between the border and an area surrounding it, which is caused even when the potentials applied to the border and the surrounding area are the same.

Further, the data transfer method of the present invention, in addition to the foregoing arrangement, may have an arrangement wherein the preliminary conduction of the BL2 is carried out during the normal conduction period of the BL1 within one horizontal period.

According to this arrangement, the preliminary conduction of the BL2 is carried out during the normal conduction period of the BL1 within one horizontal period.

Thus, even when driving multiple blocks, since the preliminary conduction period such as the preliminary polarity inversion is common to all blocks, the time required for the preliminary conduction does not become overly long as a whole, thus saving time for the normal conduction such as the normal polarity inversion. This allows the signal to be applied without congestion, thus improving the quality of data transfer process, in addition to the effect by the foregoing arrangement.

Further, the data transfer method of the present invention, in addition to the foregoing arrangement, may have an arrangement wherein the preliminary conduction of the BL2 is finished at the time when the normal conduction of the BL1 is finished within one horizontal period, and normal conduction of the BL2 is carried out continuously thereafter.

According to this arrangement, the preliminary conduction of the BL2 is finished at the time when the normal conduction of the BL1 is finished within one horizontal period, and the normal conduction of the BL2 is carried out continuously thereafter. By this shift of the overlapping normal conduction periods of the respective blocks, the normal conduction period of the BL2 (ON period of each control wire) can be regarded as a conduction period which is composed of a preliminary conduction period which overlaps the normal conduction period of the BL1 and a normal conduction period after the normal conduction period of the BL1.

Therefore, in practice, this arrangement can be realized only by slightly changing the timing of signals for specifying the start and the end of the normal conduction period, and it is not required to newly create a signal for specifying the start and the end of the preliminary conduction period. As a result, in addition to the effect by the foregoing arrangement, the arrangement of the device for effecting the foregoing driving can be simplified.

Further, the data transfer method of the present invention, in addition to the foregoing arrangement, may have an arrangement wherein, with respect to at least one pair of the blocks respectively having signal lines which are adjacent to each other, when a block for which the application of the data signal is finished earlier is BL1, and when a block for which the application of the data signal is finished later is BL2, each of the sampling sections has a plurality of systems for storing the sampling data, and the sampling data of the block BL1 are respectively stored in one of the plurality of systems in each sampling section within a group GR1, and upon finishing the storage, another storage is started in another group with respect to next sampling data, and then the systems are switched in the group GR1 for the next storage to a system which does not currently store data, before storage of sampling data of the block BL2 is started in the group GR1.

With this arrangement, with respect to at least one pair of the blocks respectively having signal lines which are adjacent to each other, when a block for which the application of the data signal is finished earlier is BL1, and when a block for which the application of the data signal is finished later is BL2, each of the sampling sections has a plurality of systems for storing the sampling data, and the sampling data of the block BL1 are respectively stored in one of the plurality of systems in each sampling section within a group GR1, and upon finishing the storage, another storage is started in another group with respect to next sampling data, and then the systems are switched in the group GR1 for the next storage to a system which does not currently store data, before storage of sampling data of the block BL2 is started in the group GR1. The switching is made simultaneously per block.

For example, the sampling data are stored per group in one of the plurality of systems of the sampling section, and upon finishing the storage, the systems are switched simultaneously per block for the next storage to a system which does not currently store data, and the input data, which is inputted while a certain group was undergoing system switching, can be sampled in another group, for example, in a group which is not undergoing system switching at this time.

Also, for example, among the data signal for the block BL1, which is sampled before the block BL2, with respect to a single scanning line, the data signal which is sampled last is stored in system A of a certain group, and the first sampling data Db1 of the block BL2 is stored in another group GRa while the former group is being switched to system B. The sampling data which is stored in one system of a group can be outputted while storing sampling data in another system of the group. Alternatively, the output can be made during a period in which no system in the group is storing data.

Thus, even though the storage and output are switched between systems by providing plural systems with respect to each signal line within a block, the group which performs the storage process is switched to ensure sampling of the data signal in another group, thus surely preventing failure to pick up data. Therefore, in addition to the effect by the foregoing arrangement, data can be transferred faster with a simpler arrangement, thereby processing data at high speed.

The switching can be made by using and suitably outputting a group control signal which indicates the timing of the switching operation. Such a group control signal is the group control signal (system switching timing signal) which, by the provision of a plurality of systems (system A, system B, etc.) for storing data signals in each sampling section, indicates the timing of switching the system for storing the data signal to a blank system between the systems. The sampling signal is switched in this manner at the timing of the group control signal.

Further, the data transfer system of the present invention, in addition to the foregoing arrangement, may have an arrangement wherein when a group GR1 is one of the groups, the sampling data stored in the group GR1 are outputted after it was stored at least in the group GR1, and while storing sampling data in another group.

According to this arrangement, when a group GR1 is one of the groups, the sampling data stored in the group GR1 are outputted after it was stored at least in the group GR1, and while storing sampling data in another group.

Thus, even though the storage and output are switched between systems by providing plural systems with respect to each signal line within a block, the group which performs the storage process is switched to ensure sampling of the data signal in another group, thus surely preventing failure to pick up data. Therefore, in addition to the effect by the foregoing arrangement, data can be transferred faster with a simpler arrangement, thereby processing data at high speed.

For example, it is possible to have an arrangement wherein while sampling the data signal within a group, the signal which has been sampled in another group is transferred therefrom to the signal lines or latched, and a group control signal which specifies the timing of transfer or latching is outputted. For example, with respect to the data signals which are outputted to one of the blocks of the signal lines, those which are outputted at the same time are grouped, and, two of the groups, e.g., two groups which output data signals in consecutive order are denoted by GR1, having earlier output time, and GR2, having later output time, respectively, and the data signal can be subsequently outputted per block to one of the blocks of the signal lines by transferring or latching the signal which has been sampled in GR1 to the signal lines while sampling data signals in GR2.

The output can be carried out by using and suitably outputting a group control signal which indicates the timing of the output operation. For example, such a group control signal is the group control signal (output timing signal) which indicates the timing of outputting the stored sampling data by transferring or latching it while another group is undergoing input and storage operation of other sampling data. In this manner, the lines of at least two groups are independently controlled by different group control signals. That is, in group GR1, the timing of sampling and the timing of transfer or latching are specified by a group control signal (CNTa), and in group GR2, the timing of sampling of the timing of transfer or latching are specified by a group control signal (CNTb).

Further, the signal line driving circuit of the present invention, in addition to the foregoing arrangement, may have an arrangement wherein with respect to at least one pair of the blocks respectively having signal lines which are adjacent to each other, when a block for which the application of the data signal is finished earlier is BL1, and when a block for which the application of the data signal is finished later is BL2, each of the sampling sections has a plurality of systems for storing the sampling data, and the sampling data of the block BL1 are respectively stored in one of the plurality of systems in each sampling section within a group GR1, and upon finishing the storage, and before another storage is started in another group with respect to next sampling data, the signal line driving circuit generates a signal as the group control signal for specifying a timing of switching the systems in the group GR1 for the next storage to a system which does not currently store data, before storage of sampling data of the block BL2 is started in the group GR1.

According to this arrangement, with respect to at least one pair of the blocks respectively having signal lines which are adjacent to each other, when a block for which the application of the data signal is finished earlier is BL1, and when a block for which the application of the data signal is finished later is BL2, each of the sampling sections has a plurality of systems for storing the sampling data, and the sampling data of the block BL1 are respectively stored in one of the plurality of systems in each sampling section within a group GR1, and upon finishing the storage, and before another storage is started in another group with respect to next sampling data, the systems are switched in the group GR1 for the next storage to a system which does not currently store data, before storage of sampling data of the block BL2 is started in the group GR1. The switching is made simultaneously per block.

Thus, even though the storage and output are switched between systems by providing plural systems with respect to each signal line within a block, the group which performs the storage process is switched to ensure sampling of the data signal in another group, thus surely preventing failure to pick up data. Therefore, in addition to the effect by the foregoing arrangement, data can be transferred faster with a simpler arrangement, thereby processing data at high speed.

Further, the data signal line driving circuit of the present invention, in addition to the foregoing arrangement, may have an arrangement wherein when a group GR1 is one of the groups, the signal line driving circuit generates a signal as the group control signal for specifying a timing of outputting the sampling data stored in the group GR1, after it was stored at least in the group GR1, and while storing sampling data in another group.

According to this arrangement, when a group GR1 is one of the groups, the sampling data stored in the group GR1 is outputted after it was stored at least in the group GR1, and while storing sampling data in another group.

Thus, it is not required to switch the storage and output between the systems by providing plural systems with respect to each signal line within a block, and it is not required to provide time for switching. Therefore, in addition to the effect by the foregoing arrangement, data can be transferred faster with a simpler arrangement, thereby processing data at high speed.

[Fifth Embodiment]

Figure 26:
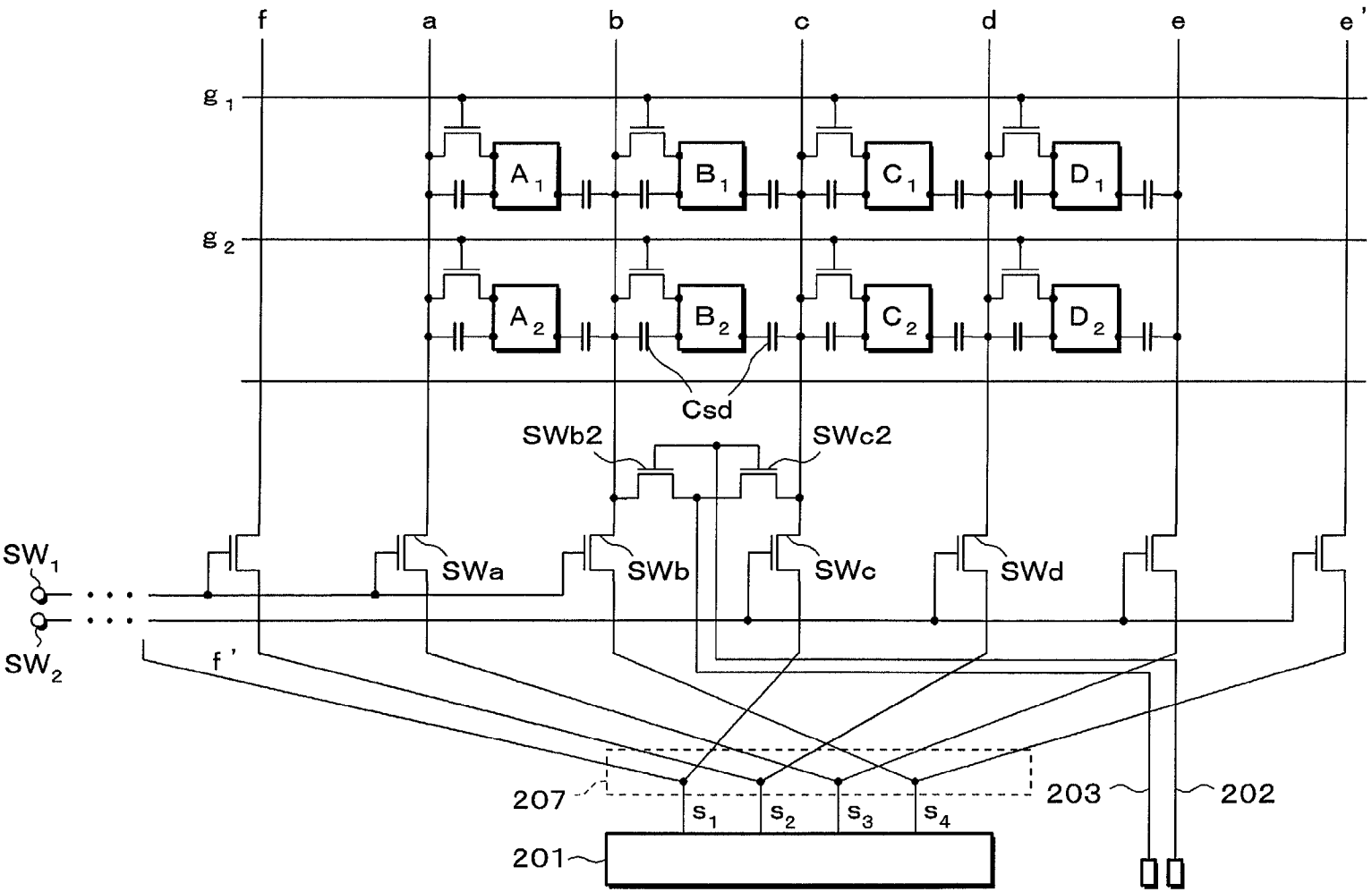
FIG. 26 is an explanatory drawing showing an exemplary structure of an equivalent circuit of the active-matrix substrate.
Figure 27:
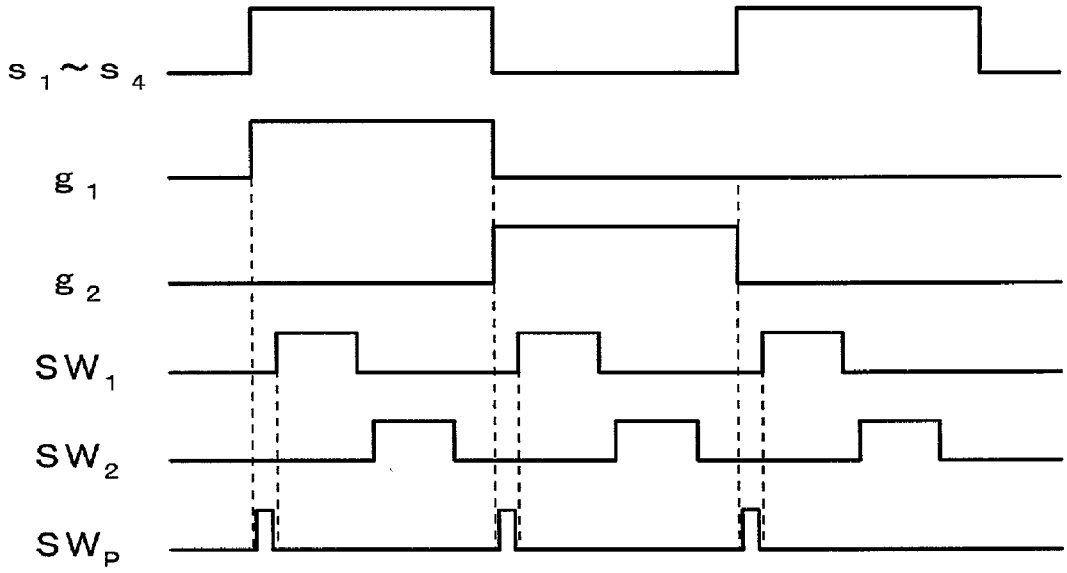
FIG. 27 is an explanatory drawing showing a timing chart of driving employing the active-matrix substrate.

The following will describe yet another embodiment of the present invention based on FIG. 26 and FIG. 27.

An active-matrix substrate in accordance with the present embodiment includes scanning lines, signal lines, and pixel electrodes, and makes up a liquid crystal display device as a display device which is driven by the active-matrix mode for display, which is particularly effective in preventing lowering of display quality due to potential oscillation. The following describes its equivalent circuit with reference to FIG. 26.

The pixel electrodes have their respective pixels $A_1$, $B_1$, . . . as a data processing section, and are connected to pixel switching elements such as TFTs (thin film transistor) (not shown). The pixels are made up of liquid crystal, which makes up a liquid crystal panel, which, in turn, makes up a liquid crystal display device for displaying an image by the liquid crystal panel. Note that, in reality, there are many other signal lines and other elements corresponding thereto, other than those shown in the drawings, which, however, are omitted here for convenience of explanation, and only eight signal lines f', f, a, b, c, d, e, e', and two scanning lines $g_1$ and $g_2$ are shown.

The signal lines f', f, a, b makes up a single block ("first block" hereinafter), and the signal lines c, d, e, e' makes up another block ("second block" hereinafter). Even though the following explanation of the present embodiment will be based on structures of these two blocks as with the conventional example, the explanation also applies to larger numbers of blocks.

As shown in FIG. 26, to respective ends of the signal lines f', f, a, b, c, d, e, e' are provided signal line switching elements (SWa, SWb, SWc, SWd, etc.), and the other ends of these switching elements are electrically connected to a signal line driving circuit (driver IC) 201 as a signal input section for installing an external circuit, and between the signal line driving circuit 201 and the signal line switching elements is provided a signal line branching section 207. The signal line switching elements may be realized by CMOS transistors, or, alternatively, NMOS transistors in some cases. The signal line branching section 207 can be structured by branching wires.

The signal line switching elements are electrically connected to output lines $s_1$, $s_2$, $s_3$, $s_4$, which extend from output terminals of the signal line driving circuit 201. To control ends of the switching element SWa and other switching elements are connected control wires $SW_1$ and $SW_2$ for switching conduction/non-conduction of the signal line switching elements, commonly to each of the plurality of blocks, and by this switching, an image signal (data signal) from the signal line driving circuit 201 is supplied as a display signal in a time sharing manner to the signal lines.

That is, the signal lines or scanning lines are divided into blocks, and the blocks to which the signal is destined are switched in a time sharing manner so that the data signal or scanning signal is sequentially applied to each block, by dividing a period during which a scanning line is selected (one select period of a scanning line, one horizontal period) in the case of the signal line, or by dividing one vertical period in the case of the scanning line, with respect to time. In the present embodiment, the signal lines are divided into blocks, and the blocks to which the signal is destined are switched in time by dividing one select period of the scanning line with respect to time so that the data signal is sequentially applied to each block. In the case of dividing the scanning lines into blocks, the blocks to which the signal is destined are switched in time by dividing one vertical period with respect to time so that the scanning signal is sequentially applied to each block.

The signal line driving circuit 201 which carries out the foregoing block-driving has n sampling circuits (not shown). When the number of blocks is two as in the foregoing case, the number of signal lines is given by their product, 2n.

The signal line driving circuit 201 creates therein n sampling pulses by the shift resistors, which are then supplied sequentially to their respective n sampling circuits. The data signals are inputted, in response to the sequential inputs of n sampling pulses to the signal line driving circuit 201, to their respective n sampling circuits at the timings of the sampling pulses, respectively, and are held therein.

These data signals are outputted, via the signal line branching section 207, from their respective sampling circuits, to one ends of all signal line switching elements which are connected to the signal lines, at the timings indicated by predetermined control signals. They are, for example, data signals for the first block.

Simultaneously, the data signals which are sent during the foregoing operation are inputted to the n sampling circuits, respectively, at the timings of new sampling pulses which are created by the shift resistors, and are held therein. These data signals are outputted, via the signal line branching circuit 207, from the sampling circuits, to one ends of all signal line switching elements which are connected to the signal lines, at the next predetermined timings. They are, for example, data signals for the second block.

The data signals outputted from the signal line driving circuit 201 are allowed to pass the signal line switching elements (e.g., SWa) only in an ON (high) period of the pulse of a conduction signal of the control wire $SW_1$ or $SW_2$, so as to be supplied to their corresponding signal lines. Thus, within one horizontal period, as shown in FIG. 27, the data signals are supplied only to the first block (block including signal line b) by switching ON only the control wire $SW_1$, and thereafter the data signals are supplied to the second block (block including signal line c) by switching on only the control wire $SW_2$. The block driving of signal lines is carried out in this manner.

The conduction signals (pulses) which are supplied from the control wires to the signal line switching elements, by being supplied to the control wires $SW_1$ and $SW_2$ are supplied as follows, for example. That is, a PLL (phase-locked loop) oscillator generates a clock CLK. The clock CLK and the horizontal synchronize signal HSY which is synchronized with the image signal are counted by a horizontal counter, and a pulse is created by each decoder based on the value of the counter. Each decoder is set to have a predetermined value beforehand, and outputs the pulse according to the predetermined value. The predetermined value is decided and optimized beforehand with respect to individual parameters of each pixel or SWa, such as $s_1$ and $g_1$.

FIG. 27 shows how the signal lines are driven in the present embodiment. In FIG. 27, $SW_P$ is a driving waveform of an auxiliary control wire 202. In the present embodiment, the data signal is inverted with respect to frame and line, which in also the case in the following embodiments. What is different from FIG. 1 is that to the signal lines b and c, which correspond to the border of the blocks, are connected auxiliary signal line switching elements SWb2 and SWc2 which are controlled by another control wire, i.e., the auxiliary control wire 202, parallel to the normal signal line switching elements SWb and SWc. The auxiliary control wire 202 is selected prior to the timing of supplying the normal data signal (display signal) to the signal lines. Here, to the inverse signal line 203 (auxiliary inverse data supply line) is supplied in advance a signal having the opposite polarity to that of the signal of the previous frame. This allows the polarity of the signal line to be inverted in advance as preliminary polarity inversion, thereby solving the foregoing problem that the border becomes visible by the oscillation of the signal line on the edge of a preceding block by the polarity inversion at the time of selecting the subsequent block.

Note that, the auxiliary control wire 202 can also be driven by a circuit structure similar to that employing the control wires $SW_1$ and $SW_2$. Also, the signal supplied from the inverse signal line 203 may be an original signal ($V_{ref}$) used for the polarity inversion for deciding the output polarity, which is the original signal of that applied to the signal lines in the signal line driving circuit, or a signal having a waveform which is created by increasing or decreasing the voltage value of the original signal.

To explain the preliminary polarity inversion period in more detail, the start time and end time of the normal polarity inversion period for supplying the data signal on the signal line b will be denoted by Sb and Eb, respectively. Similarly, the start time and end time of the normal polarity inversion period for supplying the data signal on the signal line c will be denoted by Sc and Ec, respectively. Further, the start time and end time of the preliminary polarity inversion period on the signal line b, prior to the normal polarity inversion period for supplying the data signal will be denoted by Sbp and Ebp, respectively. Similarly, the start time and end time of the preliminary polarity inversion period on the signal line c, prior to the normal polarity inversion period for supplying the data signal will be denoted by Scp and Ecp, respectively. Note that, the foregoing definitions also apply to the following embodiments.

Here, in the present embodiment, since the auxiliary control wire 202 is common to the signal lines b and c, Ebp=Ecp. Further, since the inverse signal line 203 is also common, the preliminary polarity inverse signal for the preliminary polarity inversion on the signal line c is also supplied to the signal line b from the inverse signal line 203. Therefore, in order to desirably carry out the normal polarity inversion of the signal line b, it is required to avoid overlap of input times, and thus $Ebp \leqq Sb$, which can be expressed as $Ecp=Ebp \leqq Sb$.

To explain it in more detail, since the potential which is given to the signal lines at the normal timing is different from that applied from the inverse signal line 203, there are cases where the signal line on the edge of the preceding block experiences oscillation which is in accordance with the potential difference. However, the potential difference is sufficiently small compared with the polarity inversion of the display signal, and it usually does not become visible. In case where this becomes a problem, an inverse signal which is equivalent to a half-tone is supplied to the inverse signal line 203, so as to prevent oscillation as much as possible in the half-tone where visibility becomes most prominent.

Further, the foregoing effect can also be realized in a display device having a function of inverting the left side and right side of the image by the provision of the preliminary auxiliary signal line switching elements on the both signal lines (signal lines b and c) at the border, i.e., in a structure wherein scanning of image data is started in either left-to-right and right-to-left directions, i.e., when the order of selecting SW1 and SW2 is switched. In the connection as shown in FIG. 26, the auxiliary control wire 202 and the inverse signal line 203 are common to SWb2 and SWc2, thus efficiently using the wiring area.

Incidentally, for the purpose of obtaining only the foregoing effect, the inverse signal may be supplied by driving the entire normal control lines and signal lines in advance, instead of providing additional signal line switching elements.

In contrast, in the structure according to the present embodiment, the preliminary inversion is carried out by a signal which is different from the normal polarity inverse signal, thus suppressing increase in power consumption by the polarity inversion of all lines. Further, the driver IC as the signal line driving circuit 1 does not need to have a high driving capability, which is an advantage of the structure according to the present embodiment. Further, as described, since the inverse signal line 203 can have the original signal ($V_{ref}$) of the polarity inversion for deciding the polarity of the output from the signal line driving circuit 201, it is not required to additionally create an inverse signal. Further, in the case where a predetermined inverse signal, which is not a completely inverted black signal, is needed, it is effective to supply a signal which is intended for the counter electrode, or to fix it to ground potential.

Note that, in the case where there are provided three or more blocks, the other auxiliary control wires 202 and inverse signals 203 at the borders of the respective blocks may be connected inside or outside of the panel, or the signal input section of the panel may be provided at only one location.

[Sixth Embodiment]

Figure 28:
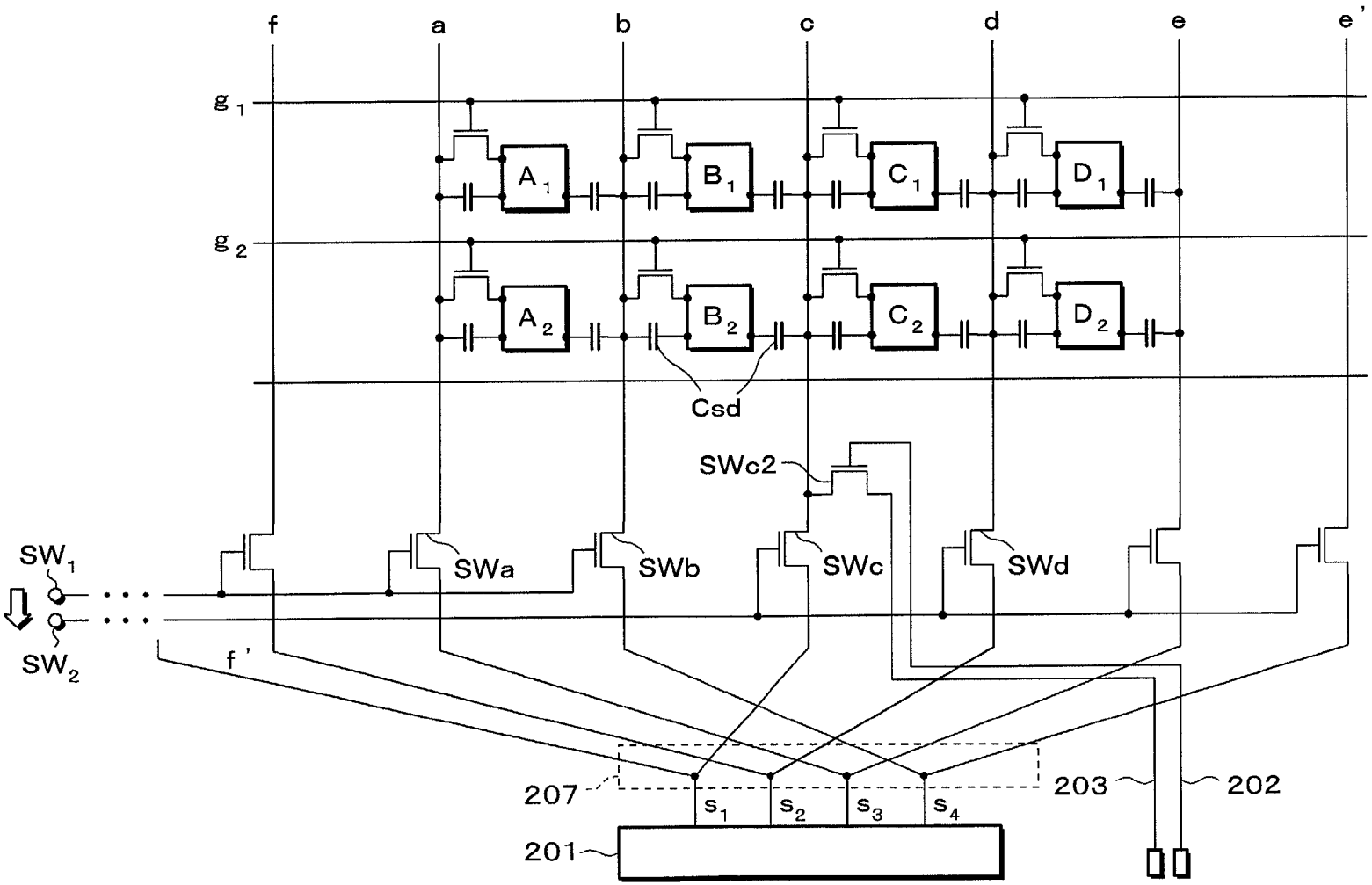
FIG. 28 is an explanatory drawing showing an exemplary structure of an equivalent circuit of the active-matrix substrate.
Figure 29:
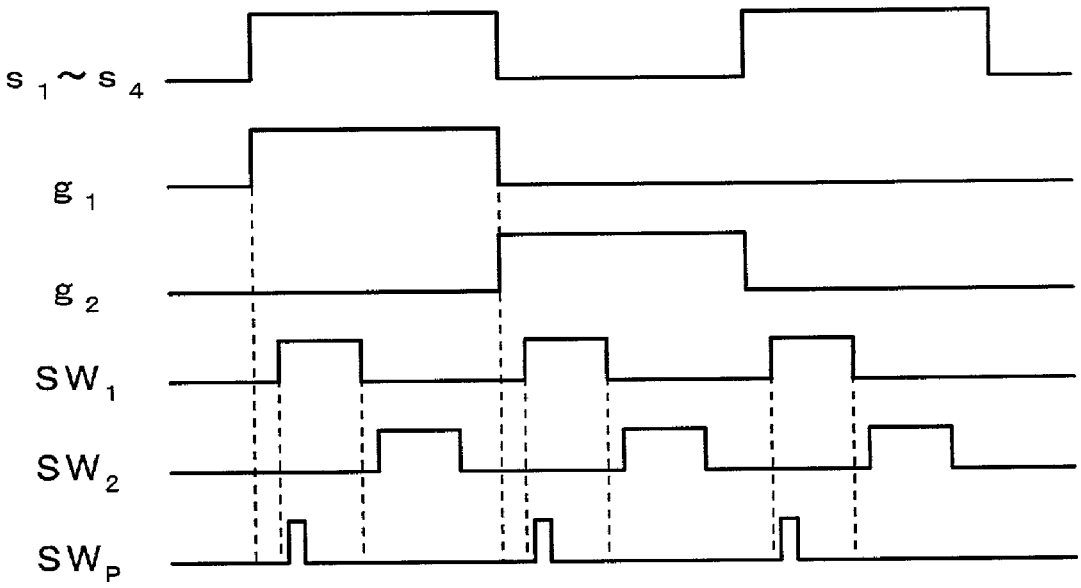
FIG. 29 is an explanatory drawing of a timing chart of driving employing the active-matrix substrate of FIG. 28.

The following will describe still another embodiment of the present embodiment referring to FIG. 28 and FIG. 29. Note that, for convenience of explanation, elements having the same functions as those described in the drawings of the foregoing embodiments are given the same reference numerals and explanations thereof are omitted here.

In the present embodiment, as shown in FIG. 28 which illustrates an equivalent circuit, in the signal lines b and c, an auxiliary signal line switching element SWc2, which is controlled by an auxiliary control wire 202, is connected, parallel to the normal signal line switching element SWc2, only to the signal line c to which the normal display signal is supplied later with respect to the time the normal display signal is supplied. The auxiliary control wire 202, which is another control wire, is selected prior to the timing of supplying the normal display signal to the signal line. Here, to the inverse signal line 203 is supplied a signal having the opposite polarity to the signal of the previous frame.

FIG. 29 shows how signal lines are driven in the present embodiment. In FIG. 29, $SW_P$ is a driving waveform of the auxiliary control wire 202. In the structure of the present embodiment, unlike the Fifth Embodiment, the inverse signal may be supplied from SWc2 by selecting the auxiliary control wire 202 during the time of normal application to the first block. In this way, it is not required to take a certain time period for supplying the polarity inverse signal, thus maximizing the normal signal supply period in each block. Even when the selection is made simultaneously, since the inverse signal is supplied from the inverse signal line 203, which is different from the signal line driving circuit 201, and since the signal lines b and c are electrically separated from each other, there will be no adverse effect on the output of the signal line driving circuit 201, or on the normal application which is carried out via the signal line b.

That is, in the present embodiment, the auxiliary control wire 202 and the inverse signal line 203 are not connected to the signal line b but only to the signal line c. Therefore, the preliminary polarity inverse period of the signal line c may overlap the normal polarity inverse period of the signal line b. The polarity inversion is carried out under the condition where the normal polarity inverse period of the signal line b completely or partially exists, after the signal b is oscillated by the preliminary polarity inversion of the signal line c. Thus, in the present embodiment, Ecp<Eb.

[Seventh Embodiment]

Figure 30:
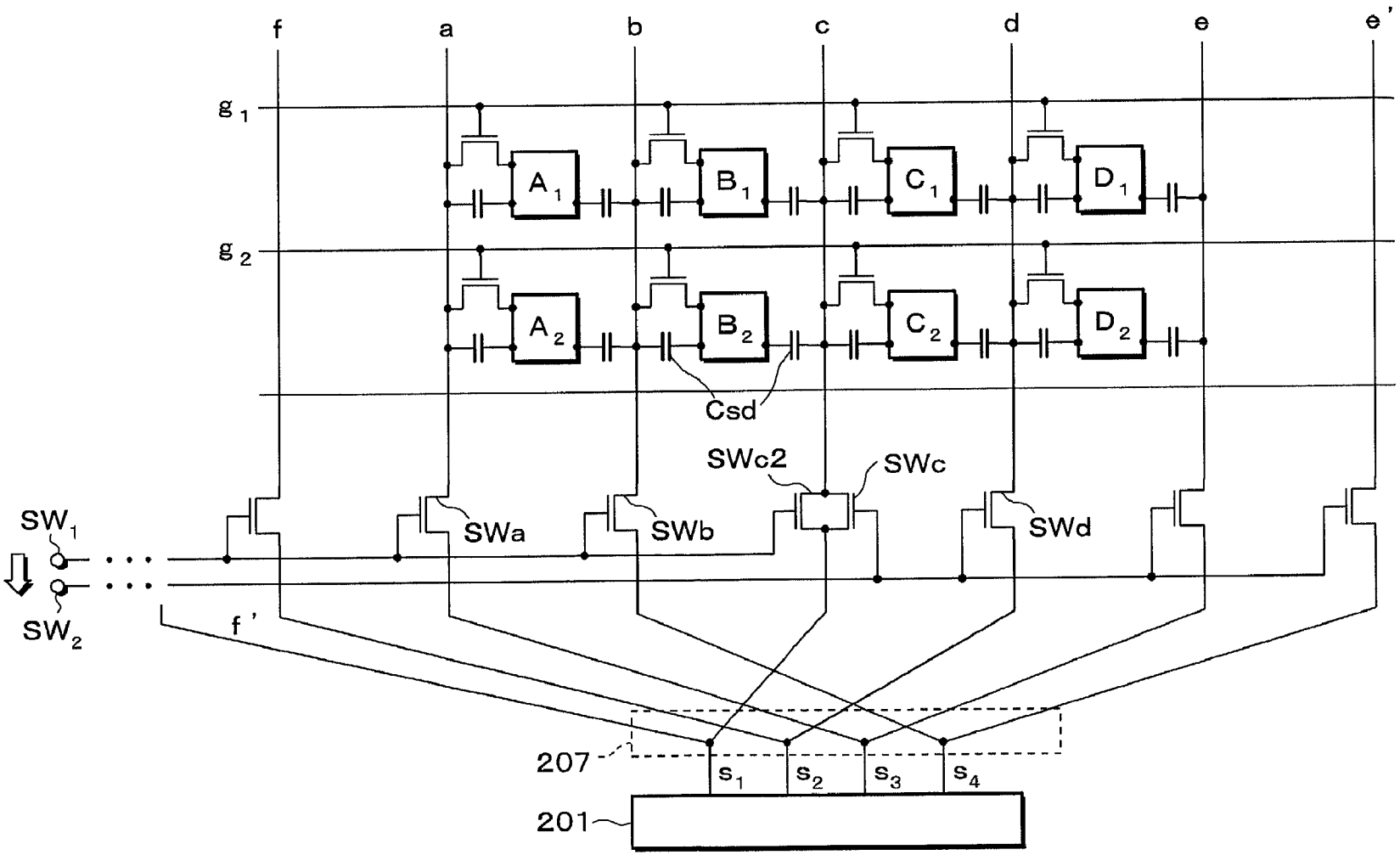
FIG. 30 is an explanatory drawing showing an exemplary structure of an equivalent circuit of the active-matrix substrate.

The following will describe yet another embodiment of the present invention with reference to FIG. 30. Note that, the convenience of explanation, elements having the same reference numerals as those described in the drawings of the previous embodiments are given the same reference numerals and explanations thereof are omitted here.

In the present embodiment, as shown in FIG. 30 illustrating an equivalent circuit, in the block which is selected later, an auxiliary signal line switching element SWc2 is connected, parallel to the normal signal line switching element SWc, to the signal line c which corresponds to the border. These two switching elements SWc2 and SWc have common input and output, and an auxiliary control wire of the SWc2 is connected to the control wire $SW_1$ of the first block. The SWc2 is conducted in the select period of the first block, prior to the timing of supplying the normal data signal to the signal line, and, at this time, the output $s_1$ from the signal line driving circuit 201 (driver IC) has already been supplied with a signal having the opposite polarity to that of a signal of the previous frame, thus preventing blackening of the signal wire c, as with the foregoing case.

The structure according to the present embodiment does not require the inverse signal line 203, the auxiliary control wire 202, and the signal input section for the signal line switching element SWc2, thus making area designing easier and simplifying the structure. Further, it is not required to additionally create a signal for the preliminary polarity inversion.

Here, the SWc2 is designed to be smaller than SWc. The auxiliary signal line switching element SWc2 for carrying out the polarity inversion in advance does not need to have a driving capability for bringing in sufficient charge, and it is only required to cause polarity inversion to some degree. That is, the SWc2 does not need to be designed to be as large as the normal signal line switching element SWc. This allows easy spatial arrangement even in the present embodiment wherein two signal line switching elements need to be provided for a single signal line. Further, since the polarity inversion side has a high-resistance connection while the side of normal application has a low-resistance connection, the normal side can receive the output signal from the signal line driving circuit 201 without being affected, even when a noise enters the signal line on the polarity inversion side, thus improving display stability.

Further, as to the load on the side of the signal line driving circuit 201, it is multiplied when the connection is made by the same line switching element, and since the polarity is inverted, the driver is susceptible to oscillation, which, depending on the driving capability of the signal line driving circuit 201, may cause improper output, or malfunction of the signal line driving circuit 201 due to latch-up. In the structure of the present embodiment, however, the apparent load on the signal line driving circuit at the same moment is smaller than the foregoing case, thus solving the foregoing problems.

The present embodiment also has the driving waveform as shown in FIG. 29, Ecp<Eb, as in the Sixth Embodiment.

[Eighth Embodiment]

Figure 31:
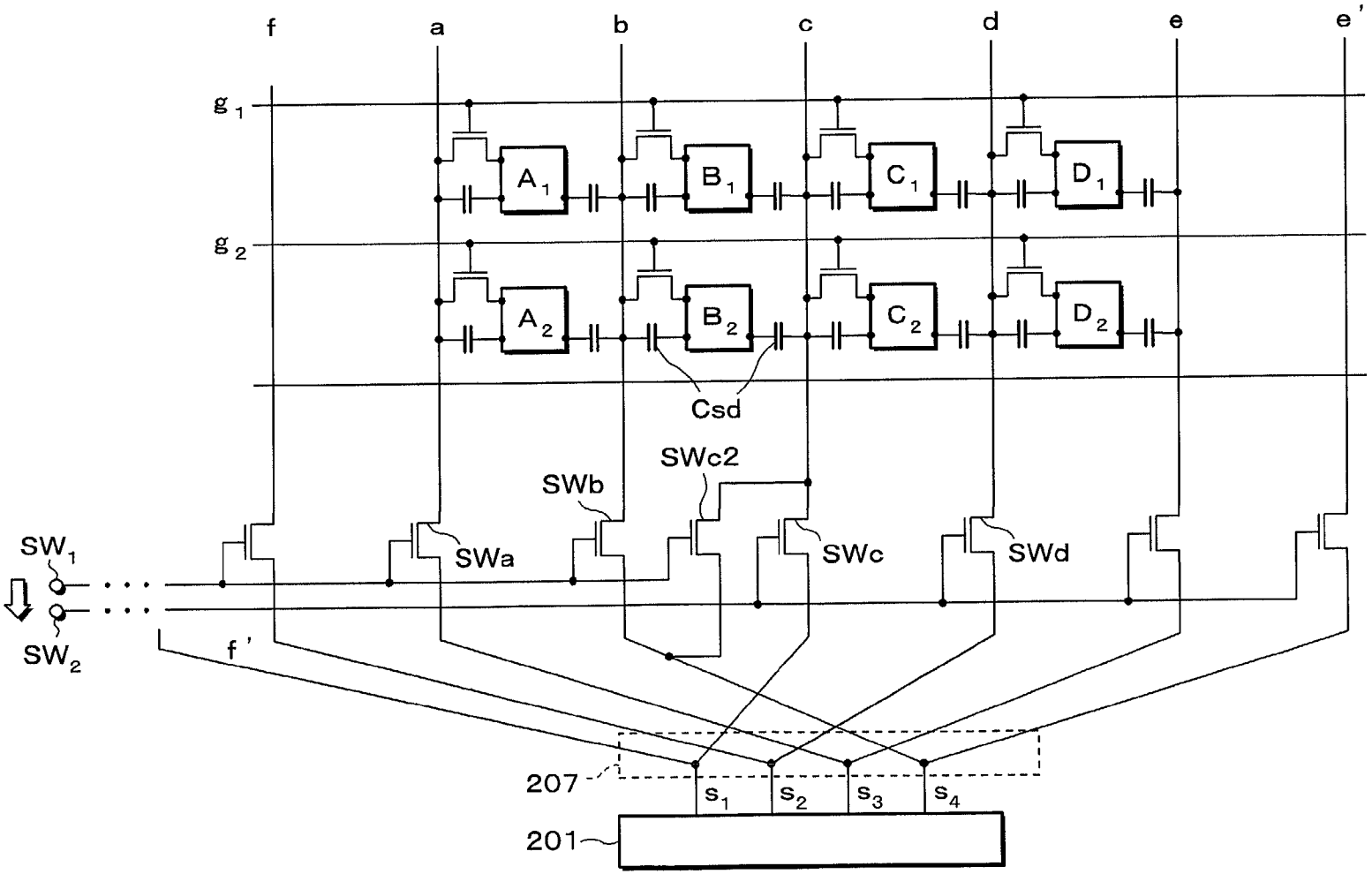
FIG. 31 is an explanatory drawing showing an exemplary structure of an equivalent circuit of the active-matrix substrate.

The following will describe still another embodiment of the present embodiment with reference to FIG. 31. Note that, for convenience of explanation, elements having the same functions as those described in the drawings of the foregoing embodiments are given the same reference numerals and explanations thereof are omitted here.

In the present embodiment, as shown in FIG. 31 illustrating an equivalent circuit, in the block which is selected later, to the signal line c which corresponds to the border is connected, parallel to the normal signal line switching element SWc, a signal line switching element SWc2 whose control wire is connected to the control wire $SW_1$ of the first block, and the input of the signal line switching element SWc2 on the side of the signal line driving circuit 201 (driver IC) is connected to the output $s_4$ of the signal line driving circuit 201, which is the input of the adjacent signal line b of the adjacent block. Because the signal level supplied to invert the polarity of the signal line c in advance is the normal display signal of the signal line b of the adjacent block, the signal level is often the same as or similar to the normal display signal of the signal line c, thus suppressing the problem of black line. Even when it occurs, it is when signals are different between adjacent lines, i.e., when the display state is changed at the border, and thus the black line is hardly recognized and causes no problem.

However, in the case of a display device which is compatible with color display, the adjacent signal line b generally corresponds to a pixel having a different color from that of the signal line c, and in this case the signal levels are not necessarily similar to each other between the adjacent lines. Thus, the input side of the auxiliary signal line switching element SWc2 is connected to a signal line which corresponds to a pixel having the same color as that of the pixel corresponding to the signal line c, and which is closest to the signal line c of the adjacent block. With this structure, because the signal level which is supplied to invert the polarity in advance is the normal display signal of the adjacent signal line of the same color, the signal level is more likely to the same as or similar to the normal display signal of the adjacent signal line, thus preventing the problem of black line. Even when it occurs, it is when signals are different between adjacent lines, i.e., when the display state is changed at the border, and thus the black line is hardly recognized and causes no problem.

The present embodiment also has the driving waveform as shown in FIG. 29, Ecp<Eb, as in the Sixth Embodiment.

Note that, the active-matrix substrate in accordance with the present invention may have an arrangement which includes: a plurality of pixel electrodes which are formed on a substrate; pixel switching elements which are individually connected to the pixel electrodes; a plurality of scanning lines for driving the pixel switching elements; a plurality of signal lines which are connected to the pixel electrodes via the pixel switching elements; a plurality of signal line switching elements which are individually connected at one ends to the plurality of signal lines; a signal input section which is electrically connected to the other ends of the signal line switching elements; a signal line branching section provided between the signal input section and the signal line switching elements; and control wires which are commonly connected per block to the plurality of signal line switching elements and for switching conduction/non-conduction of the signal line switching elements, wherein a signal line on the border between a certain block and an adjacent block is connected to a signal line switching element which is controlled by the control wire of its block ("target block"), and also to a signal line switching element which is controlled by another control wire.

Further, the active-matrix substrate in accordance with the present invention, in the foregoing arrangement, may have an arrangement wherein a signal line on the border which belongs to such a target block that the control wire of the adjacent block receives a conduction signal earlier than the control wire of the target block in one horizontal period is connected to the signal line switching element which is controlled by the control wire of the target block, and to a signal line switching element which is controlled by another control wire.

Further, the active-matrix substrate in accordance with the present invention, in the foregoing arrangement, may have an arrangement wherein the another control wire is the control wire of another block which receives the conduction signal earlier than the control wire of the target block within one horizontal period.

Further, the active-matrix substrate in accordance with the present invention, in the foregoing arrangement, may have an arrangement wherein the another control wire is the control wire of the adjacent block which receives the conduction signal earlier than the control wire of the target block within one horizontal period.

Further, the active-matrix substrate in accordance with the present invention, in the foregoing arrangement, may have an arrangement wherein the other end of the another signal line switching element is electrically connected to a single signal input section to which the other end of the signal line switching element which is controlled by the control wire of the target block is connected.

Further, the active-matrix substrate in accordance with the present invention, in the foregoing arrangement, may have an arrangement wherein the other end of the another signal line switching element is electrically connected to a single signal input section to which the other end of the signal line switching element which is connected to an adjacent signal line in an adjacent block is connected.

Further, the active-matrix substrate in accordance with the present invention, in the foregoing arrangement, may have an arrangement wherein the other end of the another signal line switching element is electrically connected to a single signal input section to which the other end of a signal line switching element which supplies a signal to a pixel for displaying the same color as that of the pixel electrode connected to the signal line and which is connected to another signal line of an adjacent block closest to the signal line is connected.

Further, the active-matrix substrate in accordance with the present invention, in the foregoing arrangement, may have an arrangement wherein the resistance of the signal line switching element is lower than that of the another signal line switching element during conduction.

Further, the active-matrix substrate in accordance with the present invention, in the foregoing arrangement, may have an arrangement wherein respective signal lines of the at least two adjacent blocks on the border between these blocks are supplied with the same preliminary polarity inverse signal via their respective auxiliary signal line switching elements, and the supply of the preliminary polarity inverse signal is finished within one horizontal period before the supply of the data signal to the signal line which receives the data signal earlier is started.

According to this arrangement, for example, by the auxiliary inversion data supply line, etc., which is connected to the both signal lines on the border, the same preliminary polarity inverse signal is supplied to the both signal lines on the border, and the supply of the preliminary polarity inverse signal is finished within one horizontal period before the start of the supply of the data signal to the block to which the data signal is supplied earlier in the adjacent blocks. Thus, in the case where the display device has the function of inverting an image either from the left-to-right and right-to-left directions, i.e., when the order of selecting the control wires is switched by the bi-directional scanning of image data, there will be no overlap of the polarity inversion period by the supply of the data and the preliminary polarity inversion period. Thus, in addition to the effect by the foregoing arrangement, in the case where the display device has the function of inverting an image either from the left-to-right and right-to-left directions, i.e., when the order of selecting the control wires is switched by the bi-directional scanning of image data, it is possible to relieve the drawback of different display states between the border and an area surrounding it, which is caused even when the potentials applied to the border and the surrounding area are the same.

Further, by this connection, since the auxiliary control wire and the line (auxiliary inversion data supply line) for supplying and the preliminary polarity inverse signal are common, the wiring area can be used efficiently.

Further, the active-matrix substrate in accordance with the present invention, in the foregoing arrangement, may have an arrangement wherein the auxiliary control wire is a control wire of another block which receives a conduction signal earlier than the control wire of the target block within one horizontal period.

According to this arrangement, the auxiliary control wire is the control wire of another block which is supplied with a conduction signal earlier than the control wire of the target block within one horizontal period. The control wire can also function as the auxiliary control wire. Thus, in addition to the effect by the foregoing arrangement, it is not required to create a special control signal outside and to supply it to another signal line switching element, thus solving the problem of complex external circuit and the problem of layout of the control wires due to the creation of such a control signal.

Further, the active-matrix substrate in accordance with the present invention, in the foregoing arrangement, may have an arrangement wherein the auxiliary control wire is the control wire of the adjacent block which receives the conduction signal earlier than the control wire of the target block within one horizontal period.

According to this arrangement, the auxiliary control wire is the control wire of the other block which is supplied with a conduction signal earlier than the control signal of the target block within one horizontal period. Thus, the auxiliary control wire can also function as the control wire of the adjacent block. Therefore, in addition to the effect by the foregoing arrangement, the control wire of another signal line switching element can be provided by only extending the control wire of the adjacent block by a small distance, thus making the disposition of the patterning easier.

Further, the active-matrix substrate in accordance with the present invention, in the foregoing arrangement, may have an arrangement wherein one of terminals of the auxiliary signal line switching element which is not connected to a signal line is electrically connected to a signal input section to which one of terminals of a signal line switching element which is controlled by the control wire of the target block, which is not connected to a signal line, is connected.

According to this arrangement, one of terminals of the auxiliary signal line switching element which is not connected to the signal line is electrically connected to a signal input section to which one of terminals of a signal line switching element, which is controlled by the control wire of the target block, which is not connected to the signal line is connected. In other words, the supply source (auxiliary inversion data supply line) of the preliminary polarity inverse signal for the auxiliary signal line switching element is the signal input section which is connected to the signal line switching element which is connected to the signal line of the adjacent block. Thus, the data signal which is inputted from the signal input section to the adjacent block can also function as the preliminary polarity inverse signal of the target block. Therefore, in addition to the effect by the foregoing arrangement, it is not required to provide a signal input section to the other terminal of the other signal line switching element, thus simplifying the structure.

Further, since it is only required to additionally connect the control wire by connecting the input and output of the signal line switching element in parallel, it can be easily provided in terms of a space.

Further, since the signal input section is being supplied with a signal of another block and has already been inverted to the opposite polarity, it is not required to additionally create the polarity inverse signal, for example, by additionally providing it, and the number elements required for the signal input can be reduced.

Further, the active-matrix substrate in accordance with the present invention, in the foregoing arrangement, may have an arrangement wherein one of terminals of the auxiliary signal line switching element which is not connected to a target signal line is electrically connected to a signal input section to which one of terminals of a signal line switching element which is connected to a signal line, in an adjacent block, adjacent to the target signal line, which is not connected to a signal line, is connected.

According to this arrangement, one of terminals of the auxiliary signal line switching element which is not connected to a target signal line is electrically connected to a signal input section to which one of terminals of a signal line switching element which is connected to a signal line, in an adjacent block, adjacent to the target signal line, which is not connected to a signal line, is connected. In other words, the supply source (auxiliary inversion data supply line) of the preliminary polarity inverse signal for the auxiliary signal line switching element is the signal input section connected to the signal line switching element which is connected to an adjacent signal line in an adjacent block. Thus, the data signal which is inputted from the signal input section to the adjacent block can have the function of the preliminary polarity inverse signal of the target block. Therefore, in addition to the effect by the foregoing arrangement, since the signal level which is supplied in advance is the normal display signal of a single color of the adjacent line, in many cases, the signal level is the same as or similar to the normal display signal of the signal line, and the problem of black line can be further prevented. Even when it occurs, it is when signals are different between adjacent lines, i.e., when the display state is changed at the border, and thus the black line is hardly recognized and causes no problem.

Further, the active-matrix substrate in accordance with the present invention, in the foregoing arrangement, may have an arrangement wherein one of terminals of the auxiliary signal line switching element which is not connected to a signal line is electrically connected to a signal input section to which one of terminals of a signal line switching element, which supplies the data signal to a pixel which should display the same color as that of a pixel electrode which is connected to the signal line, and which is connected to another signal line closest to the signal line of the adjacent block, which is not connected to a signal line is connected.

According to this arrangement, one of terminals of the auxiliary signal line switching element which is not connected to a signal line is electrically connected to a signal input section to which one of terminals of a signal line switching element, which supplies the data signal to a pixel which should display the same color as that of a pixel electrode which is connected to the signal line, and which is connected to another signal line closest to the signal line of the adjacent block, which is not connected to a signal line is connected. In other words, the supply source (auxiliary inversion data supply line) of the preliminary polarity inverse signal for the auxiliary signal line switching element is the signal input section connected to the signal line switching element which supplies the data signal to the pixel which should display the same color as that of the pixel electrode connected to the signal line and which is connected to another signal line of the adjacent block closest to the signal line. Thus, the data of the same color which is inputted from the signal input section to the adjacent block can also function as the preliminary polarity inverse signal of the target block. Therefore, in addition to the effect by the foregoing arrangement, since the signal level which is supplied in advance is the normal display signal of a single color of the adjacent line, in many cases, the signal level is the same as or similar to the normal display signal of the signal line, and the problem of black line can be further prevented. Even when it occurs, it is when signals are different between adjacent lines, i.e., when the display state is changed at the border, and thus the black line is hardly recognized and causes no problem.

Further, the active-matrix substrate in accordance with the present invention, in the foregoing arrangement, may have an arrangement wherein a resistance of the signal line switching element is lower than that of the auxiliary signal line switching element during conduction.

According to this arrangement, a resistance of the signal line switching element is lower than that of the auxiliary signal line switching element during conduction. The auxiliary signal line switching element for carrying out the polarity inversion in advance does not need to have a driving capability for bringing in sufficient charge, and it is only required to cause polarity inversion to some degree. That is, the auxiliary signal line switching element does not need to be designed to be as large as the normal signal line switching element. This allows easy spatial arrangement of the auxiliary signal line switching element, in addition to the effect by the foregoing arrangement.

Further, since the preliminary polarity inversion side has a high-resistance connection while the side of normal application has a low-resistance connection, the normal side can receive the output signal from the signal input section without being affected, even when a noise enters the signal line on the polarity inversion side, thus improving display stability.

Further, as to the load on the side of the signal input section, it is multiplied when the connection is made by the same line switching element, and since the polarity is inverted, the signal input section is susceptible to oscillation, which, depending on the driving capability of the signal input section, may cause improper output, or malfunction of the signal input section due to latch-up. In the structure of the present embodiment, however, the apparent load on the signal input section at the same moment is smaller than the foregoing case, thus solving the foregoing problems.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A data transfer method in which scanning lines in a row direction and signal lines in a column direction are formed in a matrix pattern, and a data signal which corresponds to a position on the matrix is applied within one horizontal period to a signal line which corresponds to this position, the signal lines being divided into a plurality of blocks and being sequentially conducted for each line per block so as to transfer the data signal between a matrix section and a data transfer section with respect to each block, the method comprising the step of:

with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, conducting the SL2 as preliminary conduction within one horizontal period prior to the time the application of the data signal to the BL1 is finished as normal conduction for applying the data signal.

2. The method as set forth in claim 1, wherein the signal lines of the plurality of blocks are simultaneously conducted within said one horizontal period prior to the time the application of the data signal to the BL1 is finished.

3. The method as set forth in claim 1, wherein, during the preliminary conduction of the BL2, the signal line BL2 which is being preliminarily conducted receives a data signal having intermediate intensity between a maximum value and a minimum value of data signals which are applied to the signal lines.

4. The method as set forth in claim 1, wherein the preliminary conduction of the BL2 is carried out during the normal conduction period of the BL1 within said one horizontal period.

5. The method as set forth in claim 4, wherein the preliminary conduction of the BL2 is finished at the time when the normal conduction of the BL1 is finished within said one horizontal period, and normal conduction of the BL2 is carried out continuously thereafter.

6. A data transfer method for an image display device having scanning lines in a row direction and signal lines in a column direction which are formed in a matrix pattern and displaying an image according to a data signal by a pixel on the matrix, the method applying a data signal which corresponds to a position on the matrix to a signal line which corresponds to this position within one horizontal period, the signal lines being divided into a plurality of blocks, and the data signal being transferred per block from a data transfer section to the pixel by sequentially inverting a polarity of a potential of the signal line for each line per block with respect to a reference voltage, the method comprising the step of:

with respect to at least one pair of the blocks respectively having signal lines which are adjacent to each other, among which a block for which the application of the data signal is finished earlier is BL1, and a block for which the application of the data signal is finished later is BL2, the blocks BL1 and BL2 having adjacent signal lines SL1 and SL2, respectively, inverting a polarity of a potential of the SL2 as preliminary conduction with respect to the reference voltage within one horizontal period, prior to the time the application of the data signal to the BL1 is finished as normal conduction for applying the data signal.

7. The method as set forth in claim 6, wherein the signal lines of the plurality of blocks are simultaneously conducted within said one horizontal period prior to the time the application of the data signal to the BL1 is finished.

8. The method as set forth in claim 6, wherein, during the preliminary conduction of the BL2, the signal line BL2 which is being preliminarily conducted receives a data signal having intermediate intensity between a maximum value and a minimum value of data signals which are applied to the signal lines.

9. The method as set forth in claim 6, wherein the preliminary conduction of the BL2 is carried out during the normal conduction period of the BL1 within said one horizontal period.

10. The method as set forth in claim 9, wherein the preliminary conduction of the BL2 is finished at the time when the normal conduction of the BL1 is finished within said one horizontal period, and normal conduction of the BL2 is carried out continuously thereafter.

11. An image display device having scanning lines in a row direction and signal lines in a column direction which are formed in a matrix pattern and applying a data signal which corresponds to a position on the matrix to a signal line which corresponds to this position within one horizontal period, the signal lines being divided into a plurality of blocks, said image display device displaying an image according to the data signal by a pixel on the matrix by transferring the data signal per block from a data transfer section to the pixel on the matrix by sequentially inverting a polarity of a potential of the signal line for each line per block with respect to a reference voltage, wherein:

with respect to at least one pair of the blocks respectively having signal lines which are adjacent to each other, among which a block for which the application of the data signal is finished earlier is BL1, and a block for which the application of the data signal is finished later is BL2, said blocks BL1 and BL2 having adjacent signal lines SL1 and SL2, respectively, the data signal is transferred within one horizontal period from the data transfer section to the pixel on the matrix by inverting a polarity of a potential of the SL2 as preliminary conduction with respect to the reference voltage, prior to the time the application of the data signal to the BL1 is finished as normal conduction for applying the data signal.

12. An active-matrix substrate which includes a pixel switching element connected to each of a plurality of pixel electrodes, a plurality of scanning lines for driving the pixel switching element, a plurality of signal lines for applying a data signal to the pixel electrodes via the pixel switching element, and a signal input section for supplying the data signal to the signal lines so as to invert a polarity of a voltage of the signal lines, the signal lines being divided into blocks depending on a time the data signal is supplied in one horizontal period, said active-matrix substrate comprising:

a signal branching section for branching the data signal from the signal input section into respective blocks;

a signal line switching element for switching on or switching off supply of the data signal to respective signal lines from the signal branching section by being conducted or not conducted; and a control wire, provided per block, for supplying a conduction signal to the signal line switching element, so as to switch conduction/non-conduction of the signal line switching element per block according to a supply time of the data signal, wherein:

with respect to at least one target block of at least two adjacent blocks, the data signal is applied to a control wire of an adjacent block earlier than a control wire of the target block within one horizontal period, and a signal line of the target block on a border between the adjacent blocks is preliminarily supplied with a preliminary polarity inverse signal for inverting a polarity of a voltage of the signal line of the target block, by an auxiliary signal line switching element which is controlled by being supplied with an auxiliary control signal from another auxiliary control wire which is different from the control wire of the target block, and which is different from the signal line switching element which is controlled by the control wire of the target block, prior to the time the supply of the data signal to the adjacent block is finished within one horizontal period.

13. The active-matrix substrate as set forth in claim 12, wherein:

respective signal lines of the at least two adjacent blocks on the border between these blocks are supplied with the same preliminary polarity inverse signal via their respective auxiliary signal line switching elements, and the supply of the preliminary polarity inverse signal is finished within one horizontal period before the supply of the data signal to the signal line which receives the data signal earlier is started.

14. The active-matrix substrate as set forth in claim 12, wherein the auxiliary control wire is a control wire of another block which receives a conduction signal earlier than the control wire of the target block within one horizontal period.

15. The active-matrix substrate as set forth in claim 14, wherein the auxiliary control wire is the control wire of the adjacent block which receives the conduction signal earlier than the control wire of the target block within one horizontal period.

16. The active-matrix substrate as set forth in claim 12, wherein one of terminals of the auxiliary signal line switching element which is not connected to a signal line is electrically connected to a signal input section to which one of terminals of a signal line switching element which is controlled by the control wire of the target block, which is not connected to a signal line, is connected.

17. The active-matrix substrate as set forth in claim 12, wherein one of terminals of the auxiliary signal line switching element which is not connected to a target signal line is electrically connected to a signal input section to which one of terminals of a signal line switching element which is connected to a signal line, in an adjacent block, adjacent to the target signal line, which is not connected to a signal line, is connected.

18. The active-matrix substrate as set forth in claim 12, wherein one of terminals of the auxiliary signal line switching element which is not connected to a signal line is electrically connected to a signal input section to which one of terminals of a signal line switching element which supplies the data signal to a pixel which should display the same color as that of a pixel electrode which is connected to the signal line, and which is connected to another signal line closest to the signal line of the adjacent block, which is not connected to a signal line, is connected.

19. The active-matrix substrate as set forth in claim 12, wherein a resistance of said signal line switching element is lower than that of the auxiliary signal line switching element during conduction.

* * * * *